US006489088B2

(12) United States Patent
Fukagawa et al.

(10) Patent No.: US 6,489,088 B2
(45) Date of Patent: Dec. 3, 2002

(54) COLOR DIFFUSION-TRANSFER LIGHT-SENSITIVE MATERIAL

(75) Inventors: Nobutaka Fukagawa, Minami-ashigara (JP); Shinichi Ichikawa, Minami-ashigara (JP); Masaru Yoshikawa, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/805,205

(22) Filed: Mar. 14, 2001

(65) Prior Publication Data

US 2002/0042015 A1 Apr. 11, 2002

(30) Foreign Application Priority Data

Mar. 17, 2000 (JP) ..... 2000-77218

(51) Int. Cl.[7] ..... G03C 8/10; G03C 1/295; G03C 8/36

(52) U.S. Cl. ..... 430/391; 430/217; 430/218; 430/219; 430/264; 430/383; 430/598

(58) Field of Search ..... 430/217, 218, 430/219, 598, 391, 383, 264

(56) References Cited

U.S. PATENT DOCUMENTS

| | | | | | |
|---|---|---|---|---|---|
| 4,080,207 | A | * | 3/1978 | Leone et al. | 430/217 |
| 4,255,511 | A | * | 3/1981 | Hirano et al. | 430/217 |
| 4,416,969 | A | * | 11/1983 | Magee et al. | 430/217 |
| H1119 | H | * | 12/1992 | Inoue | 430/598 |
| 5,672,469 | A | * | 9/1997 | Hioki et al. | 430/598 |

FOREIGN PATENT DOCUMENTS

JP 2000330247 11/2000

* cited by examiner

*Primary Examiner*—Richard L Schilling
(74) *Attorney, Agent, or Firm*—Birch, Stewart, Kolasch & Birch, LLP

(57) ABSTRACT

A color diffusion-transfer photographic light-sensitive material provided with at least two light-sensitive silver halide emulsion layers, each of which is combined with a non-diffusive dye image forming compound forming or releasing a diffusive dye or its precursor in relation to silver development, or with a dye image forming compound whose diffusibility changes in relation to silver development, on a support, the light-sensitive material comprises a specific hydrazine compound and a specific compound improved in storability.

4 Claims, No Drawings

COLOR DIFFUSION-TRANSFER LIGHT-SENSITIVE MATERIAL

FIELD OF THE INVENTION

The present invention relates to a color diffusion-transfer photographic light-sensitive material, and particularly to a color diffusion-transfer photographic light-sensitive material that is improved in the storability of a nucleating agent and a light-sensitive material.

BACKGROUND OF THE INVENTION

The present invention relates to a color diffusion-transfer photographic light-sensitive element providing directly a positive photographic image.

In the field of silver halide photographic methods, a photographic method enabling the preparation of a positive photographic image through neither a negative image nor an intermediate process of obtaining a negative image, is referred to as a direct positive photographic method, and a photographic light-sensitive material used in such a photographic method is referred to as a direct positive light-sensitive material.

Although there are various direct positive photographic methods, the most useful are systems in which a positive-type emulsion (silver development takes place at unexposed portions) is combined with a negative-type dye image-forming compound (a dye image is formed at developed (exposed) portions), and systems in which a negative-type emulsion (silver development takes place at exposed portions) is combined with a positive-type dye image-forming compound (a dye image is formed at unexposed portions).

As to the former system, a frequently used method is one in which a silver halide emulsion that has light-sensitive nuclei inside of silver halide particles, is developed in the presence of a nucleating agent, after an exposure step is finished.

Methods of obtaining a direct positive image by carrying out surface development of an internal latent image-type silver halide photographic emulsion in the presence of a nucleating agent, and photographic emulsions or light-sensitive materials used in such a method, are known from descriptions of, for example, U.S. Pat. No. 2,456,953, No. 2,497,875, No. 2,497,876, No. 2,588,982, No. 2,592,250, No. 2,675,318, and No. 3,227,552; U.K. Patents No. 1,011,062 and No. 1,151,363, and JP-B-43-29,405 ("JP-B" means examined Japanese patent publication).

Various reducing agents can be used as a nucleating agent in the aforementioned method of obtaining a direct positive image. Among these reducing agents, acylhydrazine-type compounds are particularly effective. Thiourea-bonded-type acylhydrazine-series compounds are disclosed in U.S. Pat. No. 4,030,925, No. 4,031,127, No. 4,245,037, No. 4,255,511, No. 4,266,013, and No. 4,276,364; and U.K. Patent No. 2,012,443, and acylhydrazine-series compounds having a thioamide ring or a heterocyclic group, such as triazole or tetrazole, as an adsorbing group, are disclosed in U.S. Pat. No. 4,080,270 and No. 4,278,748, and U.K. Patent No. 2,011,391B.

On the other hand, in the system using a negative-type emulsion and a positive-type image dye-forming agent, it is effective to promote developing by using a nucleating agent, and it is known that the promotion of the formation of a dye image is attained by use of the nucleating agent.

For color diffusion-transfer photographic light-sensitive materials, it is particularly important to make the time short, which is taken from shooting to formation of an appreciable image. For this purpose, an addition of a large amount of a nucleating agent having a strong fogging action is effective to promote developing, in both a negative type emulsion system and a positive type emulsion system. Such an addition makes it possible to obtain an image that requires short emergence time and has a high maximum image density. However, this method, in turn, has the problem that a variation in sensitivity and a rise in minimum image density (Dmin) during storage are significantly occurred.

SUMMARY OF THE INVENTION

A color diffusion-transfer light-sensitive material that has, on a support, at least two light-sensitive silver halide emulsion layers, which are combined with a non-diffusive dye image forming compound that forms or releases a diffusive dye or its precursor in association with silver development, or with a dye image forming compound whose diffusibility changes in association with silver development is provided. This light-sensitive material comprises a compound represented by the following formula (I) and at least one from compounds represented by formulae (II) to (V):

formula (I)

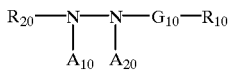

wherein $R_{20}$ represents an aliphatic group, an aromatic group, or a heterocyclic group, $R_{10}$ represents a hydrogen atom, or a block group, $G_{10}$ represents —CO—, —COCO—, —C(=S)—, —$SO_2$—, —SO—, or —PO($R_{30}$)— group ($R_{30}$ is selected from the same range of the groups defined for $R_{10}$, and $R_{30}$ may be different from $R_{10}$), or an iminomethylene group, and $A_{10}$ and $A_{20}$ each represent a hydrogen atom, or one of $A_{10}$ and $A_{20}$ represents a hydrogen atom and the other represents a substituted or unsubstituted alkylsulfonyl group, a substituted or unsubstituted arylsulfonyl group, or a substituted or unsubstituted acyl group;

formula (II)

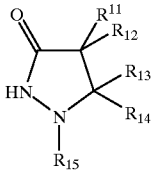

wherein each of $R_{11}$, $R_{R12}$, $R_{13}$, and $R_{14}$ independently represent a hydrogen atom, an aryl group, a chain or cyclic alkyl group, a chain or cyclic alkenyl group, or an alkinyl group, and $R_{15}$ represents a chain or cyclic alkyl group, a chain or cyclic alkenyl group, an alkinyl group, an aryl group, or a heterocyclic group; formula (III)

$$(Het)_{k1}[(Q)_{k2}(Hy)]_{k3}$$

wherein Het represents an adsorptive group to a silver halide, provided that the group represented by Het is substituted by at least one —(Q)k2—(Hy); Q represents a divalent connecting group that comprises an atom or an atomic group containing at least one of a carbon atom, a nitrogen atom, a sulfur atom, and an oxygen atom, Hy represents a group having a hydrazine structure represented by $R_1R_2N—NR_3R_4$, each of $R_1$, $R_2$, $R_3$, and $R_4$ independently represent an alkyl group, an alkenyl group, an alkinyl group, an aryl group, or a heterocyclic group, and $R_1$ and $R_2$, $R_3$ and $R_4$, $R_1$ and $R_3$, or $R_2$ and $R_4$ may respectively bond to form a ring, provided that at least one of $R_1$, $R_2$, $R_3$, and $R_4$ is an alkylene group, an alkenylene group, an alkinylene group, an arylene group, or a divalent heterocyclic residue, to be substituted by —(Q)k2—(Het)k1, k1 and k3 independently denote 1, 2, 3 or 4, and k2 denotes 0 or 1;

formula (IV-A)

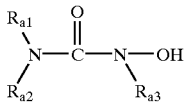

formula (IV-B)

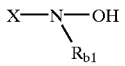

formula (IV-C)

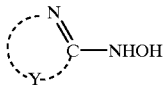

wherein in formula (IV-A), $R_{a1}$ represents a substituted or unsubstituted alkyl, alkenyl, or aryl group, $R_{a2}$ represents a hydrogen atom, or a group defined for $R_{a1}$, $R_{a3}$ represents a hydrogen atom, or a substituted or unsubstituted alkyl or alkenyl group having 1 to 10 carbon atoms, and $R_{a1}$ and $R_{a3}$, or $R_{a2}$ and $R_{a3}$ may bond with each other to form a five- to seven-membered ring; in formula (IV-B), X represents a heterocyclic group, $R_{b1}$ represents an alkyl group, an alkenyl group, or an aryl group, X and $R_{b1}$ may bond with each other to form a five- to seven-membered ring; and in formula (IV-C), Y represents a non-metal atomic group required to form a five-membered ring in combination with a —N═C— group; Y further represents a non-metal atomic group required to form a six-membered ring in combination with a —N═C— group, and the end of Y, which connects with the carbon atom of the —N═C— group, represents one group (that connects with the carbon atom of an —N═C— group on the left side of each group) selected from the group consisting of $—N(R_{C1})—$, $—C(R_{C2})(R_{C3})—$, $—C(R_{C4})═$, —O— and S—; each of $R_{C1}$, $R_{C2}$, $R_{C3}$ and $R_{C4}$ independently represent a hydrogen atom or a substituent;

formula (V)

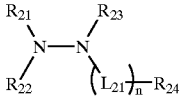

wherein in formula (V), each of $R_{21}$, $R_{22}$ and $R_{23}$ independently represent a hydrogen atom, an alkyl group, an alkenyl group, an alkinyl group, an aryl group, or a heterocyclic group, $R_{24}$ represents a hydrogen atom, an alkyl group, an alkenyl group, an alkinyl group, an aryl group, a heterocyclic group, or $NR_{25}R_{26}$, $L_{21}$, represents —CO— or $—SO_2—$, n denotes 0 or 1, $R_{25}$ represents a hydrogen atom, a hydroxy group, an amino group, an alkyl group, an alkenyl group, an alkinyl group, an aromatic group, or a heterocyclic group, $R_{26}$ represents an alkyl group, an alkenyl group, an alkinyl group, an aromatic group, or a heterocyclic group, $R_{21}$ and $R_{22}$, $R_{21}$, and $R_{23}$, $R_{23}$ and $R_{24}$, or $R_{24}$ and $R_{22}$ may bond with each other to form a ring.

DETAILED DESCRIPTION OF THE INVENTION

The inventors of the present invention have conducted earnest studies and, as a result, there are provided the following light-sensitive material.

<1> A color diffusion-transfer light-sensitive material that has, on a support, at least two light-sensitive silver halide emulsion layers, which are combined with a non-diffusive dye image forming compound that forms or releases a diffusive dye or its precursor in association with silver development, or with a dye image forming compound whose diffusibility changes in association with silver development, wherein the light-sensitive material comprises a compound represented by the following formula (I) and at least one from compounds represented by formulae (II) to (V):

formula (I)

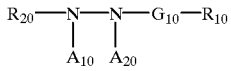

wherein $R_{20}$ represents an aliphatic group, an aromatic group, or a heterocyclic group, $R_{10}$ represents a hydrogen atom, or a block group, $G_{10}$ represents —CO—, —COCO—, —C(═S)—, $—SO_2—$, —SO—, or —PO($R_{30}$)— group ($R_{30}$ is selected from the same range of the groups defined for $R_{10}$, and $R_{30}$ may be different from $R_{10}$), or an iminomethylene group, and $A_{10}$ and $A_{20}$ each represent a hydrogen atom, or one of $A_{10}$ and $A_{20}$ represents a hydrogen atom and the other represents a substituted or unsubstituted alkylsulfonyl group, a substituted or unsubstituted arylsulfonyl group, or a substituted or unsubstituted acyl group;

formula (II)

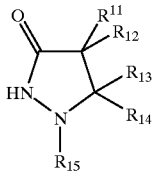

wherein each of $R_{11}$, $R_{12}$, $R_{13}$, and $R_{14}$ independently represent a hydrogen atom, an aryl group, a chain or cyclic alkyl group, a chain or cyclic alkenyl group, or an alkinyl group, and $R_{15}$ represents a chain or cyclic alkyl group, a chain or cyclic alkenyl group, an alkinyl group, an aryl group, or a heterocyclic group; formula (III)

$$(Het)_{k1}—[(Q)_{k2}—(Hy)]_{k3}$$

wherein Het represents an adsorptive group to a silver halide, provided that the group represented by Het is substituted by at least one —(Q)k2—(Hy); Q represents a divalent connecting group that comprises an atom or an atomic group containing at least one of a carbon atom, a nitrogen atom, a sulfur atom, and an oxygen atom, Hy represents a group having a hydrazine structure represented by $R_1R_2N—NR_3R_4$, each of $R_1$, $R_2$, $R_3$, and $R_4$ independently represent an alkyl group, an alkenyl group, an alkinyl group, an aryl group, or a heterocyclic group, and $R_1$ and $R_2$, $R_3$ and $R_4$, $R_1$ and $R_3$, or $R_2$ and $R_4$ may respectively bond to form a ring, provided that at least one of $R_1$, $R_2$, $R_3$, and $R_4$ is an alkylene group, an alkenylene group, an alkinylene group, an arylene group, or a divalent heterocyclic residue, to be substituted by —(Q)k2—(Het)k1, k1 and k3 independently denote 1, 2, 3 or 4, and k2 denotes 0 or 1;

formula (IV-A)

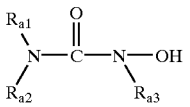

formula (IV-B)

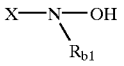

formula (IV-C)

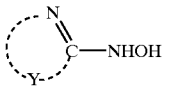

wherein in formula (IV-A), $R_{a1}$ represents a substituted or unsubstituted alkyl, alkenyl, or aryl group, $R_{a2}$ represents a hydrogen atom, or a group defined for $R_{a1}$, $R_{a3}$ represents a hydrogen atom, or a substituted or unsubstituted alkyl or alkenyl group having 1 to 10 carbon atoms, and $R_{a1}$ and $R_{a3}$ or $R_{a2}$ and $R_{a3}$ may bond with each other to form a five- to seven-membered ring; in formula (IV-B), X represents a heterocyclic group, $R_{b1}$ represents an alkyl group, an alkenyl group, or an aryl group, X and $R_{b1}$ may bond with each other to form a five- to seven-membered ring; and in formula (IV-C), Y represents a non-metal atomic group required to form a five-membered ring in combination with a —N═C— group; Y further represents a non-metal atomic group required to form a six-membered ring in combination with a —N═C— group, and the end of Y, which connects with the carbon atom of the —N═C— group, represents one group (that connects with the carbon atom of an —N═C— group on the left side of each group) selected from the group consisting of —N($R_{C1}$)—, —C($R_{C2}$)($R_{C3}$)—, —C($R_{C4}$)═, —O— and S—; each of $R_{C1}$, $R_{C2}$, $R_{C3}$, and $R_{C4}$ independently represent a hydrogen atom or a substituent;

formula (V)

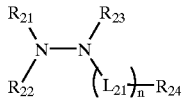

wherein in formula (V), each of $R_{21}$, $R_{22}$ and $R_{23}$ independently represent a hydrogen atom, an alkyl group, an alkenyl group, an alkinyl group, an aryl group, or a heterocyclic group, $R_{24}$ represents a hydrogen atom, an alkyl group, an alkenyl group, an alkinyl group, an aryl group, a heterocyclic group, or $NR_{25}R_{26}$, $L_{21}$ represents —CO— or —$SO_2$—, n denotes 0 or 1, $R_{25}$ represents a hydrogen atom, a hydroxy group, an amino group, an alkyl group, an alkenyl group, an alkinyl group, an aromatic group, or a heterocyclic group, $R_{26}$ represents an alkyl group, an alkenyl group, an alkinyl group, an aromatic group, or a heterocyclic group, $R_{21}$ and $R_{22}$, $R_{21}$ and $R_{23}$, $R_{23}$ and $R_{24}$, or $R_{24}$ and $R_{22}$ may bond with each other to form a ring.

<2> The color diffusion-transfer light-sensitive material according to the above <1>, which is a color diffusion film unit comprising a light-sensitive sheet (1) that comprises an image receiving layer, a white reflecting layer, a light-shielding layer, and the at least two light-sensitive silver halide emulsion layers combined with the dye image forming compound, and contains the compound represented by formula (I) and at least one of the compounds represented by formulae (II) to (V), on a transparent support, a transparent cover sheet (2) that has a neutralizing layer and a neutralizing timing layer, on a transparent support, and a light-shielding alkali processing composition (3), which is arranged such that it developes between the light-sensitive sheet (1) and the transparent cover sheet (2).

<3> The color diffusion-transfer light-sensitive material according to the above <1>, which is a color diffusion-transfer film unit comprising an image receiving sheet (1) that includes at least a neutralizing layer, a neutralizing timing layer, an image receiving layer, and a peel layer, on a support provided with light-shielding property, a light-sensitive sheet (2) that includes the at least two light-sensitive silver halide emulsion layers combined with the dye image forming compound, and contains the compound represented by said formula (I) and the at least one compound represented by said formulae (II) to (V), on a support provided with light-shielding property, and an alkali processing composition (3), which is arranged such that it develops between the image receiving sheet (1) and the light-sensitive sheet (2).

In the single use of the compound (I) for use in the present invention, it was impossible to solve a dilemma that an image, which was short in image emergence time and had high maximum image density could be obtained, by increasing the addition amount or by using a compound having a high fogging action, whereas a reduction in sensitivity and a rose in minimum image density, after long term storage, became conspicuous. However, when at least one type of the compounds (II) to (IV) for use in the present invention is used together, surprisingly, such a result was obtained: a reduction in sensitivity and a rise in minimum image density, after long term storage, are small, though the image emergent time is made shorter and the maximum image density becomes high.

The compound (I) for use in the present invention will be hereinafter explained in detail.

In formula (I), the aliphatic group represented by $R_{20}$ is preferably a substituted or unsubstituted and straight-chain, branched or cyclic alkyl, alkenyl or alkinyl group having 1 to 30 carbon atoms.

In formula (I), the aromatic group represented by $R_{20}$ is preferably a monocyclic or condensed cyclic aryl group. As examples of the aromatic group, a benzene ring and naphthalene ring can be mentioned. The heterocyclic group represented by $R_{20}$ is a monocyclic or condensed ring, and saturated or unsaturated aromatic or non-aromatic heterocyclic group. Given as examples of the heterocyclic group are a pyridine ring, pyrimidine ring, imidazole ring, pyrazole ring, quinoline ring, isoquinoline ring, benzimidazole ring, thiazole ring, benzothiazole ring, piperidine ring, triazine ring, and the like.

Preferably $R_{20}$ is an aryl group, and particularly preferably $R_{20}$ is a phenyl group.

The group represented by $R_{20}$ may be substituted. Typical examples of the substituent include halogen atoms (a fluorine atom, chlorine atom, bromine atom, or iodine atom), alkyl groups (including an aralkyl group, cycloalkyl group, active methine group, and the like), alkenyl groups, alkinyl groups, aryl groups, heterocyclic groups, heterocyclic groups containing a quaternarized nitrogen atom (e.g., a pyridinio group), acyl groups, alkoxycarbonyl groups, aryloxycarbonyl groups, carbamoyl groups, carboxy groups or their salts, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy group, alkoxy groups (including a group containing a unit of an ethyleneoxy or propyleneoxy group repeatedly), aryloxy groups, heterocyclic oxy groups, acyloxy groups, (alkoxy or aryloxy)carbonyloxy groups, carbamoyloxy groups sulfonyloxy groups, amino groups, (alkyl, aryl, or heterocyclic)amino groups, N-substituted nitrogen-containing heterocyclic groups, acylamino groups, sulfonamido groups, ureido groups, thioureido groups, isothioureido groups, imido groups, (alkoxy or aryloxy )carbonylamino groups, sulfamoylamlno groups, semicarbazide groups, thiosemicarbazide groups, hydrazino groups, quaternary ammonio groups, oxamoylamino groups, (alkyl or aryl)sulfonylureido groups, acylureido groups, N-acylsulfamoylamino groups, nitro groups, mercapto groups, (alkyl, aryl, or heterocyclic)thio groups, (alkyl or aryl)sulfonyl groups, (alkyl or aryl)sulfinyl groups, sulfo groups or their salts, sulfamoyl groups, N-acylsulfamoyl groups, sulfonylsulfamoyl groups or their salt, groups containing a phosphoric acid amide or a phosphate structure, and the like.

These substituents may be further substituted with these above substituents.

Preferable examples of the substituent, which $R_{20}$ may have, include alkyl groups having 1 to 30 carbon atoms (including an active methylene group), aralkyl groups, heterocyclic groups, substituted amino groups, acylamino groups, sulfonamido groups, ureido groups, sulfamoylamino groups, imide groups, thioureido groups, phosphoric acid amide groups, hydroxy groups, alkoxy groups, aryloxy groups, acyloxy groups, acyl groups, alkoxycarbonyl groups, aryloxycarbonyl groups, carbamoyl groups, carboxy groups (including their salts), (alkyl, aryl or heterocyclic) thio groups, sulfo groups (including their salts), sulfamoyl groups, halogen atoms, cyano groups, nitro groups, and the like.

In formula (I), $R_{10}$ represents a hydrogen atom or a block group. The block group means, specifically, alkyl groups, alkenyl groups, alkinyl groups, aryl groups, heterocyclic groups, alkoxy groups, aryloxy groups, amino groups, and hydrazino groups.

As the alkyl group represented by $R_{10}$, alkyl groups having 1 to 10 carbon atoms are preferable and examples are a methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group, and the like. As the alkenyl group, alkenyl groups having 1 to 10 carbon atoms are preferable, and example are a vinyl group, 2,2-dicyanovinyl group, 2-ethoxycarbonylvinyl group, 2-trifluoro-2-methoxycarbonylvinyl group, and the like. As the alkinyl group, alkinyl groups having 1 to 10 carbon atoms are preferable, those can be mentioned are an ethynyl group, 2-methoxycarbonylethynyl group, and the like. As the aryl group, monocyclic or condensed ring aryl groups are preferable, and those containing a benzene ring are particularly preferable. Given as specific examples of the aryl group are a phenyl group, 3,5-dichlorophenyl group, 2-methanesulfonamidophenyl group, 2-carbamoylphenyl group, 4-cyanophenyl group, 2-hydroxymethylphenyl group, and the like.

As the heterocyclic group, heterocyclic groups of five- and six-membered saturated or unsaturated monocyclic or condensed ring and containing at least one of a nitrogen atom, oxygen atom, and sulfur atom, or nitrogen-containing heterocyclic groups containing a quaternary nitrogen atom may be preferably used. Examples are a morpholino group, piperidino group (N-substituted), piperazino group, imidazolyl group, indazolyl group (e.g., 4-nitroindazolyl group, and the like), pyrazolyl group, triazolyl group, benzoimidazolyl group, tetrazolyl group, pyridyl group, pyridinio group (e.g., N-methyl-3-pyridinio group, and the like), quinolinio group, and quinolyl group. A morpholino group, piperidino group, pyridyl group, pyridinio group, and the like are particularly preferable.

As the alkoxy group, alkoxy groups having 1 to 8 carbon atoms are preferable, and examples are a methoxy group, 2-hydroxyethoxy group, benzyloxy group, and the like. As the aryloxy group, phenoxy groups are preferable. As the amino group, unsubstituted amino groups, alkyl amino groups having 1 to 10 carbon atoms, arylamino groups, and saturated or unsaturated heterocyclic amino groups (including nitrogen-containing heterocyclic groups containing a quaternary nitrogen atom) are preferable. Examples of the amino group include a 2,2,6,6-tetramethylpiperidine-4-ylamino group, propylamino group, 2-hydroxyethylamino group, anilino group, o-hydroxyanilino group, 5-benzotriazolylamino group, N-benzyl-3-pyridinioamino group, and the like. As the hydrazino group, substituted or unsubstituted hydrazino groups, and substituted or unsubstituted phenylhydrazino groups (e.g., a 4-benzenesulfonamidophenylhydrazino group) are particularly preferable.

The group represented by $R_{10}$ may be substituted. As preferable substituents, those exemplified for $R_{20}$ are applied.

In formula (I), $R_{10}$ may be a group that causes a cyclization reaction to split the $G_{10}$-$R_{10}$ portion from the remainder molecule, and to form a ring structure containing atoms in the $G_{10}$-$R_{10}$ portion. As examples of such a group, those described in JP-A-63-29751 ("JP-A" means unexamined published Japanese patent application; further, the references mentioned hereinafter are incorporated herein by reference) are given.

To the hydrazine derivatives represented by formula (I), an adsorptive group, which adsorbs to a silver halide, may be incorporated. Given as examples of such an adsorptive group are alkylthio groups, arylthlio groups, thiourea groups, thioamido groups, mercapto heterocyclic groups, triazole groups, and the like, as described in U.S. Pat. No. 4,385,108 and No. 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorptive groups, which adsorbs to a silver halide, may be in the form of a precursor. As examples of such a precursor, groups described in JP-A-2-285344 are given.

Each of $R_{10}$ and $R_{20}$ in formula (I) may be a group into which a ballasting group or polymer ordinary used in immobile photographic additives such as a coupler, is incorporated. The "ballasting group", in the present invention, indicates a straight-chain or branched alkyl (or alkylene), alkoxy (alkyleneoxy), alkylamino (or alkyleneamino) or alkylthio group, having 6 or more carbon atoms, or a group having one of these groups as its partial structure. More preferable examples of the ballasting group include a straight-chain or branched alkyl (or alkylene), alkoxy (alkyleneoxy), alkylamino (or alkyleneamino) alkylthio group, having 7 to 24 carbon atoms, or a group having one of these groups as its partial structure. As the polymer, those described in JP-A-1-100530 can be mentioned Each of $R_{10}$ and $R_{20}$ in formula (I) may contain a plurality of hydrazino groups as substituents. In this case, the compounds represented by formula (I) are polymers relative to the hydrazino group. Specific examples of such polymers include compounds described in JP-A-64-86134, JP-A-4-16938, JP-A-5-197091, WO95-32452, WO95-32453, JP-A-9-179229, JP-A-9-235264, JP-A-9-235265, JP-A-9-235266, JP-A-9-235267, and the like.

Each of $R_{10}$ and $R_{20}$ in formula (I) may contain a cationic group (specifically, a group containing a quaternary ammonio group, group containing a quaternary phosphorus atom, or nitrogen-containing heterocyclic group containing a quaternary nitrogen atom), group containing a recurring unit of an ethyleneoxy group or propyleneoxy group, (alkyl, aryl or heterocyclic)thio group, or dissociable group (a group containing a low acidic proton, which is dissociable in an alkaline developing solution, a partial structure of the group, or salt of the group, specifically, for example, carboxy group/—COOH, sulfo group/—$SO_3H$, phosphonic acid group/—$PO_3H$, phosphoric acid group/—$OPO_3H$, hydroxy group/-OH group, mercapto group/—SH, —$SO_2NH_2$ group, N-substituted sulfonamido group/—$SO_2NH$-group, —$CONHSO_2$— group, —$CONHSO_2NH$— group, —$NHCONHSO_2$—group, —$SO_2NHSO_2$— group, —CONHCO— group, active methylene group, —NH— group that is Inherent in a nitrogen-containing heterocyclic group, or salts of these groups). Examples containing these groups include compounds described in JP-A-7-234471, JP-A-5-333466, JP-A-6-19032, JP-A-6-19031, JP-A-5-45761, U.S. Patents No. 4,994,365 and No. 4,988,604, JP-A-7-259240, JP-A-7-5610, JP-A-7-244348, German Patent No. 4006032, JP-A-11-7093, and the like.

$A_{10}$ and $A_{20}$ in formula (I) respectively represent a hydrogen atom, alkyl- or arylsulfonyl group having 20 or less carbon atoms (preferably, a phenylsulfonyl group, or a phenylsulfonyl group substituted with a substituent such that the sum of Hammett's substituent constant becomes −0.5 or more), acyl group having 20 or less carbon atoms (preferably, a benzoyl group, or a benzoyl group substituted with a substituent such that the sum of Hammett's substituent constant becomes −0.5 or more, or a straight-chain, branched or cyclic, substituted or unsubstituted aliphatic acyl group (where examples of the substituent include a halogen atom, ether group, sulfonamido group, carbonamido group, hydroxy group, carboxy group, sulfo group, and the like). As $A_{10}$ and $A_{20}$, a hydrogen atom is most preferable.

Next, particularly preferable hydrazine derivatives, in the present invention, will be explained.

As $R_{20}$, a substituted phenyl group is particularly preferable. As the substituent, a sulfonamido group, acylamino group, ureido group, carbamoyl group, thioureido group, isothioureido group, sulfamoylamino group, N-acylsulfamoylamino group, and the like, is particularly preferable, and a sulfonamido group, ureido group, and carbamoyl group is further more preferable.

In the hydrazine derivative represented by formula (I), it is particularly preferable that $R_{20}$ or $R_{10}$ is directly or indirectly substituted with at least one of a ballasting group, an adsorptive group to a silver halide, a group containing a quaternary ammonio group, a nitrogen-containing heterocyclic group containing a quaternary nitrogen atom, a group containing a recurring unit of an ethyleneoxy group, an (alkyl-, aryl- or heterocyclic)thio group, a dissociable group that is dissociable in an alkaline developing solution, and a hydrazino group (a group represented by —NHNH—$G_{10}$—$R_{10}$) that can form a polymer. Furthermore, $R_{20}$ preferably has directly or indirectly any one of the aforementioned groups as its substituent. It is most preferable that $R_{20}$ represent a phenyl group substituted with a benzenesulfonamido group, and have any one of the aforementioned groups directly or indirectly as the substituent on the benzene ring of the benzenesulfonamido group.

Those preferable ones among the groups represented by $R_{10}$ are hydrogen atom, alkyl group, alkenyl group, alkinyl group, aryl group, and heterocyclic group, when $G_{10}$ is a —CO— group. A hydrogen atom, alkyl group, and substituted aryl group (as the substituent, an electron attractive group and o-hydroxymethyl group are particularly preferable) are more preferable, and a hydrogen atom and alkyl group are most preferable.

When $G_{10}$ is a —COCO— group, an alkoxy group, aryloxy group, and amino group are preferable, and a substituted-amino group, specifically, an alkylamino group, arylamino group, and saturated or unsaturated heterocyclic amino group are particularly preferable.

When $G_{10}$ is —$SO_2$- group, $R_{10}$ is preferably an alkyl group, aryl group or substituted amino group.

In formula (I), $G_{10}$ is preferably a —CO— group or —COCO— group, and particularly preferably a —CO— group.

Next, specific examples of the compound represented by formula (I) are shown below. However, the present invention is not limited to the following compounds.

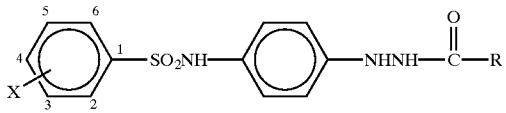
| | X = | R = —H | —$C_2F_4$—COOH (or —$C_2F_4$–$COO^{\ominus}K^{\oplus}$) | 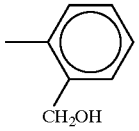 | 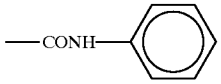 |
|---|---|---|---|---|---|
| I-1 | 3-$NHCOC_9H_{19}$(n) | 1a | 1b | 1c | 1d |
| I-2 | 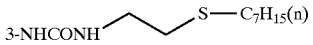 | 2a | 2b | 2c | 2d |
| I-3 | 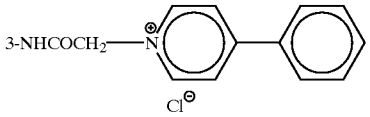 | 3a | 3b | 3c | 3d |
| I-4 | 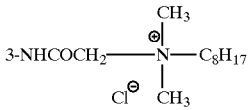 | 4a | 4b | 4c | 4d |
| I-5 | 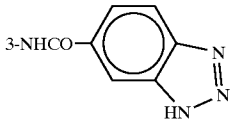 | 5a | 5b | 5c | 5d |
| I-6 | 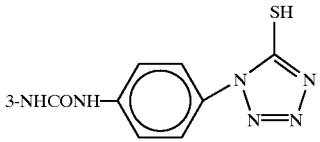 | 6a | 6b | 6c | 6d |
| I-7 | 2,4-$(CH_3)_2$-3-$SC_2H_4$—$(OC_2H_4)_4$—$OC_8H_{17}$ | 7a | 7b | 7c | 7d |

-continued
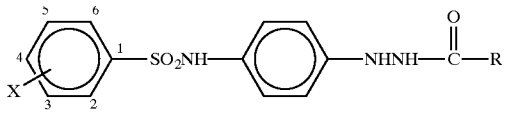
| | X = | R = —H | —$CF_2H$ | 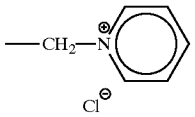 | 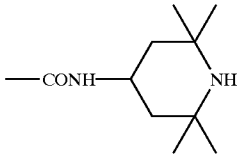 |
|---|---|---|---|---|---|
| I-8 | 3-$CONHCH_2CH(C_2H_5)$—$C_4H_8$ | 8a | 8e | 8f | 8g |
| I-9 | 6-$OCH_3$-3-$C_5H_{11}$(t) | 9a | 9e | 9f | 9g |
| I-10 | 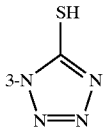 | 10a | 10e | 10f | 10g |
| I-11 | 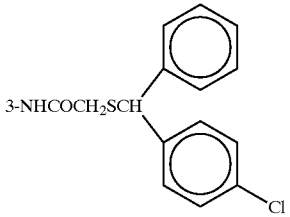 | 11a | 11e | 11f | 11g |
| I-12 | 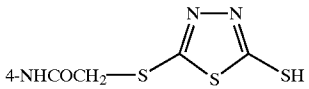 | 12a | 12e | 12f | 12g |
| I-13 | 3-$NHCOCH(CH_2COOH)$—$C_8H_{17}$ | 13a | 13e | 13f | 13g |

-continued
| | | | | | |
|---|---|---|---|---|---|
| I-14 | 3,5—(CONHCH$_2$CH(C$_2$H$_5$)—C$_4$H$_8$)$_2$ | 14a | 14e | 14f | 14g |
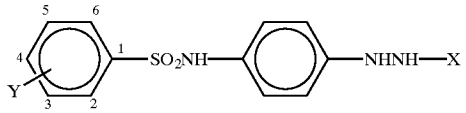
| | Y = | X = —CHO | —COCF$_3$ | —SO$_2$CH$_3$ | —P(=O)(OC$_2$H$_5$)$_2$ |
|---|---|---|---|---|---|
| I-15 | 3-NHCOCH$_2$N$^{\oplus}$(C$_6$H$_4$)—CONHC$_4$H$_9$ •Cl$^{\ominus}$ | 15a | 15h | 15i | 15j |
| I-16 | 4-NHCO(CH$_2$)$_2$N$^{\oplus}$(C$_4$H$_8$)—C$_6$H$_{13}$ Cl$^{\ominus}$ | 16a | 16h | 16i | 16j |
| I-17 | 3-SO$_2$NH—(CH$_2$)$_3$—(O—CH$_2$)$_4$—OC$_4$H$_9$ | 17a | 17h | 17i | 17j |
| I-18 | 3,4-(COOCH(CH$_3$)COOC$_4$H$_9$)$_2$ | 18a | 18h | 18i | 18j |
| I-19 | 3-NHCO—(CH$_2$)$_4$—(1,2-dithiolane) | 19a | 19h | 19i | 19j |
| I-20 | 3-NHSO$_2$NH—C$_8$H$_{17}$ | 20a | 20h | 20i | 20j |

-continued
| | | | | | |
|---|---|---|---|---|---|
| I-21 | 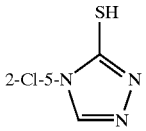 | 21a | 21h | 21i | 21j |
| | | R = | | | |
| | | —H | —$CF_2H$ | 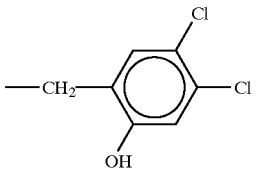 | —$CONHC_3H_7$ |
| I-22 | 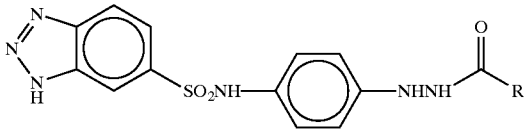 | 22a | 22e | 22k | 22l |
| I-23 | 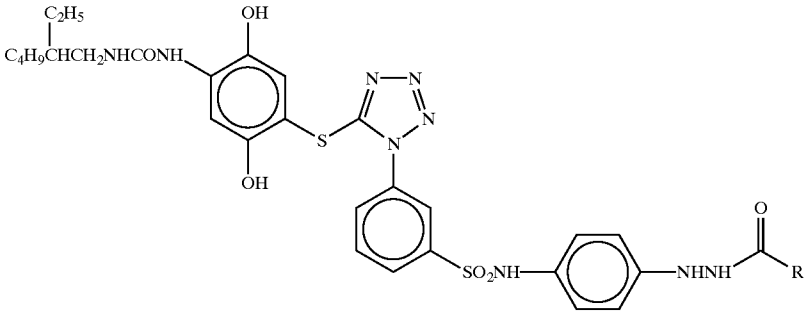 | 23a | 23e | 23k | 23l |

-continued
| | | | | |
|---|---|---|---|---|
| I-24 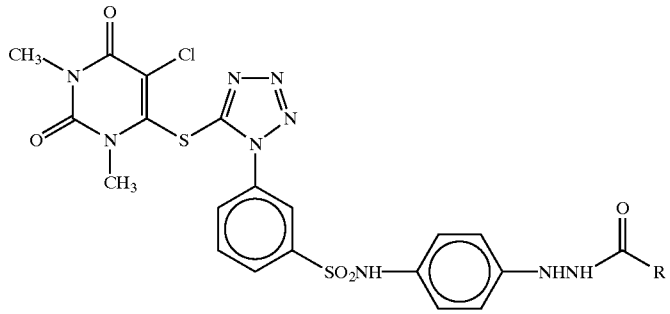 | 24a | 24e | 24k | 24l |
| I-25 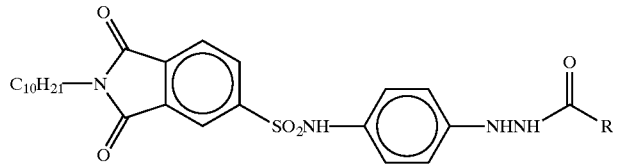 | 25a | 25e | 25k | 25l |
| I-26 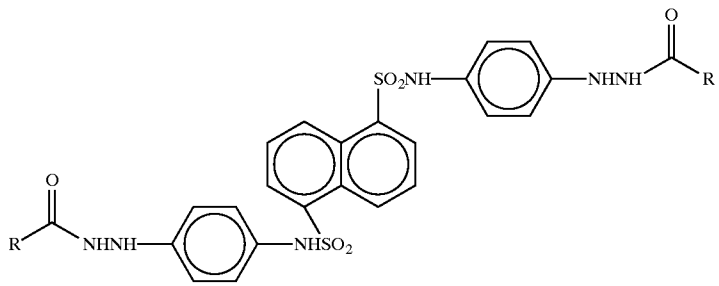 | 26a | 26e | 26k | 26l |
| I-27 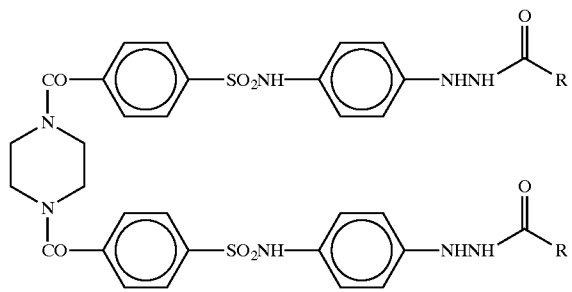 | 27a | 27e | 27k | 27l |

-continued
| | | | | | |
|---|---|---|---|---|---|
| I-28 | 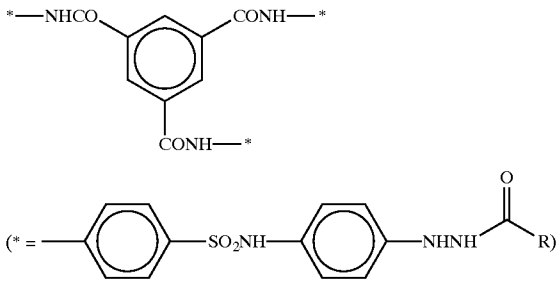 | 28a | 28e | 28k | 28l |
| | 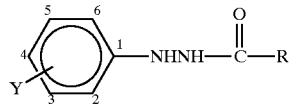 | | | | |
| | Y = | —H | —$CH_2OCH_3$ | 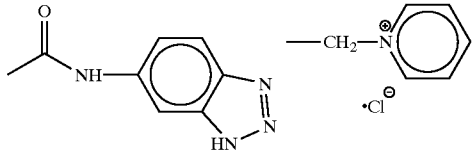 | |
| I-29 | 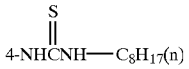 | 29a | 29m | 29n | 29f |
| I-30 | 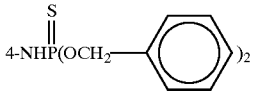 | 30a | 30m | 30n | 30f |
| I-31 | 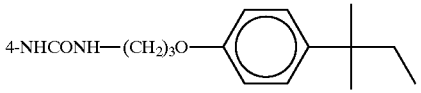 | 31a | 31m | 31n | 31f |
| I-32 | 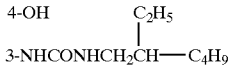 | 32a | 32m | 32n | 32f |

-continued
| | | | | | |
|---|---|---|---|---|---|
| I-33 | 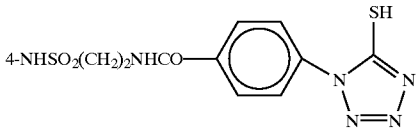 | 33a | 33m | 33n | 33f |
| I-34 | 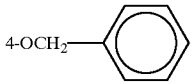 | 34a | 34m | 34n | 34f |
| I-35 | 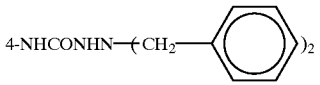 | 35a | 35m | 35n | 35f |
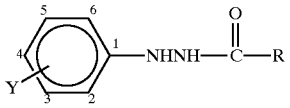
| Y = | R = —H | R = —$C_3F_6$—COOH | R = —$CONHCH_3$ | R = 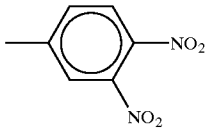 |
|---|---|---|---|---|
| I-36 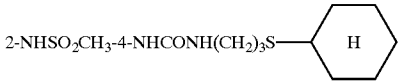 | 36a | 36o | 36p | 36q |
| I-37 2-$OCH_3$-4-$NHSO_2C_{12}H_{25}$ | 37a | 37o | 37p | 37q |
| I-38 3-$NHCOC_{11}H_{23}$-4-$NHSO_2CF_3$ | 38a | 38o | 38p | 38q |
| I-39 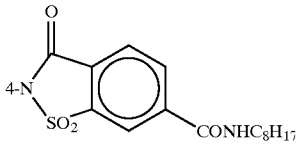 | 39a | 39o | 39p | 39q |
| I-40 4-$OCO(CH_2)_2COOC_6H_{13}$ | 40a | 40o | 40p | 40q |

-continued
| | | | | | |
|---|---|---|---|---|---|
| I-41 | 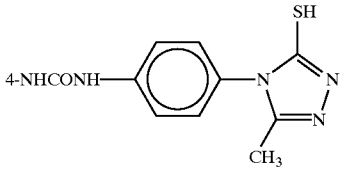 | 41a | 41o | 41p | 41q |
| I-42 | 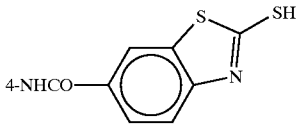 | 42a | 42o | 42p | 42q |
| I-43 | 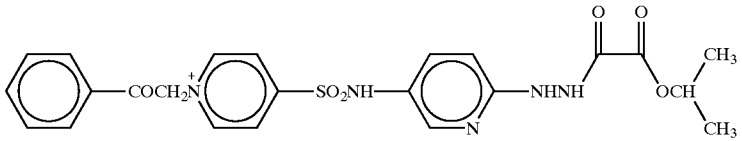 | | | | |
| I-44 | 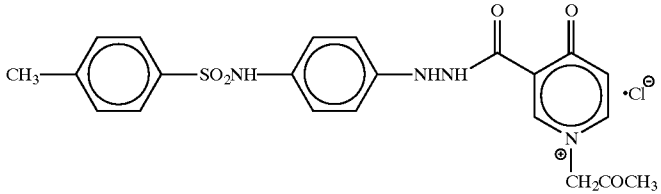 | | | | |
| I-45 | 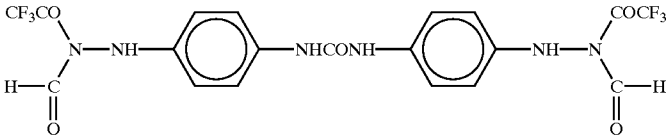 | | | | |
| I-46 | 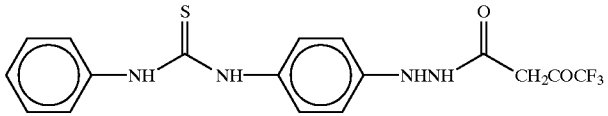 | | | | |

-continued
I-47
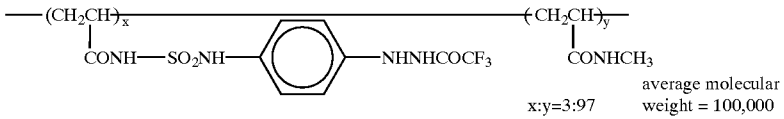
I-48
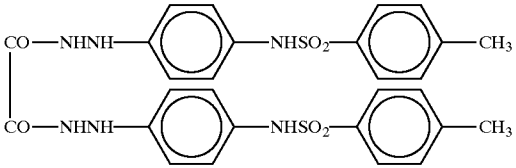
I-49
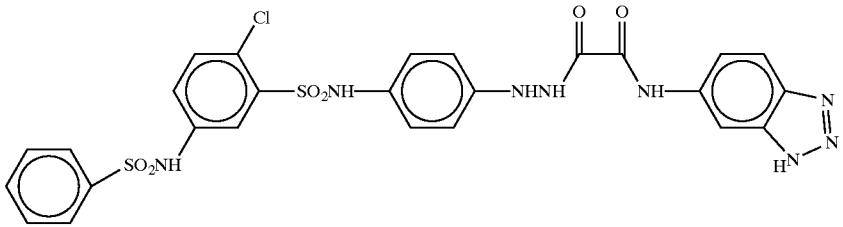
I-50
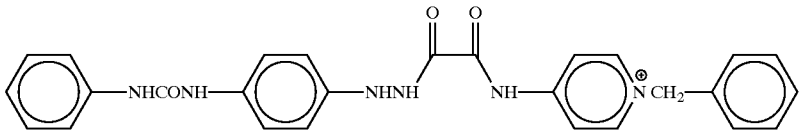
I-51
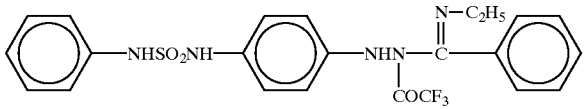
I-52
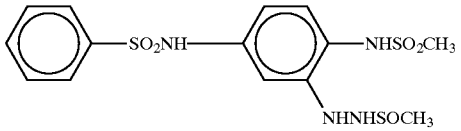

-continued
I-53
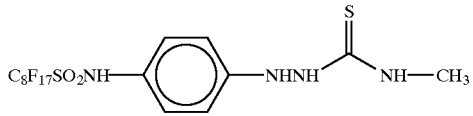
I-54
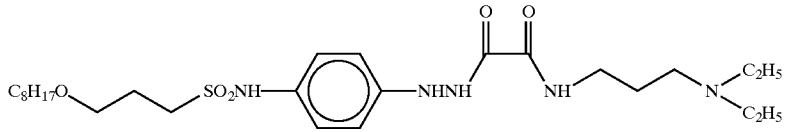
I-55
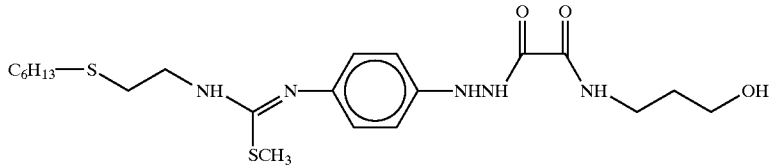
I-56
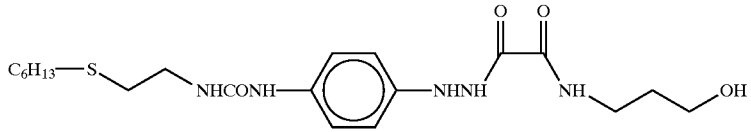
I-57
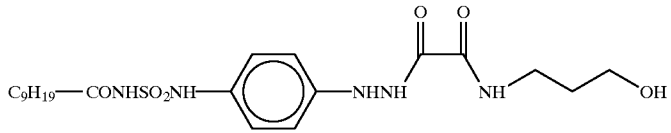
I-58
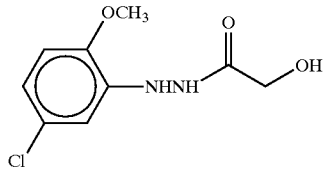
I-59
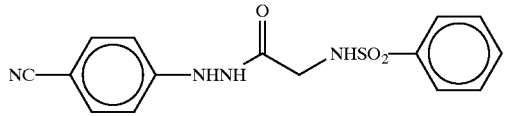

-continued
I-60
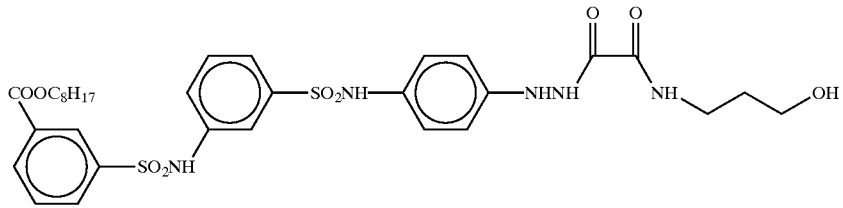
I-61
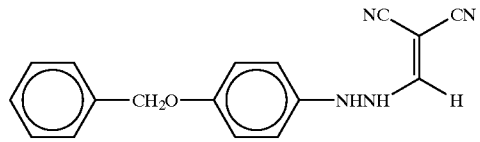
I-62
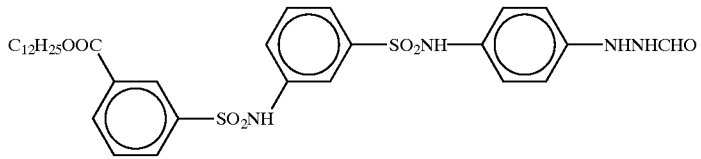
I-63
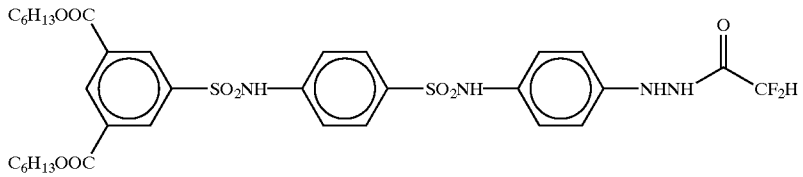
I-64
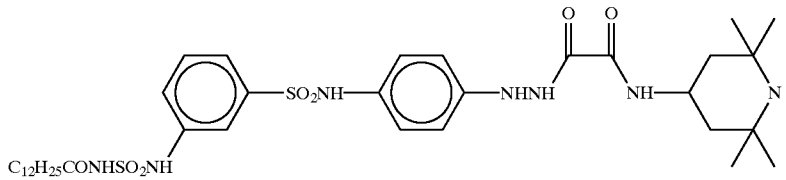

-continued
I-65
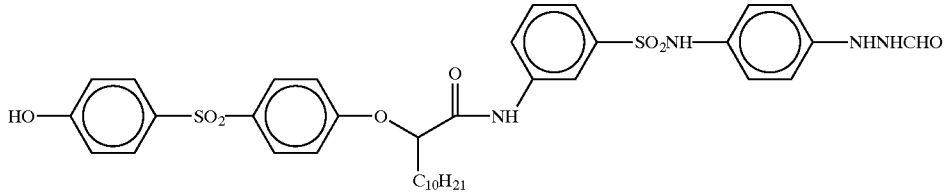
I-66
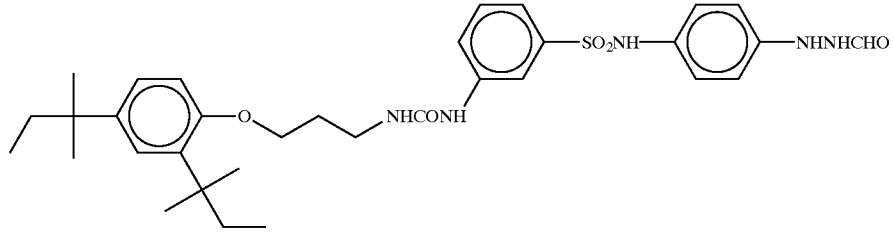
I-67
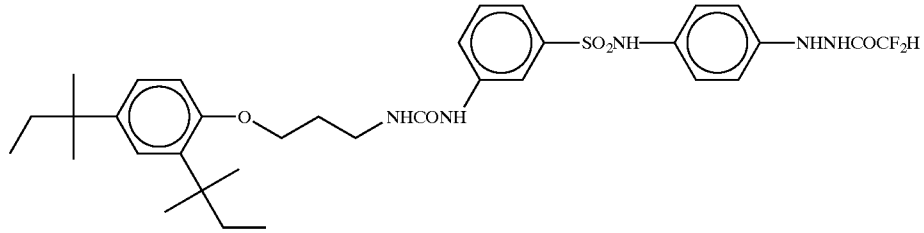
I-68
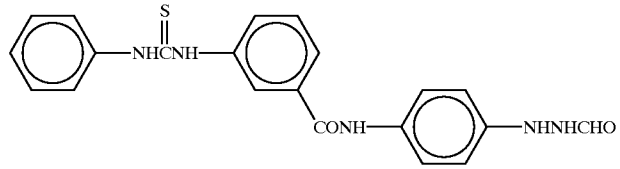
I-69
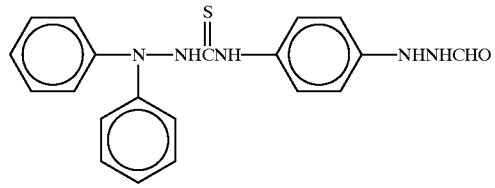

-continued
I-70
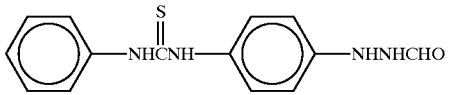
I-71
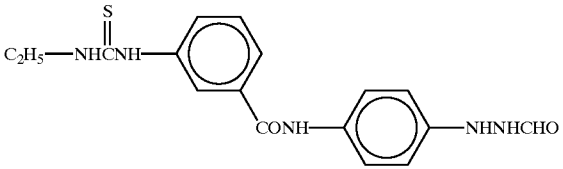
I-72
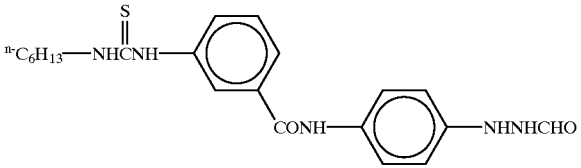
I-73
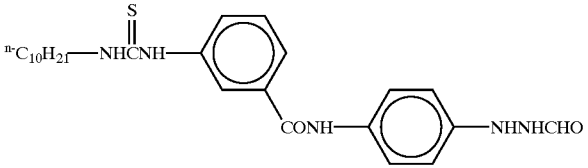
I-74
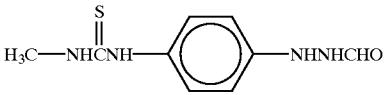
I-75
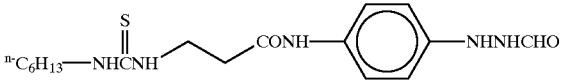

As the hydrazine derivatives to be used in the present invention, besides the aforementioned compounds, the following hydrazine derivatives are also preferably used. The hydrazine derivatives to be used in the present invention may be synthesized by a variety of methods described in the patents below.

They are the compounds represented by (Compound 1) described in JP-B-6-77138, and specifically, compounds described in the publication, pages 3 and 4; the compounds represented by formula (I) described in JP-B-6-93082, and specifically, the compounds 1 to 38 described in the publication, pages 8 to 18; the compounds represented by the formulae (4), (5) and (6) described in JP-A-6-230497, and specifically, the compounds 4-1 to 4-10 on pages 25 and 26, the compounds 5-1 to 5-42 on pages 28 to 36, and the compounds 6-1 to 6-7 on pages 39 and 40 in the publication; the compounds represented by the formulae (1) and (2) described in JP-A-6-289520, and specifically, the compounds 1-1) to 1-17) and 2-1) described in the publication, pages 5 to 7; the compounds represented by (Compound 2) and (Compound 3) described in JP-A-6-313936, and specifically, the compounds described in the publication, pages 6 to 19; the compounds represented by (Compound 1) described in JP-A-6-313951, and specifically, the compounds described in the publication, pages 3 to 5; the compounds represented by formula (I) described in JP-A-7-5610, and specifically, the compounds I-1 to I-38 described in the publication, pages 5 to 10; the compounds represented by the formula (II) described in JP-A-7-77783, and specifically, the compounds II-1 to II-102 described in the publication, pages 10 to 27; the compounds represented by the formulae (H) and (Ha) described in JP-A-7-104426, and specifically the compounds H-1 to H-44 described in the publication, pages 8 to 15; the compounds having, in the vicinity of the hydrazine group, an anionic group or a nonionic group which forms an intermolecular hydrogen bond in combination with a hydrogen atom of the hydrazine group, particularly, compounds represented by the formula (A), formula (B), formula (C), formula (D), formula (E) or formula (F), and specifically, the compounds N-1 to N-30 described in the publication; and the compounds represented by the formula (1) described in JP-A-9-22082, and specifically, the compounds D-1 to D-55 described in the publication; and besides the aforementioned compounds, hydrazine derivatives described in WO95-32452, WO95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381, JP-A.-10-175946.

In the present invention, the hydrazine-series nucleating agent may be used by dissolving it in a proper water-miscible organic solvent, for example, alcohols (methanol, ethanol, propanol and fluorinated alcohols), ketones (acetone and methyl ethyl ketone), dimethylformamide, dimethylsulfoxide, or methyl cellosolve.

Also, by means of well known emulsion dispersing method, the hydrazine-series nucleating agent may be used by dissolving it with using an oil, such as dibutyl phthalate, tricresyl phosphate, glyceryl triacetate, and diethyl phthalate, or an auxiliary solvent, such as ethyl acetate or cyclohexane, and preparing an emulsion dispersion mechanically. Alternatively, by means of a method known as the solid dispersion method, the agent may be used by dispersing a powder of a hydrazine derivative in water by using a ball mill, colloid mill or supersonic wave.

In the present invention, although the hydrazine-series nucleating agent may be added to any one of silver halide emulsion layers and other hydrophilic colloidal layers on the side of the support to which the silver halide emulsion layers are provided, it is preferably added to the silver halide emulsion layer or a hydrophilic colloidal layer adjacent thereto. Also, two or more types of hydrazine-series nucleating agent may be used together.

In the present invention, the amount of the nucleating agent to be added is preferably $1\times10^{-8}$ to $1\times10^{-2}$ mol, more preferably $1\times10^{-7}$ to $5\times10^{-3}$ mol, and most preferably $2\times10^{-7}$ to $1\times10^{-4}$ mol per 1 mol of a silver halide.

The compound represented by the formula (II) will be explained in more detail.

Examples of the alkyl group, alkenyl group, and alkinyl group represented by $R_{11}$ or $R_{12}$ in the formula (II) include substituted or unsubstituted straight-chain or branched alkyl groups having 1 to 10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxypropyl, and methoxymethyl), substituted or unsubstituted cyclic alkyl groups having 3 to 6 carbon atoms (e.g., cyclopropyl, cyclopentyl, and cyclohexyl), alkenyl groups having 2 to 10 carbon atoms (e.g., allyl, 2-butenyl and 3-pentenyl), alkinyl groups having 2 to 10 carbon atoms (e.g., propargyl and 3-pentinyl), aralkyl groups having 6 to 12 carbon atoms (e.g., benzyl), and the like. Given as examples of the aryl group are substituted or unsubstituted phenyl groups having 6 to 12 carbon atoms (e.g., unsubstituted phenyl, and 4-methylphenyl).

Examples of the alkyl group, alkenyl group and alkinyl group represented by $R_{13}$ or $R_{14}$ in the formula (II) include substituted or unsubstituted straight-chain or branched alkyl groups having 1 to 10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, diethylaminoethyl, dibutylaminoethyl, methoxyethyl and ethoxyethoxy ethyl), substituted or unsubstituted cyclic alkyl groups having 3 to 6 carbon atoms (e.g., cyclopropyl, cyclopentyl and cyclohexyl), alkenyl groups having 2 to 10 carbon atoms (e.g., allyl, 2-butenyl and 3-pentenyl), alkinyl groups having 2 to 10 carbon atoms (e.g., propargyl and 3-pentinyl), aralkyl groups having 6 to 12 carbon atoms (e.g., benzyl), and the like. Given as examples of the aryl group are substituted or unsubstituted phenyl groups having 6 to 12 carbon atoms (e.g., unsubstituted phenyl and 4-methylphenyl), and substituted or unsubstituted naphthyl groups having 10 to 16 carbon atoms (e.g., unsubstituted naphthyl).

Also, $R_{11}$ or $R_{12}$ may be combined with $R_{13}$ or $R_{14}$ to form a ring.

Examples of the alkyl group, alkenyl group and alkinyl group represented by $R_{15}$ in the formula (II) include substituted or unsubstituted straight-chain or branched alkyl groups having 1 to 8 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl and diethylaminoethyl), substituted or unsubstituted cyclic alkyl groups having 3 to 6 carbon atoms (e.g., cyclopropyl, cyclopentyl and cyclohexyl), alkenyl groups having 2 to 10 carbon atoms (e.g., allyl, 2-butenyl and 3-pentenyl), alkinyl groups having 2 to 10 carbon atoms (e.g., propargyl and 3-pentinyl), aralkyl groups having 6 to 12 carbon atoms (e.g., benzyl), and the like. Given as examples of the aryl group are substituted or unsubstituted phenyl groups having 6 to 16 carbon atoms (e.g., unsubstituted phenyl, 4-methylphenyl, 4-(2-hydroxyethyl)-phenyl, 4-sulfophenyl, 4-chlorophenyl, 4-trifluoromethylphenyl, 3-trifluoromethylphenyl, 4-carboxyphenyl, 2,5-dimethylphenyl, 4-dimethylaminophenyl, 4-(3-carboxypropionylamino)-phenyl, 4-methoxyphenyl, 2-methoxyphenyl, 2,5-dimethoxyphenyl and 2,4,6-trimethylphenyl), and naphthyl groups having 10 to 16 carbon atoms (e.g., unsubstituted naphthyl and 4-methylnaphthyl). Examples of the heterocyclic group include pyridyl, furyl, imidazolyl, piperidyl, and morpholyl groups.

Each of $R_{11}$, $R_{12}$, $R_{13}$, $R_{14}$ and $R_{15}$ in the formula (II) may have a substituent, if possible. Examples of the substituents may include halogen atoms (e.g., fluorine atom, chlorine atom, bromine atom, and the like), alkyl groups (e.g., methyl, ethyl, isopropyl, n-propyl and t-butyl group), alkenyl groups (e.g., allyl, and 2-butenyl group), alkinyl groups (e.g., a propargyl group), aralkyl groups (e.g., a benzyl group), aryl groups (e.g., phenyl, naphthyl, and 4-methylphenyl group), heterocyclic groups (e.g., pyridyl, furyl, imidazolyl, piperidinyl, and morpholyl group), alkoxy groups (e.g., methoxy, ethoxy, butoxy, 2-ethylhexyloxy, ethoxyethoxy or methoxyethoxy group), aryloxy groups (e.g., phenoxy and 2-naphthyloxy group), amino groups (e.g., unsubstituted amino, dimethylamino, diethylamino, dipropylamino, dibutylamino, ethylamino and anilino group), acylamino groups (e.g., acetyl amino and benzoylamino group), ureido groups (e.g., unsubstituted ureido and N-methylureido group), urethane groups (e.g., a methoxycarbonylamino and phenoxycarbonylamino group), sulfonylamino groups (e.g., methylsulfonylamino and phenylsulfonylamino group), sulfamoyl groups (e.g., unsubstituted sulfamoyl, N,N-dimethylsulfamoyl and N-phenylsulfamoyl group), carbamoyl groups (e.g., unsubstituted carbamoyl, N,N-diethylcarbamoyl and N-phenylcarbamoyl group), sulfonyl groups (e.g., mesyl and tosyl group), sulfinyl groups (e.g., methylsulfinyl and phenylsulfinyl group), alkyloxycarbonyl groups (e.g., methoxycarbonyl and ethoxycarbonyl group), aryloxycarbonyl group (e.g., phenoxycarbonyl group), acyl groups (e.g., acetyl, benzoyl, formyl and pivaloyl group), acyloxy groups (e.g., acetoxy and benzoyloxy group), phosphoric acid amido groups (e.g., N,N-diethylphosphoric acid amido group), cyano groups, sulfo groups, thiosulfonic acid groups, sulfinic acid groups, carboxy groups, hydroxy groups, phosphono groups, nitro groups, ammonio groups, phosphonio groups, hydrazino groups, and thiazolino groups. When two or more substituents are present, these substituents may be the same or different.

Preferable examples of $R_{11}$, $R_{12}$, $R_{13}$, $R_{14}$ and $R_{15}$ in the formula (II) will be hereinafter explained.

In formula (II), it is preferable that each of $R_{11}$ and $R_{12}$ is respectively a substituted or unsubstituted, straight-chain or branched alkyl group having 1 to 4 carbon atoms, or a substituted or unsubstituted phenyl group having 6 to 10 carbon atoms, each of $R_{13}$ and $R_{14}$ is respectively a hydrogen atom, a substituted or unsubstituted, straight-chain or branched alkyl groups having 1 to 4 carbon atoms, or a substituted or unsubstituted phenyl group having 6 to 10 carbon atoms, and $R_{15}$ is a substituted or unsubstituted phenyl group having 6 to 12 carbon atoms, and further the molecular weight of the compound represented by the formula (II) is 350 or less.

Further, in formula (II), it is more preferable that each of $R_{11}$ and $R_{12}$ is respectively a substituted or unsubstituted straight-chain alkyl group having 1 to 3 carbon atoms, each of $R_{13}$ and $R_{14}$ is respectively a hydrogen atom, and $R_{15}$ is a substituted or unsubstituted phenyl group having 6 to 10 carbon atoms, and further the molecular weight of the compound represented by the formula (II) is 300 or less. Furthermore it is most preferable that the sum of the numbers of carbons in $R_{11}$ to $R_{15}$ in the formula (II) is 11 or less.

Specific examples of the compound represented by the formula (II) are shoswn below. However, these compounds are not intended to be limiting of the present invention.

(II-1)

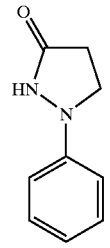

(II-2)

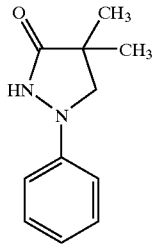

(II-3)

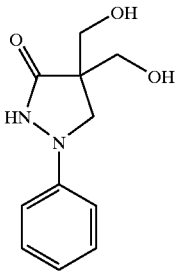

(II-4)

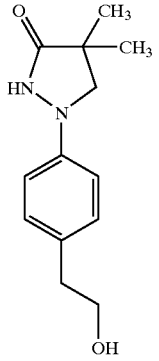

-continued
(II-5)
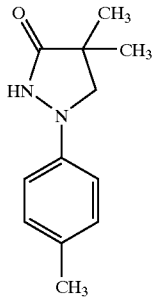
(II-6)
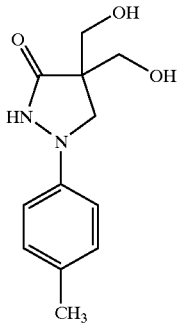
(II-7)
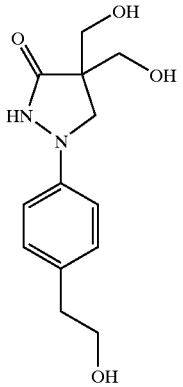
(II-8)
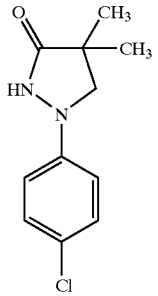
(II-9)
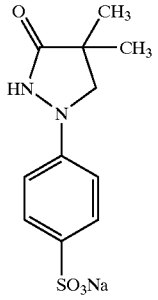
-continued
(II-10)
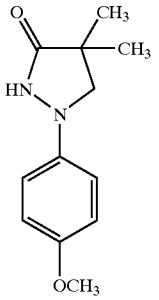
(II-11)
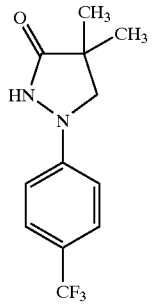
(II-12)
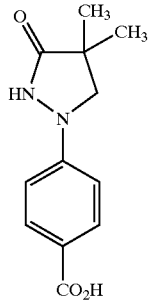
(II-13)
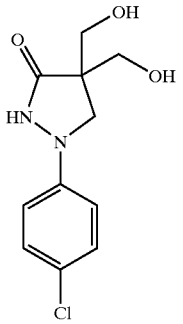
(II-14)
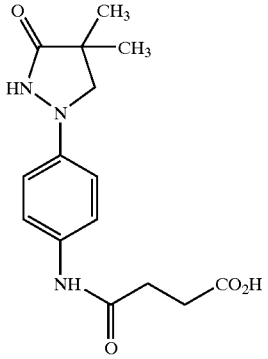

-continued
(II-15)
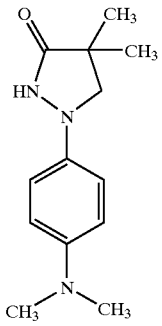
(II-16)
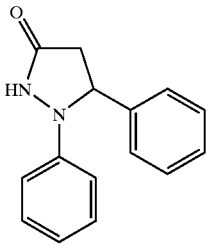
(II-17)
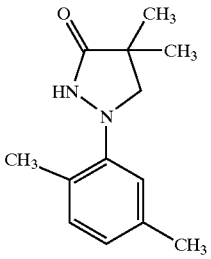
(II-18)
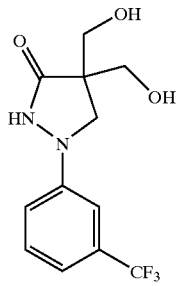
(II-19)
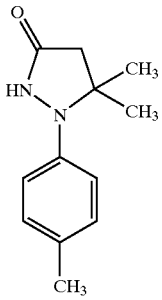
-continued
(II-20)
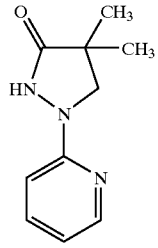
(II-21)
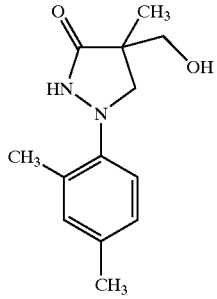
(II-22)
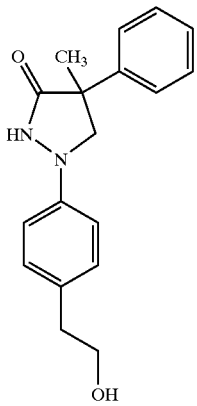
(II-23)
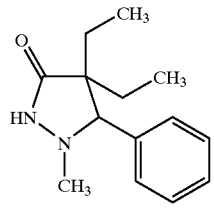
(II-24)
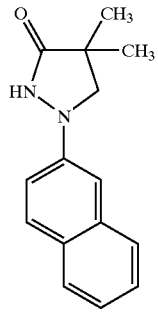

-continued (II-25)

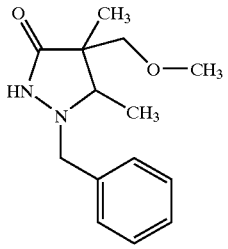

(II-26)

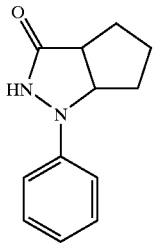

(II-27)

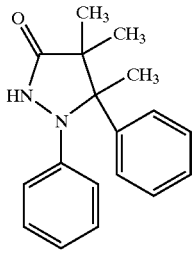

(II-28)

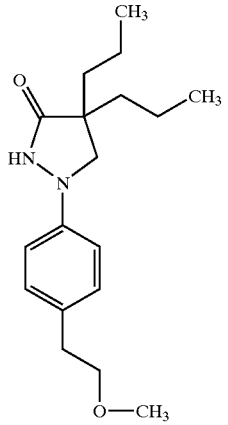

(II-29)

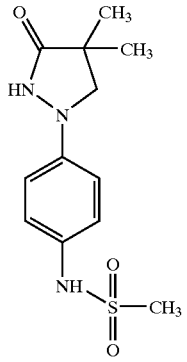

-continued (II-30)

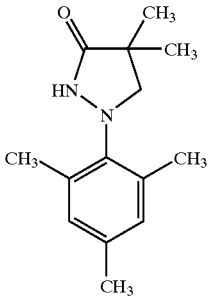

(II-31)

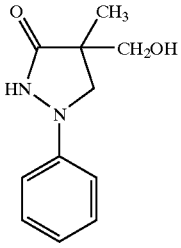

(II-32)

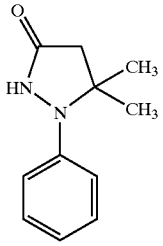

(II-33)

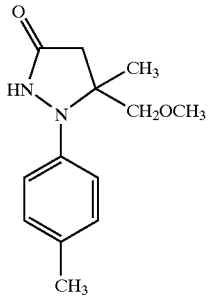

(II-34)

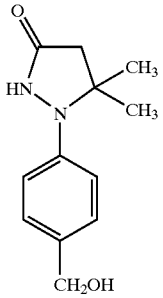

The compound represented by the formula (II) can be easily obtained as commercially available chemicals, or as compounds that can be synthesized from commercially available chemicals by a conventional method. The compound represented by the formula (II) may be synthesized easily by the methods described in J. Chem. Soc., page 408 (1954), U.S. Pat. No. 2,743,279 (1953), U.S. Pat. No.

2,772,282 (1953), and the like, and a method according to these methods.

The compound represented by the formula (II) is preferably added to a layer adjacent to an emulsion layer or to other layers, before or when a coating solution is applied, to thereby diffuse the compound into the emulsion layer. The compound may be added before, during or after chemical sensitization when the emulsion is prepared. The compound represented by the formula (II) may be added to either a light-sensitive layer or a non-light-sensitive layer.

A preferable amount of the compound to be added largely depends upon the aforementioned addition method and the type of compound to be added. Generally, the compound is used in an amount of $5\times10^{-6}$ mol to 0.05 mol, and more preferably $1\times10^{-5}$ mol to 0.005 mol, per 1 mol of a light-sensitive silver halide. When the amount is greater than the above defined amount, this brings about adverse effects such as an increase in fogging and is therefore undesirable.

The compound represented by the formula (II) is preferably added by dissolving it in a water-soluble solvent. The pH may be either lowered or raised using an acid or a base, and maybe a surfactant is allowed to coexist. The compound may be added by dissolving it as an emulsion dispersion in a high-boiling point organic solvent, or may be added as a microcrystal dispersion by using a known dispersion method.

The compounds represented by the formula (II) may be used in combination of two or more. When the compounds represented by the formula (II) are used in combination of two or more, these compounds may be added to either the same layer or different layers.

The compound represented by the formula (III) will be explained in more detail.

Firstly, the hydrazine structure, which is preferably used as Hy and represented by $R_1R_2N—NR_3R_4$, will be explained in detail.

$R_1$, $R_2$, $R_3$ and $R_4$ respectively represents an alkyl group, alkenyl group, alkinyl, aryl group, or heterocyclic group. $R_1$ and $R_2$, $R_3$ and $R_4$, $R_1$ and $R_3$, and $R_2$ and $R_4$ may be combined with each other to form a ring, but they never form an aromatic heterocycle.

Provided that at least one of $R_1$, $R_2$, $R_3$, and $R_4$ is an alkylene group, alkenylene group, alkinylene group, arylene group or divalent heterocyclic residue, to which —(Q)k2—(Het)k1 in formula (III) substitute.

Preferable examples of $R_1$, $R_2$, $R_3$, and $R_4$ include unsubstituted alkyl, alkenyl, and alkinyl groups having 1 to 18 and more preferably 1 to 8 carbon atoms (e.g., methyl group, ethyl group, propyl group, isopropyl group, butyl group, isobutyl group, hexyl group, octyl group, dodecyl group, octadecyl group, cyclopentyl group, cyclopropyl group, and cyclohexyl group), and substituted alkyl, alkenyl, and alkinyl groups having 1 to 18, and more preferably 1 to 8 carbon atoms.

Here, the substituent is designated as V. Although there is no particular limitation to the substituents represented by V, examples of the substituent V include a carboxy group, sulfo group, cyano group, halogen atom (e.g., fluorine atom, chlorine atom, bromine atom, and iodine atom), hydroxy group, alkoxycarbonyl group (e.g., methoxycarbonyl, ethoxycarbonyl, phenoxycarbonyl and benzyloxycarbonyl group), alkoxy group (e.g., methoxy, ethoxy, benzyloxy and phenethyloxy group), aryloxy group (e.g., phenoxy, 4-methylphenoxy and α-naphthoxy group), acyloxy group (e.g., acetyloxy and propionyloxy group), acyl group (e.g., acetyl, propionyl, benzoyl and mesyl group), carbamoyl group (e.g., carbamoyl, N,N-dimethylcarbamoyl, morpholinocarbonyl and piperidinocarbonyl group), sulfamoyl groups (e.g., sulfamoyl, N,N-dimethylsulfamoyl, morpholinosulfonyl and piperidinosulfonyl group), aryl group (e.g., phenyl, 4-chlorophenyl, 4-methylphenyl and α-naphthyl group), heterocyclic group (e.g., 2-pyridyl, tetrahydrofurfuryl, morpholino and 2-thienyl group), amino group (e.g., amino, dimethylamino, anilino and diphenylamino group), alkylthio group (e.g., methylthio and ethylthio group), alkylsulfonyl group (e.g., methylsulfonyl and propylsulfonyl group), alkylsulfinyl group (e.g., methylsulfinyl group), nitro group, phosphoric acid group, acylamino group (e.g., acetylamino group), ammonium group (e.g., trimethylammonium and tributylammonium group), mercapto group, hydrazino group (e.g., trimethylhydrazino group), ureido group (e.g., ureido and N,N-dimethylureido group), imide group, alkenyl group (e.g., vinyl group, ethynyl group and 1-cyclohexenyl group), alkinyl group (e.g., a benzylidyne group) and alkylidene group (e.g., a benzylidene group). The number of carbon atoms of the substituent V is preferably 1 to 18, and more preferably 1 to 8. These substituents may be further substituted by a substituent V.

More specifically, preferable examples of $R_1$, $R_2$, $R_3$, and $R_4$ include an alkyl group, alkenyl group, and alkinyl group {e.g., a carboxymethyl, 2-carboxyethyl, 3-carboxypropyl, 4-carboxybutyl, 2-sulfoethyl, 3-sulfopropyl, 4-sulfobutyl, 3-sulfobutyl, 2-hydroxy-3-sulfopropyl, 2-cyanoethyl, 2-chloroethyl, 2-bromoethyl, 2-hydroxyethyl, 3-hydroxypropyl, hydroxymethyl, 2-hydroxyethyl, 2-methoxyethyl, 2-ethoxyethyl, 2-ehtoxycarbonylethyl, methoxycarbonylmethyl, 2-methoxyethyl, 2-ethoxyethyl, 2-phenoxyethyl, 2-acetyloxyethyl, 2-propionyloxyethyl, 2-acetylethyl, 3-benzoylpropyl, 2-carbamoylethyl, 2-morpholinocarbonylethyl, sulfamoylmethyl, 2-(N,N-dimethylsulfamoyl)ethyl, benzyl, 2-naphthylethyl, 2-(2-pyridyl)ethyl, allyl, 3-aminopropyl, 3-dimethylaminopropyl, methylthiomethyl, 2-methylsulfonylethyl, methylsulfinylmethyl, 2-acetylaminoethyl, 3-trimethylammoniumethyl, 2-mercaptoethyl, 2-trimethylhydrazinoethyl, methylsulfonylcarbamoylmethyl, (2-methoxy)ethoxymethyl group, and the like can be mentioned}, aryl group having 6 to 18, and more preferably 6 to 12 carbon atoms (e.g., a phenyl, α-naphthyl, and β-naphthyl group, and further a phenyl or naphthyl group substituted with the aforementioned V, or with an alkyl group, alkenyl group or alkinyl group) and heterocyclic group having 4 to 18, and more preferably 4 to 12 carbon atoms (e.g., a 2-pyridyl group, a 2-pyridyl group substituted with the aforementioned substituent V or with an alkyl group, alkenyl group or alkinyl group).

Also, $R_1$ and $R_2$, $R_3$ and $R_4$, $R_1$ and $R_3$, and $R_2$ and $R_4$ may bond with each other to form a ring, but they do not form an aromatic heterocycle. These rings may be substituted with, for example, the aforementioned substituent V.

For $R_1$, $R_2$, $R_3$ and $R_4$, more preferable is the case where $R_1$, $R_2$, $R_3$ and $R_4$ respectively represent an unsubstituted alkyl, alkenyl or alkinyl group, or a substituted alkyl, alkenyl or alkinyl group, or an alkylene group {which may be substituted, for example, with the aforementioned substituent V}, which can form a ring that does not contain an atom other than carbon atom (e.g., an oxygen atom, sulfur atom or nitrogen atom) as atoms forming the ring, when $R_1$ and $R_2$, $R_3$ and $R_4$, $R_1$ and $R_3$, and $R_2$ and $R_4$ are respectively combined with each other to form a ring.

More preferable for $R_1$, $R_2$, $R_3$ and $R_4$ is the case where a carbon atom, which is directly connected to a nitrogen atom of the hydrazine, is the carbon atom of an unsubstituted methylene group. Particularly preferable for $R_1$, $R_2$, $R_3$ and $R_4$ are the case where $R_1$, $R_2$, $R_3$ and $R_4$ respectively represent an unsubstituted alkyl group having 1 to 6 carbon atoms (e.g., methyl, ethyl, propyl, butyl), a substituted alkyl group having 1 to 8 carbon atoms {e.g., a sulfoalkyl group (e.g., a 2-sulfoethyl, 3-sulfopropyl, 4-sulfobutyl and 3-sulfobutyl group), carboxyalkyl group (e.g., a carboxymethyl and 2-carboxyethyl group) and hydroxyalkyl group (e.g., a 2-hydroxyethyl group)}, and the case where each of $R_1$ and $R_2$, $R_3$ and $R_4$, $R_1$ and $R_3$, and $R_2$ and $R_4$ are respectively combined through an alkylene chain to form a five-, six- or seven-membered ring.

The hydrazine group represented by $R_1R_2N—NR_3R_4$ is substituted with at least one —(Q)k2—(Het)k1. The substitution position may be any one of $R_1$, $R_2$, $R_3$ and $R_4$.

The hydrazine compound represented by $R_1R_2N—NR_3R_4$ can be isolated as a salt, without any problem, when this is advantageous in synthesis and preservation. In this case, any compound which can combine with hydrazines to form salts may be used. As desirable salts, the following compounds are given.

Examples of the salt include aryl sulfonates (e.g., p-toluene sulfonate and p-chlorobenzene sulfonate), aryl disulfonates (e.g., 1,3-benzene disulfonate, 1,5-naphthalene disulfonate and 2,6-naphthalene disulfonate), thiocyanates, picrates, carboxylates (e.g., oxalates, acetates, benzoates and hydrogen oxalates)l halides (e.g., hydrogen chloride, hydrogen fluoride, hydrogen bromide and hydrogen iodide), sulfates, perchlorates, tetrafluoroborates, sulfites, nitrates, phosphates, carbonates and bicarbonates.

Hydrogen oxalates, oxalates, 1,5-naphthalene dicarboxylate and hydrogen chlorides are preferable.

It is particularly preferable that the compound represented by $R_1R_2N—NR_3R_4$ for use in the present invention is selected from compounds represented by the formulae (Hy-1), (Hy-2) and (Hy-3) below.

formula (Hy-1)

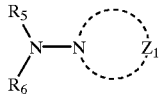

formula (Hy-2)

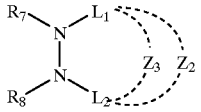

formula (Hy-3)

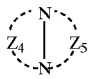

In the formulas, each of $R_5$, $R_6$, $R_7$ and $R_8$ independently represent an alkyl group, an alkenyl group, an alkinyl group, an aryl group or a heterocyclic group, and $R_5$ and $R_6$, or $R_7$ and $R_8$ may bond with each other to form a ring.

$Z_1$ represents an alkylene group having 4, 5 or 6 carbon atoms.

$Z_2$ represents an alkylene group having 2 carbon atoms.

$Z_3$ represents an alkylene group having 1 or 2 carbon atoms.

$Z_4$ and $Z_5$ respectively represent an alkylene group having 3 carbon atoms.

$L_1$ and $L_2$ respectively represent a methine group.

Also, the compound represented by each of the formulae (Hy-1), (Hy-2) and (Hy-3) is substituted with at least one —(Q)k2—(Het)k1.

Compounds selected from the compounds represented by (Hy-1) and (Hy-2) are more preferable, and compounds selected from the compounds represented by (Hy-1) are particularly preferable.

The formula (Hy-1) will be hereinafter explained in detail.

$R_5$ and $R_6$ respectively have the same meanings as $R_1$, $R_2$, $R_3$ and $R_4$, and their preferable range is the same to that of $R_1$, $R_2$, $R_3$ and $R_4$.

Particularly preferable is the case where each of $R_5$ and $R_6$ is an alkyl group, and the case where $R_5$ and $R_6$ bond with each other to form an unsubstituted tetramethylene group or pentamethylene group.

$Z_1$ represents an alkylene group having 4, 5 or 6 carbon atoms, and is preferably an alkylene group having 4 or 5 carbon atoms.

However, a carbon atom, which is directly connected to a nitrogen atom of the hydrazine, is substituted with no oxo group.

Also, the alkylene group may be either unsubstituted or substituted. As examples of the substituent, the aforementioned substituents V are given. The preferable case is where the carbon atom, which directly bond to the nitrogen atom of the hydrazine, is that of an unsubstituted methylene group.

It is particularly preferable that $Z_1$ is an unsubstituted tetramethylene group or an unsubstituted pentamethylene group.

The hydrazine group represented by the formula (Hy-1) is substituted with at least one —(Q)k2—(Het)k1. The group —(Q)k2—(Het)k1 may substitute on any one of $R_5$, $R_6$ and $Z_1$, but preferably on $R_5$ or $R_6$.

Next, the formula (Hy-2) will be explained in detail.

$R_7$ and $R_8$ respectively have the same meanings as each of $R_1$, $R_2$, $R_3$ and $R_4$, and their preferable range is the same to that for $R_1$ to $R_4$.

Particularly preferable is the case where each of $R_7$ and $R_8$ is an alkyl group, and the case where $R_7$ and $R_8$ are combined with each other to form a trimethylene group.

$Z_2$ represents an alkylene group having 2 carbon atoms.

$Z_3$ represents an alkylene group having 1 or 2 carbon atoms.

Also, these alkylene groups may be unsubstituted or substituted. As examples of the substituent, the aforementioned substituent V is given.

As $Z_2$, an unsubstituted ethylene group is more preferable.

As $Z_3$, an unsubstituted methylene group or ethylene group is more preferable.

$L_1$ and $L_2$ respectively represent an substituted or substituted methine group. As examples of the substituent, the aforementioned substituent V is given. Preferable example is an unsubstituted alkyl group (e.g., a methyl group and a t-butyl group). More preferable example is an unsubstituted methine group.

The hydrazine group represented by the formula (Hy-2) is substituted with at least one —(Q)k2—(Het)k1. The group —(Q)k2—(Het)k1 may substitute on a position any one of $R_7$, $R_8$, $Z_2$, $Z_3$, $L_1$ and $L_2$, but preferably on $R_7$ or $R_8$.

The formula (Hy-3) will be hereinafter explained in detail. Each of $Z_4$ and $Z_5$ respectively represents an alkylene group having 3 carbon atoms.

However, a carbon atom, which is directly connected to a nitrogen atom of the hydrazine, is substituted with no oxo group.

Also, these alkylene groups may be either unsubstituted or substituted. As examples of the substituent, the aforementioned substituents V are given. The preferable case is where the carbon atom, which is directly connected to the nitrogen atom of the hydrazine, is that of an unsubstituted methylene group.

As $Z_4$ and $Z_5$, an unsubstituted trimethylene, unsubstituted alkyl group, and substituted trimethylene group (e.g., a 2,2-dimethyltrimethylene group) are particularly preferable.

The hydrazine group represented by the formula (Hy-3) is substituted with at least one —(Q)k2—(Het)k1. The group —(Q)k2—(Het)k1 may substitute on a position any one of $Z_4$ and $Z_5$.

Like the compounds represented by $R_1R_2N—NR_3R_4$, the compounds represented by the formula (Hy-1), (Hy-2) or (Hy-3) can be isolated as salts without causing any problem. As examples of the salts, the same salts that are shown as in the case of $R_1R_2N—NR_3R_4$ are given. Preferable examples are hydrogen oxalates, oxalates, 1,5-naphthalene disulfonate, and hydrochlorides.

The group represented by Het in the formula (III) has any one of the following structures (1) to (5).

(1) A five-, six- or seven-membered heterocycle having two or more hetero atoms.

(2) A five-, six- or seven-membered nitrogen-containing heterocycle represented by the following A, which has a quaternary nitrogen atom.

(3) A five-, six- or seven-membered nitrogen-containing heterocycle represented by the following B, which has a thioxo group.

(4) A five-, six- or seven-membered nitrogen-containing heterocycle represented by the following C.

(5) A five-, six- or seven-membered nitrogen-containing heterocycle represented by the following D or E.

A

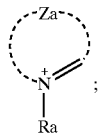

B

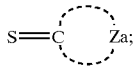

C

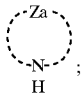

D

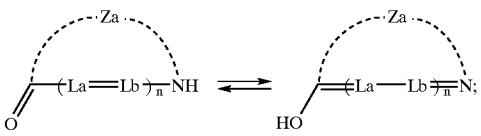

-continued

E

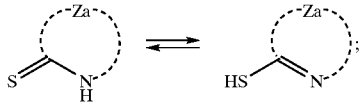

Za represents an atomic group required to form a five-, six- or seven-membered nitrogen-containing heterocycle.

Ra represents an aliphatic group.

La and Lb respectively represent a methine group.

n denotes 0, 1 or 2.

As Ra, those exemplified as the alkyl group, alkenyl group and alkinyl group for $R_1$, $R_2$, $R_3$ and $R_4$ are given.

The nitrogen-containing heterocycle containing Za as the ring structural atom is a five-, six- or seven-membered heterocycle, which contains at least one nitrogen atom and may further contain a heteroatoms (e.g., an oxygen atom, sulfur atom, selenium atom and tellurium atom) other than a nitrogen atom. Preferable examples of the nitrogen-containing heterocycle include an azole ring (e.g., an imidazole, triazole, tetrazole, oxazole, thiazole, selenazole, benzoimidazole, benzotriazole, benzoxazole, benzothiazole, thiadiazole, oxadiazole, benzoselenazole, pyrazole, naphthothiazole, naphthoimidazole, naphthoxazole, azabenzoimidazole and purine), pyrimidine ring, triazine ring, azaindene ring (e.g., triazaindene, tetrazaindene and pentazaindene), and the like.

However, the group represented by Het is substituted with at least one —(Q)k2—(Hy).

More preferable examples of Het are compounds represented by the following formulae (Het-a), (Het-b), (Het-c), (Het-d) or (Het-e).

formula (Het-a)

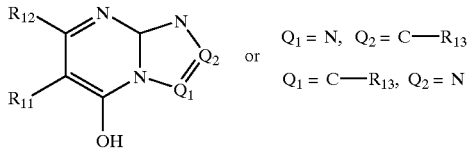

formula (Het-b)

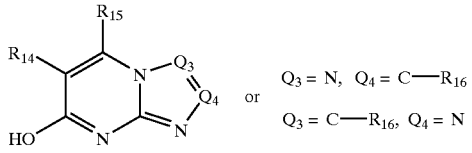

formula (Het-c)

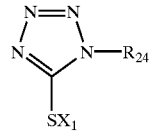

formula (Het-d)

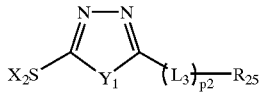

-continued formula (Het-e)

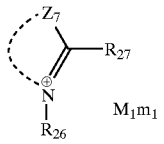

In the formula, each of $R_{11}$, $R_{12}$, $R_{13}$, $R_{14}$, $R_{15}$ and $R_{16}$ independently represents a hydrogen atom or monovalent substituent.

$R_{24}$ represents an alkyl group, an alkenyl group, an alkinyl group, an aryl group or a heterocyclic group.

$X_1$ represents a hydrogen atom, an alkali metal atom, an ammonium group or a block group.

$Y_1$ represents an oxygen atom, a sulfur atom, >NH, or >N—$(L_4)p_3$—$R_{28}$, $L_3$ and $L_4$ respectively represent a divalent connecting group, $R_{25}$ and $R_{28}$ respectively represent a hydrogen atom, an alkyl group, an alkenyl group, an alkinyl group, an aryl group or a heterocyclic group.

$X_2$ has the same meanings as $X_1$.

$p_2$ and $p_3$ respectively denote an integer from 0 to 3, and preferably $p_2$ and $p_3$ respectively denote 1.

$Z_7$ represents an atomic group necessary to form a five- or six-membered nitrogen-containing heterocycle. $R_{26}$ represents an alkyl group, an alkenyl group, or an alkinyl group.

$R_{27}$ represents a hydrogen atom, an alkyl group, an alkenyl group, or an alkinyl group.

However, each of the groups represented by (Het-a), (Het-b), (Het-c), (Het-d), and (Het-e) is substituted with at least one —(Q)k2—(Hy). However, the group —(Q)k2—(Hy) is not substituted on $X_1$ and $X_2$ of each of the formulae (Het-c) and (Het-d).

Among the formulae (Het-a) to (Het-e), the formulae (Het-a), (Het-c) and (Het-d) are preferable, and the formula (Het-c) is more preferable.

Next, the formulae (Het-a), (Het-b), (Het-c), (Het-d), and (Het-e) will be explained in more detail.

Each of $R_{11}$, $R_{12}$, $R_{13}$, $R_{14}$, $R_{15}$ and $R_{16}$ independently represents a hydrogen atom or a monovalent group. As examples of the monovalent group, those exemplified as the preferable groups for $R_1$, $R_2$, $R_3$, $R_4$, and V can be mentioned.

More preferable examples of the monovalent group include a lower alkyl group (preferably, a substituted or unsubstituted lower alkyl group having 1 to 4 carbon atoms; for example, methyl, ethyl, n-propyl, isopropyl, n-butyl, t-butyl, methoxyethyl, hydroxyethyl, hydroxymethyl, vinyl and allyl), carboxy group, alkoxy group (preferably, a substituted or unsubstituted alkoxy group having 1 to 5 carbon atoms; for example, methoxy, ethoxy, methoxyethoxy and hydroxyethoxy), aralkyl group (preferably, a substituted or unsubstituted aralkyl group having 7 to 12 carbon atoms; for example, benzyl, phenethyl and phenylpropyl), aryl group (preferably, a substituted or unsubstituted aryl group having 6 to 12 carbon atoms; for example, phenyl, 4-methylphenyl and 4-methoxyphenyl), heterocyclic group (e.g., a 2-pyridyl group), alkylthio group (preferably, a substituted or unsubstituted alkylthio group having 1 to 10 carbon atoms; for example, methylthio and ethylthio), arylthio group (preferably, a substituted or unsubstituted arylthio group having 6 to 12 carbon atoms; for example, phenylthio), aryloxy group (preferably, a substituted or unsubstituted aryloxy group having 6 to 12 carbon atoms; for example, phenoxy), alkylamino group having 3 or more carbon atoms (e.g., propylamino and butylamino), arylamino group (e.g., an anilino group), halogen atom (e.g., chlorine atom, bromine atom and fluorine atom) and the following substituents.

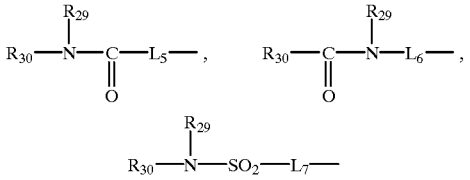

Herein, $L_5$, $L_6$ and $L_7$ respectively represent a connecting group of an alkylene group (preferably, an alkylene group having 1 to 5 carbon atoms; for example, methylene, propylene and 2-hydroxypropylene).

$R_{29}$ and $R_{30}$, which may be the same or different, respectively represent a hydrogen atom, an alkyl group, an alkenyl group, an alkinyl group (preferably, a substituted or unsubstituted alkinyl group having 1 to 10 carbon atoms, for example, methyl, ethyl, n-propyl, isopropyl, n-butyl, t-butyl, n-octyl, methoxyethyl, hydroxyethyl, allyl, and propargyl), aralkyl group (preferably, a substituted or unsubstituted aralkyl group having 7 to 12 carbon atoms, for example, benzyl, phenethyl and vinylbenzyl), aryl group (preferably, a substituted or unsubstituted aryl group having 6 to 12 carbon atoms, for example, phenyl and 4-methylphenyl) or heterocyclic group (e.g., a 2-pyridyl group).

The alkyl group, alkenyl group, alkinyl group, aryl group and heterocyclic group of $R_{24}$ may be either unsubstituted or substituted. As preferable examples, those groups exemplified for $R_1$, $R_2$, $R_3$, $R_4$, and V can be mentioned.

More preferable examples may include a halogen atom (e.g., a chlorine atom, bromine atom and fluorine atom), nitro group, cyano group, hydroxy group, alkoxy group (e.g., a methoxy group), aryl group (e.g., a phenyl group), acylamino group (e.g., a propionylamino group), alkoxycarbonylamino group (e.g., a methoxycarbonylamino group), ureido group, amino group, heterocyclic group (e.g., a 2-pyridyl group), acyl group (e.g., an acetyl group), sulfamoyl group, sulfonamido group, thioureido group, carbamoyl group, alkylthio group (e.g., a methylthio group), arylthio group (e.g., a phenylthio group), heterocyclic thio group (e.g., a 2-benzothiazolylthio group), carboxylic acid group, sulfo group, and salts of these groups.

The above ureido group, thioureido group, sulfamoyl group, carbamoyl group, and amino group include unsubstituted ones and those substituted with a N-alkyl group or a N-aryl group.

Examples of the aryl group include a phenyl group and substituted phenyl group. As examples of the substituent, those exemplified as the preferable examples of the aforementioned $R_1$, $R_2$, $R_3$, $R_4$, and V can be mentioned.

The alkali metal atom represented by $X_1$ or $X_2$ is, for example, a sodium atom or potassium atom, and the ammonium atom is, for example, tetramethylammonium or trimethylbenzylammonium. Also, the block group means a group, which can be cleft under alkaline condition, and for example, the block group represents an acetyl, cyanoethyl or methanesulfonylethyl group.

As specific examples of the divalent connecting group represented by $L_3$ or $L_4$, the following connecting group or combinations of these groups may be given.

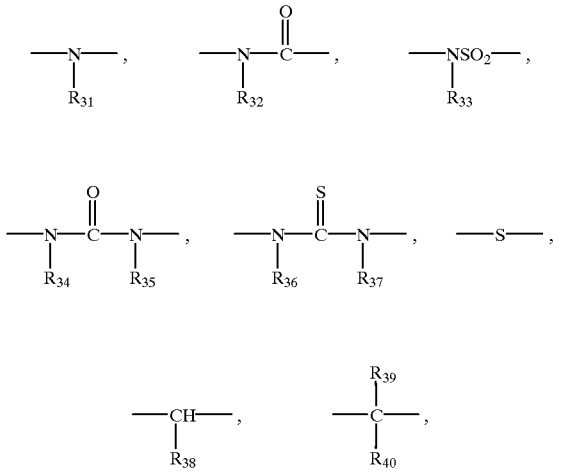

Each of $R_{31}$, $R_{32}$, $R_{33}$, $R_{34}$, $R_{35}$, $R_{36}$, $R_{37}$, $R_{38}$, $R_{39}$ and $R_{40}$ respectively represents a hydrogen atom, an alkyl group, an alkenyl group, an alkinyl group (preferably, a substituted or unsubstituted alkinyl group having 1 to 4 carbon atoms; for example, methyl, ethyl, n-butyl, methoxyethyl, hydroxyethyl and allyl) or an aralkyl group (preferably, a substituted or unsubstituted aralkyl group having 7 to 12 carbon atoms; for example, benzyl, phenethyl and phenylpropyl).

As $R_{25}$ and $R_{28}$, the same aforementioned groups for $R_{24}$ are preferable.

Preferable examples of the heterocyclic group having $Z_7$ as the ring structural atom, include thiazoliums {e.g., a thiazolium, 4-methylthiazolium, benzothiazolium, 5-methylbenzothiazolium, 5- chlorobenzothiazolium, 5-methoxybenzothiazolium, 6-methylbenzothiazolium, 6-methoxybenzothiazolium, naphtho[1,2-d]thiazolium, and naphtho[2,1-d]thiazolium}, oxazoliums {e.g., an oxazolium, 4-methyloxazolium, benzoxazolium, 5-chlorobenzoxazolium, 5-phenylbenzoxazolium, 5-methylbenzoxazolium and naphtho[1,2-d]oxazolium}, imidazoliums {e.g., a 1-methylbenzoimidazolium, 1-propyl-5-chlorobenzoimidazolium, 1-ethyl-5,6-dichlorobenzoimidazolium, and 1-allyl-5-trifluoromethyl-6-chloro-benzoimidazolium}, selenazoliums {e.g., a benzoselenazolium, 5-chlorobenzoselenazolium, 5-methylbenzoselenazolium, 5-methoxybenzoselenazolium, and naphtho[1,2-d]selenazolium}and the like.

Particularly preferable examples are thiazoliums (e.g., a benzothiazolium, 5-chlorobenzothiazolium, 5-methoxybenzothiazolium, and naphtho[1,2-d]thiazolium).

Preferable examples of $R_{26}$ or $R_{27}$ include a hydrogen atom, unsubstituted alkyl group having 1 to 18 carbon atoms (e.g., methyl, ethyl, propyl, butyl, pentyl, octyl, decyl, dodecyl and octadecyl) or substituted alkyl group {examples include an alkyl group having 1 to 18 carbons substituted by the following: vinyl group, carboxy group, sulfo group, cyano group, halogen atom (e.g., fluorine, chlorine or bromine atom), hydroxy group, alkoxycarbonyl group having 1 to 8 carbon atoms (e.g., methoxycarbonyl, ethoxycarbonyl, phenoxycarbonyl and benzyloxycarbonyl), alkoxy group having 1 to 8 carbon atoms (e.g., methoxy, ethoxy, benzyloxy and phenethyloxy), monocyclic aryloxy group having 6 to 10 carbon atoms (e.g., phenoxy and p-tolyloxy), acyloxy group having 1 to 3 carbon atoms (e.g., acetyloxy and propionyloxy), acyl group having 1 to 8 carbon atoms (e.g., acetyl, propionyl, benzoyl and mesyl), carbamoyl group (e.g., carbamoyl, N,N-dimethylcarbamoyl, morpholinocarbonyl and piperidinocarbonyl), sulfamoyl group (e.g., sulfamoyl, N,N-dimethylsulfamoyl, morpholinosulfonyl and piperidinosulfonyl) or aryl group having 6 to 10 carbon atoms (e.g., phenyl, 4-chlorophenyl, 4-methylphenyl and α-naphthyl)}. However, $R_{26}$ is not a hydrogen atom.

More preferably, $R_{26}$ is an unsubstituted alkyl group (e.g., methyl and ethyl) or alkenyl group (e.g., allyl), and $R_{27}$ is a hydrogen atom or unsubstituted lower alkyl group (e.g., methyl and ethyl).

$M_1$ and $m_1$ are incorporated into the formula (Het-e) to show the presence or absence of a cation or anion, when they are required to make the ionic charge of the compound represented by the formula (Het-e) neutral. It depends on the type of auxochrome and on the type of substituent, whether a certain dye is a cation or an anion, or whether the dye has a net ionic charge or not. Typical cations are inorganic or organic ammonium ions and alkali metal ions, whereas specific anions may be either inorganic anions or organic anions. Examples of these anions include a halogen anion (e.g., fluorine ion, chlorine ion, bromine ion and iodine ion), substituted arylsulfonic acid ion (e.g., p-toluenesulfonic acid ion and p-chlorobenzenesulfonic acid ion), aryldisulfonic acid ion (e.g., 1,3-benzenedisulfonic acid ion, 1,5-naphthalenedisulfonic acid imide and 2,6-naphthalenedisulfonic acid ion), alkylsulfuric acid ion (e.g., methylsulfuric acid ion), sulfuric acid ion, thiocyanic acid ion, perchloric acid ion, tetrafluoroboric acid ion, picric acid ion, acetic acid ion, and trifluoromethanesulfonic acid ion.

Preferable examples are an ammonium ion, iodine ion, bromine ion and p-toluenesulfonic acid ion.

The nitrogen-containing heterocycle represented by each of the formulae (Het-a) to (Het-e) is substituted with at least one —(Q)k2—(Hy). The group —(Q)k2—(Hy) substitute on $R_{11}$, $R_{12}$, $R_{13}$, $R_{14}$, $R_{15}$, $R_{16}$, $R_{24}$, $R_{25}$, $R_{26}$, $Y_1$, $L_3$, $Z_7$ or the like.

In the formula (III), Q represents a divalent connecting group consisting of an atom or atomic group containing at least one type among a carbon atom, nitrogen atom, sulfur atom, and oxygen atom.

Q preferably represents a divalent connecting group having 4 to 20 carbon atoms and comprising one or a combination of an alkylene group having 1 to 8 carbon atoms (e.g., methylene, ethylene, propylene, butylene and pentylene), arylene group having 6 to 12 carbon atoms (e.g., phenylene or naphthylene), alkenylene group having 2 to 8 carbon atoms (e.g., ethynylene and penylene), amido group, ester group, sulfoamido group, sulfonate group, ureido group, sulfonyl group, sulfinyl group, thioether group, ether group, carbonyl group, —N($R_0$)— ($R_0$ represents a hydrogen atom, substituted or unsubstituted alkyl group or substituted or unsubstituted aryl group), divalent heterocyclic residue (e.g., 6-chloro-1,3,5-triazine-2,4-diyl, pyrimidine-2,4-diyl or quinoxaline-2,3-diyl). More preferable examples are a ureido group, ester group, and amido group.

In the formula (III), preferably k1 and k3 are respectively 1 or 2. More preferable is the case where k1, k2 and k3 are all 1.

When k1 or k3 is 2 or more, each one of the plural Hy or Het may be the same or different.

Among compounds represented by the formula (III) in the present invention, more preferable compounds are those represented by the following formulae (III-A), (III-B), (III-C), (III-D) or (III-E).

formula (III-A)

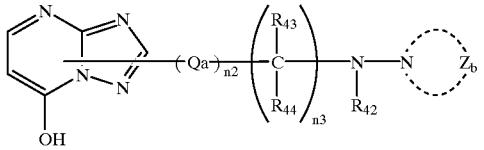

(III-B)

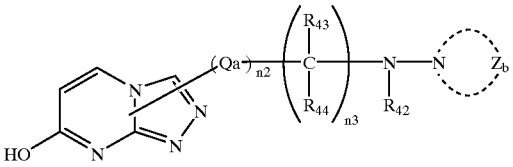

(III-C)

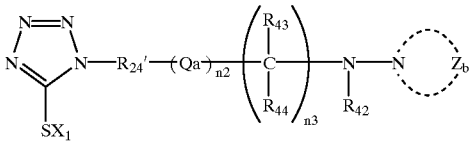

$R_{24}'$ represents an alkylene group, an arylene group, or a divalent heterocyclic group (III-D)

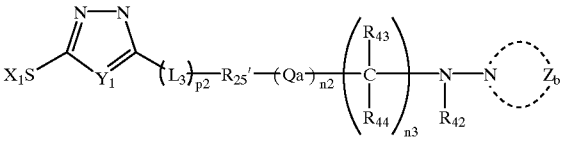

$R_{25}'$ has the same meanings as of $R_{24}'$ (III-E)

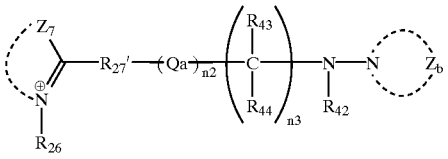

$R_{27}'$ represents an alkylene group

Moreover, particularly preferable compounds in the present invention are those represented by the formula (III-F).

(III-F)

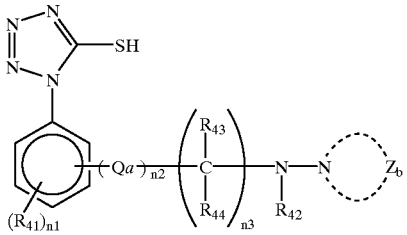

In the formula e, Qa has the same meanings as Q in the formula (III), $Z_b$ has the same meanings as $Z_1$ in the formula (Hy-1).

$R_{41}$ represents a monovalent substituent.

$R_{42}$ represents an alkyl group, an alkenyl group, an alkinyl group, an aryl group or a heterocyclic group.

Each of $R_{43}$ and $R_{44}$ independently represents a hydrogen atom or a monovalent substituent.

$n_1$ denotes an integer from 0 to 4.

$n_2$ denotes 0 or 1.

$n_3$ denotes an integer from 1 to 6.

$X_1$ has the same meanings as $X_1$ in the formula (Het-c).

$Y_1$, $L_3$ and $P_2$ have the same meanings as $Y_1$, $L_3$ and $p_2$ in the formula (Het-d) respectively.

$R_{26}$ has the same meanings as $R_{26}$ in the formula (Het-e).

Though $R_{41}$ or $C(R_{43})(R_{44})$ is repeated when $n_1$ or $n_3$ is 2 or more, it is unnecessary that the resulted plural $R_{41}$ or $C(R_{43})(R_{44})$ become the same ones.

To state in more detail, $Q_a$ is preferably the same one as Q in the formula (III), and more preferably a ureido group, ester group or amido group.

$Z_b$ is preferably the same one as $Z_1$ in the formula (Hy-1), and more preferably an unsubstituted tetramethylene group or pentamethylene group.

$R_{41}$ is preferably the same one as $R_{11}$.

$R_{42}$ is preferably the same one as $R_1$, $R_2$, $R_3$ or $R_4$, and particularly preferably unsubstituted alkyl group having 1 to 4 carbon atoms (e.g., methyl and ethyl).

Each of $R_{43}$ and $R_{44}$ is preferably the same one as $R_{11}$, and particularly preferably a hydrogen atom.

$n_1$ is preferably 0 or 1.

$n_2$ is preferably 1.

$n_3$ is preferably 2 to 4.

Next, typical examples of compounds used in the present invention will be given, however, these examples are not intended to be limiting of the present invention.

III-1

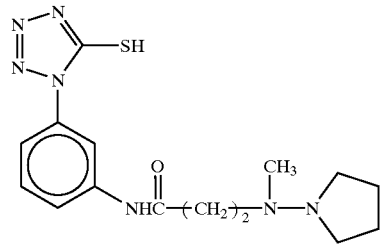

III-2

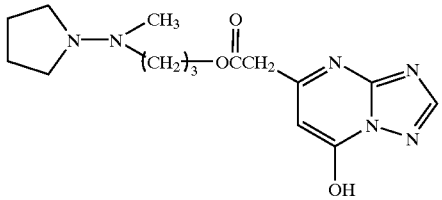

III-3

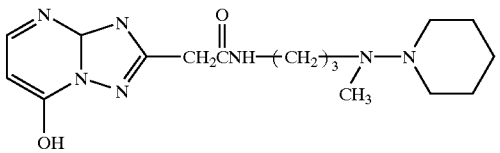

-continued
III-4
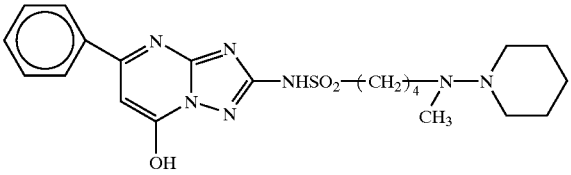
III-5
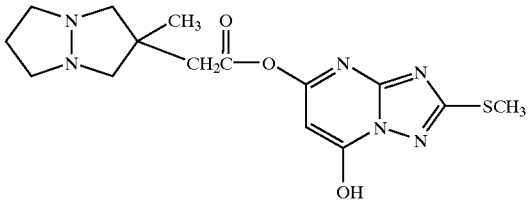
III-6
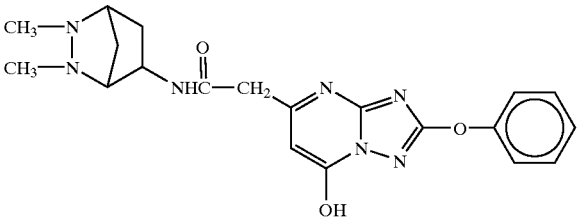
III-7
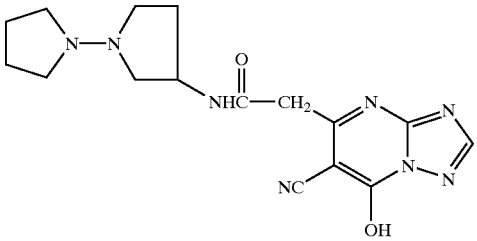
III-8
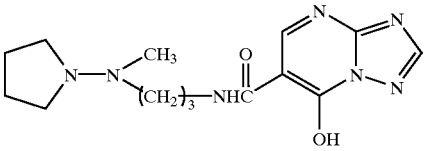
III-9
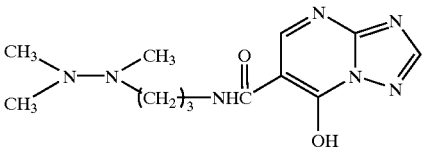
III-10
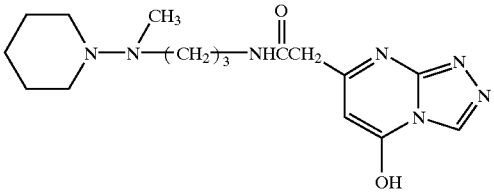
-continued
III-11
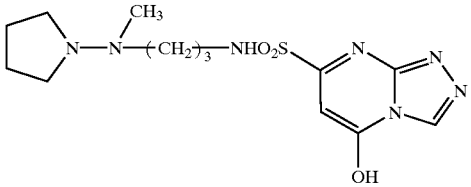
III-12
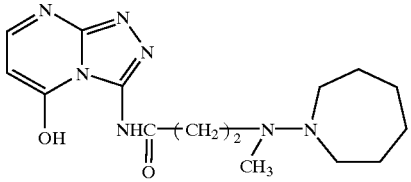
III-13
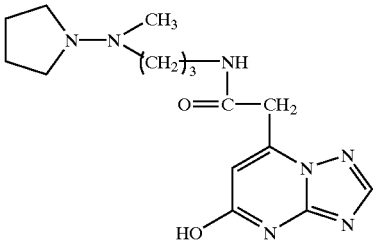
III-14
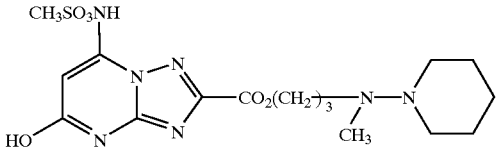
III-15
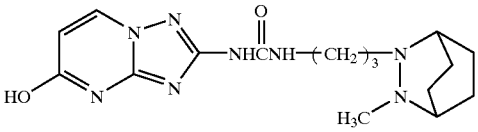
III-16
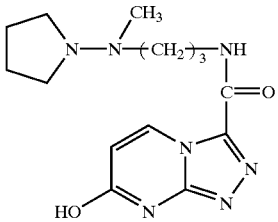
III-17
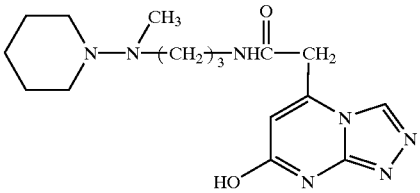
III-18
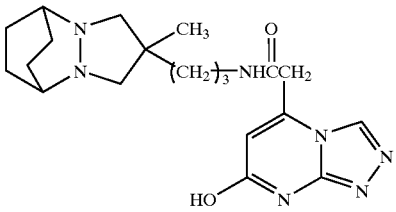

-continued
III-19
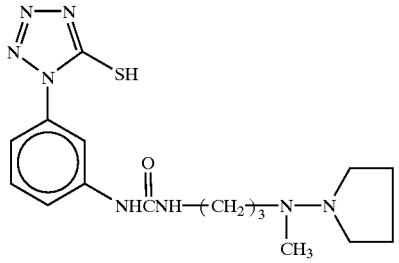
III-20
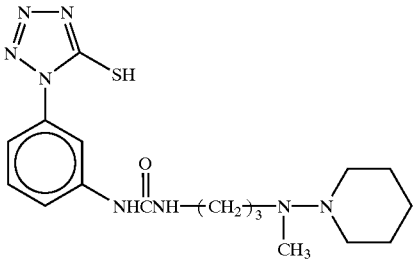
III-21
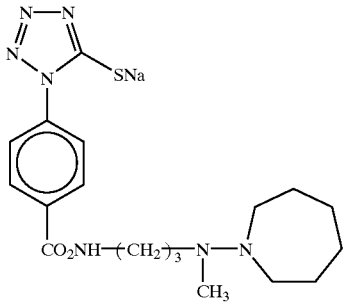
III-22
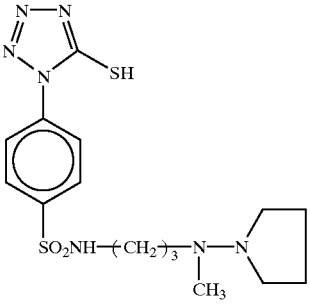
III-23
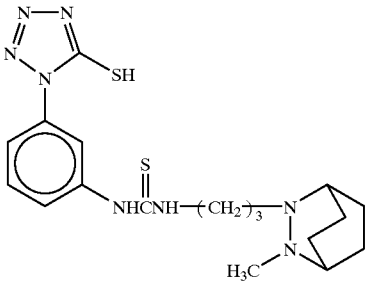
-continued
III-24
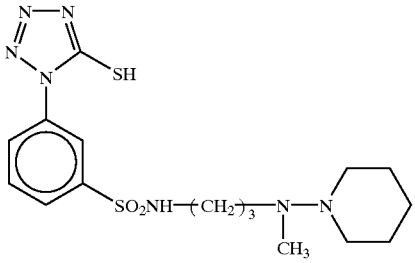
III-25
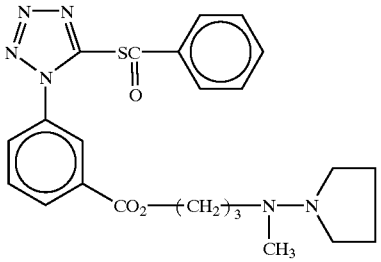
III-26
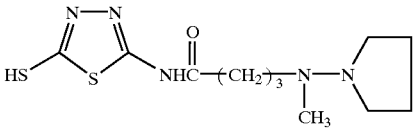
III-27
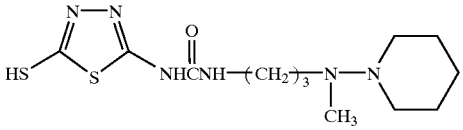
III-28
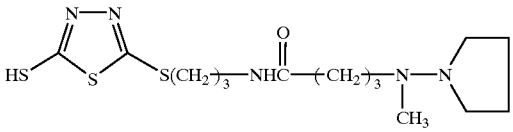
III-29
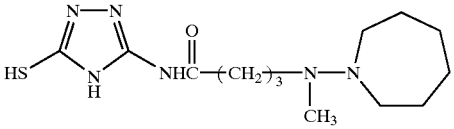
III-30
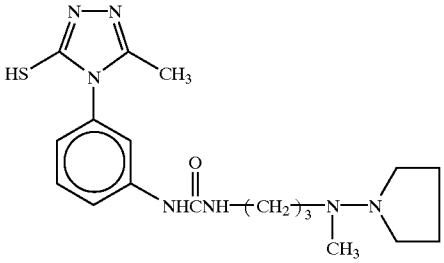

-continued
III-31
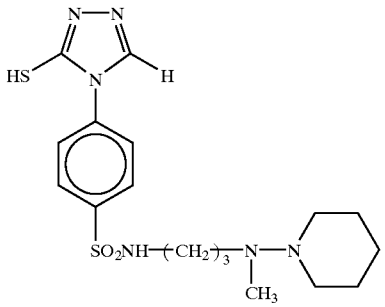
III-32
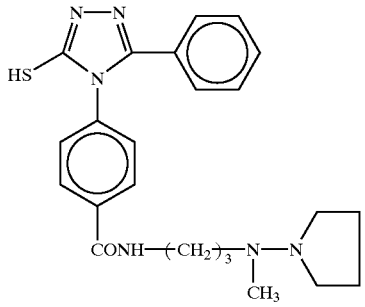
III-33
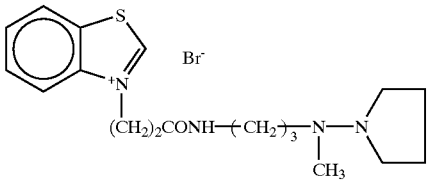
III-34
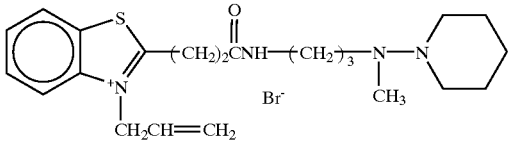
III-35
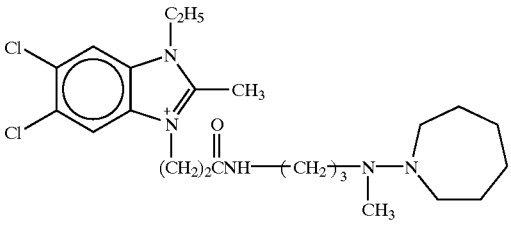
III-36
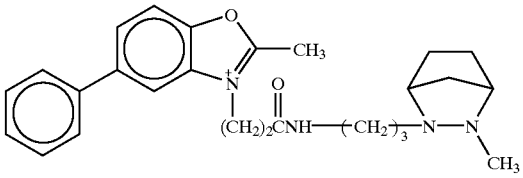
-continued
III-37
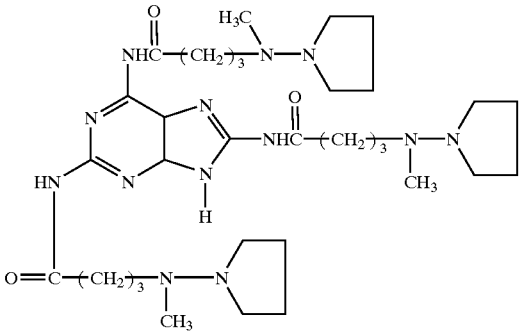
III-38
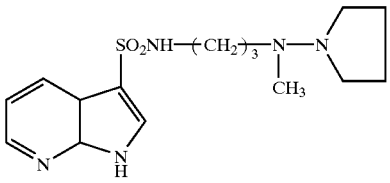
III-39
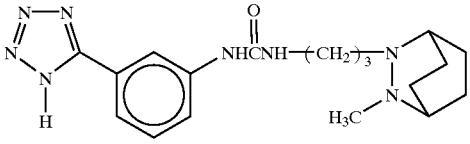
III-40
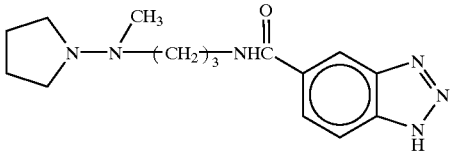
III-41
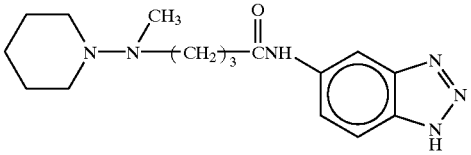
III-42
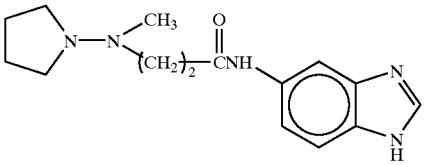
III-43
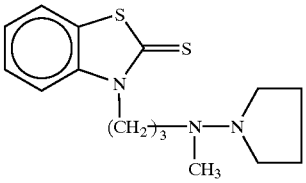

-continued

III-44

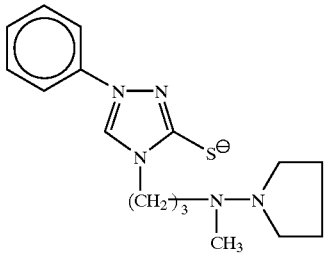

III-45

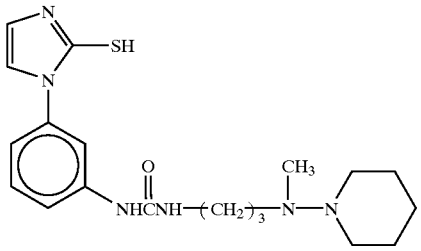

III-46

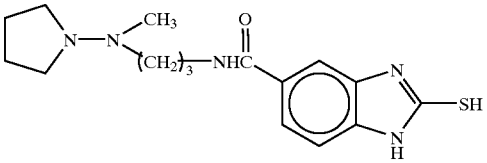

III-47

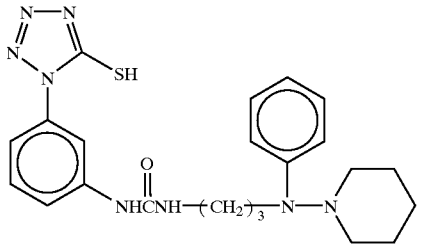

III-48

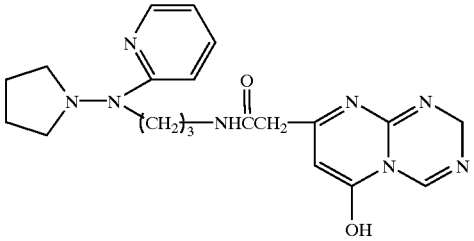

Het in the formula (III) for use in the present invention is described in U.S. Pat. No. 3,266,897, Belgian Patent No. 671,402, JP-A-60-138548, JP-A-59-68732, JP-A-59-123838, JP-B-58-9939, JP-A-59-137951, JP-A-57-202531, JP-A-57-164734, JP-A-57-14836, JP-A-57-116340, U.S. Pat. No. 4,418,140, JP-A-58-95728, JP-A-55-79436, OLS No. 2,205,029, OLS No. 1,962,605, JP-A-55-59463, JP-B-48-18257, JP-B-53-28084, JP-A-53-48723, JP-B-59-52414, JP-A-58-217928, JP-B-49-8334, U.S. Pat. No. 3,598,602, U.S. Pat. No. 887,009, U.K. Patent No. 965,047, Belgian Patent No. 737809, U.S. Pat. No. 3,622,340, JP-A-60-87322, JP-A-57-211142, JP-A-58-158631, JP-A-59-15240, U.S. Pat. No. 3,671,255, JP-B-48-34166, JP-B-48-322112, JP-A-58-221839, JP-B-48-32367, JP-A-60-130731, JP-A-60-122936, JP-A-60-117240, U.S. Pat. No. 3,228,770, JP-B-43-13496, JP-B-43-10256, JP-B-47-8725, JP-B-47-30206, JP-B-47-4417, JP-B-51-25340, U.K. Patent No. 1,165,075, U.S. Pat. No. 3,512,982, U.S. Pat. No. 1,472,845, JP-B-39-22067, JP-B-39-22068, U.S. Pat. No. 3,148,067, U.S. Pat. No. 3,759,901, U.S. Pat. No. 3,909,268, JP-B-50-40665, JP-B-39-2829, U.S. Pat. No. 3,148,066, JP-B-45-22190, U.S. Pat. No. 1,399,449, U.K. Patent No. 1,287,284, U.S. Pat. No. 3,900,321, U.S. Pat. No. 3,655,391, U.S. Pat. No. 3,910,792, U.K. Patent No. 1,064,805, U.S. Pat. No. 3,544,336, U.S. Pat. No. 4,003,746, U.K. Patent No. 1,344,525, U.K. Patent No. 972,211, JP-B-43-4136, U.S. Pat. No. 3,140,178, French Patent No. 2,015,456, U.S. Pat. No. 3,114,637, Belgian Patent No. 681,359, U.S. Pat. No. 3,220,839, U.K. Patent No. 1,290,868, U.S. Pat. No. 3,137,578, U.S. Pat. No. 3,420,670, U.S. Pat. No. 2,759,908, U.S. Pat. No. 3,622,340, OLS No. 2,501,261, DAS No. 1,772,424, U.S. Pat. No. 3,157,509, French Patent No. 1,351,234, U.S. Pat. No. 3,630,745, French Patent No. 2,005,204, German Patent No. 1,447,796, U.S. Pat. No. 3,915,710, JP-B-49-8334, U.K. Patent No. 1,021,199, U.K. Patent No. 919,061, JP-B-46-17513, U.S. Pat. No. 3,202,512, OLS No. 2,553,127, JP-A-50-104927, French Patent No. 1,467,510, U.S. Pat. No. 3,449,126, U.S. Pat. No. 3,503,936, U.S. Pat. No. 3,576,638, French Patent No. 2,093,209, U.K. Patent No. 1,246,311, U.S. Pat. No. 3,844,788, U.S. Pat. No. 3,535,115, U.K. Patent No. 1,161,264, U.S. Pat. No. 3,841,878, U.S. Pat. No. 3,615,616, JP-A-48-39039, U.K. Patent No. 1,249,077, JP-B-48-34166, U.S. Pat. No. 3,671,255, U.K. Patent No. 1,459,160, JP-A-50-6323, U.K. Patent No. 1,402,819, OSL No. 2,031,314, Research Disclosure No. 13651, U.S. Pat. No. 3,910,791, U.S. Pat. No. 3,954,478, U.S. Pat. No. 3,813,249, U.K. Patent No. 1,387,654, JP-A-57-135945, JP-A-57-96331, JP-A-57-22234, JP-A-59-26731, OLS No. 2,217,153, U.K. Patent No. 1,394,371, U.K. Patent No. 1,308,777, U.K. Patent No. 1,389,089, U.K. Patent No. 1,347,544, German Patent No. 1,107,508, U.S. Pat. No. 3,386,831, U.K. Patent No. 1,129,623, JP-A-49-14120, JP-B-46-34675, JP-A-50-43923, U.S. Pat. No. 3,642,481, U.K. Patent No. 1,269,268, U.S. Pat. No. 3,128,185, U.S. Pat. No. 3,295,981, U.S. Pat. No. 3,396,023, U.S. Pat. No. 2,895,827, JP-B-48-38418, JP-A-48-47335, JP-A-50-87028, U.S. Pat. No. 3,236,652, U.S. Pat. No. 3,443,951, U.K. Patent No. 1,065,669, U.S. Pat. No. 3,312,552, U.S. Pat. No. 3,310,405, U.S. Pat. No. 3,300,312, U.K. Patent No. 952,162, U.K. Patent No. 948,442, JP-A-49-120628, JP-B-48-35372, JP-B-47-5315, JP-B-39-18706, JP-B-43-4941, JP-A-59-34530, and the like. The aforementioned Het may be synthesized according to the methods described in the above references.

Hy in the formula (III) according to the present invention may be synthesized using various methods. For example, Hy may be synthesized by a method of alkylating a hydrazine. As such alkylation method, a method of substitution-alkylating using an alkyl halide or an alkyl sulfonate, a method of reductively alkylating using a carbonyl compound and a hydrogenated sodium cyanoborate, a method of reducing using hydrogenated lithium aluminum after being acylated, and the like are known. These methods are described in, for example, S. R. Sandler, W. Karo, "Organic Functional Group Preparation" Vol. 1, Chapter 14, pp. 434–465 (1968), Academic Press; E. L. Clennan et al. Journal of The American Chemical Society, Vol. 112, No. 13, page 5080 (1990), and the like. The aforementioned Hy may be synthesized by consulting to these references.

Bond-forming reactions including an amide bond-forming reaction and ester bond-forming reaction relative to the —(Q)k2—(Hy) portion, can be attained by making use of methods known in organic chemistry. Namely, any one of a method in which Het is connected to Hy, a method in which Het is synthesized after Hy is connected to a synthetic raw material or intermediate of Het, and a method in which Hy is synthesized after a synthetic raw material or intermediate of Hy is connected to an Het portion on the contrary, may be adopted. An appropriate method can be selected from these methods to enable synthesis. As to these synthetic reactions for connection, reference can be made to many published books relative to organic synthetic reactions, such as "Shin Jikken Kagaku Koza 14 (New Experimental Chemistry Lecture 14), "Yukikagobutsu no Gosei to Hanno (Synthesis and Reaction of organic Compounds)", Vol. I-V, edited by Nippon Kogaku Kai (Japan Chemical Society), Maruzen, Tokyo (1977); Yoshio Ogata, "Yuki Hanno-ron (Organic Reaction Theory)" Maruzen, Tokyo (1962); L. F. Fieser and M. Fieser, Advanced Organic Chemistry, Maruzen, Tokyo (1962).

To state in more specifically, the synthesis can be conducted using, for example, a method shown in Examples 1 and 2 of JP-A-7-135341.

The compound represented by the formula (III) in the present invention is preferably added in the manner dissolved in a water-soluble solvent such as water, methanol and ethanol, or a mixed solvent thereof. When dissolving in water, with respect to a compound that increases its solubility at a lower or higher pH, such a compound may be dissolved by raising or dropping the pH of water, and then it may be added.

The compound represented by the formula (III) may be added to a silver halide emulsion layer or a non-light-sensitive layer.

Although it is preferable to use the compound represented by the formula (III) in an emulsion layer, it may be added to a protective layer or an intermediate layer besides the emulsion layer in advance, to allow it diffuse at the time of coating.

The amount of the compound represented by the formula (III) according to the present invention is preferably $1\times10^{-9}$ to $5\times10^{-2}$ mol, and more preferably $1\times10^{-8}$ to $2\times10^{-3}$ mol, per 1 mol of the silver halide.

The compounds represented by the formulae (IV-A), (IV-B), and (IV-C) will be explained in more detail.

The alkyl group in the present invention means a straight-chain, branched or cyclic alkyl group and may it has a substituent.

In the formula (IV-A), $R_{a1}$ represents an alkyl group (preferably an alkyl group having 1 to 13 carbon atoms; for example, methyl, ethyl, i-propyl, cyclopropyl, butyl, isobutyl, cyclohexyl, t-octyl, decyl, dodecyl, hexadecyl and benzyl), alkenyl group (preferably, an alkenyl group having 2 to 14 carbon atoms; for example, allyl, 2-butenyl, isopropenyl, oleyl and vinyl) or aryl group (preferably, an aryl group having 6 to 14 carbon atoms; for example, phenyl and naphthyl). $R_{a2}$ represents a hydrogen atom or a group exemplified for $R_{a1}$. $R_{a3}$ represents a hydrogen atom, or a substituted or unsubstituted alkyl group having 1 to 10 carbon atoms (e.g., methyl, i-butyl and cyclohexyl), or an alkenyl group having 1 to 10 carbon atoms (e.g., a vinyl or i-propenyl group). The sum of the number of carbon atoms contained in $R_{a1}$, $R_{a2}$ and $R_{a3}$ is 20 or less, and more preferably 12 or less. Given as examples of substituents of $R_{a1}$ or $R_{a2}$ are hydroxy group, alkoxy group, aryloxy group, silyl group, silyloxy group, alkylthio group, arylthio group, amino group, acylamino group, sulfonamido group, alkylamino group, arylamino group, carbamoyl group, sulfamoyl group, sulfo group, carboxyl group, halogen atom, cyano group, nitro group, sulfonyl group, acyl group, alkoxycarbonyl group, aryloxycarbonyl group, acyloxy group, hydroxyamino group, heterocyclic group, and the like. $R_{a1}$ and $R_{a3}$, or $R_{a2}$ and $R_{a3}$ may bond together to form a five- to seven-membered ring.

In the formula (IV-B), X represents a heterocyclic group (a group forming a five- to seven-membered ring-state heterocycle, which has at least one of a nitrogen atom, sulfur atom, oxygen atom and phosphorus atom as its ring-structuring atom, and the position at which the heterocycle bonds to the nitrogen atom in the formula (the position of a monovalent group) is a carbon atom); examples are pyridine-2-yl, pyrazinyl, pyrimidinyl, purinyl, quinolyl, imidazolyl, thiazolyl, oxazolyl, 1,2,4-triazole-3-yl, benzimidazole-2-yl, benzthiazolyl, benzoxazolyl, thienyl, furyl, imidazolidinyl, pyrrolinyl, tetrahydrofuryl, 1,3,5-triazine-2-yl, 1,2,4-triazine-3-yl-morpholinyl and phosphinoline-2-yl. $R_{b1}$ represents an alkyl group, alkenyl group or aryl group having the same meanings as those of $R_{a1}$ in the formula (IV-A).

In the formula (IV-C), Y represents a non-metallic atomic group required to form a five-membered ring in combination with —N═C— (for example, cyclic group to be formed is an imidazolyl, benzimidazolyl, 1,3-thiazole-2-yl, 2-imidazoline-2-yl, purinyl or 3H-indole-2-yl). Y also represents a non-metallic atomic group required to form a six-membered ring in combination with an —N═C— group, and the end of Y to be bonded with a carbon atom of the —N═C— group represents one group selected from the group consisting of —N($R_{c1}$)—, —C($R_{c2}$)($R_{c3}$)—, —C($R_{c4}$)═, —O—, and —S— (bonded with the carbon atom of —N═C— group at the left side of each group). $R_{c1}$, $R_{c2}$, $R_{c3}$, and $R_{c4}$, which may be the same or different, respectively represent a hydrogen atom or substituent (e.g., alkyl group, alkenyl group, aryl group, alkoxy group, aryloxy group, alkylthio group, arylthio group, alkylamino group, arylamino group or halogen atom). Given as examples of the six-membered cyclic group formed by Y are a quinolyl group, isoquinolyl group, phthalazinyl group, quinoxalinyl group, 1,3,5-triazine-5-yl group, and 6H-1,2,5-thiadiazine-6-yl group.

In the formula (IV-B), $R_{b1}$ is preferably an alkyl group or alkenyl group, and more preferably an alkyl group. On the other hand, as the compound of the formula (IV-B), those represented by the following formula (IV-D) are preferable.

formula (IV-D)

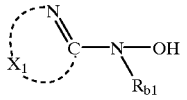

In formula (IV-D), $R_{b1}$ has the same meanings as $R_{b1}$ shown in the formula (IV-B), and $X_1$ has the same meanings as Y shown in the formula (IV-C).

Among the compounds represented by the formulae (IV-A), (IV-B), and (IV-C), those in which the sum of the number of carbon atoms is 20 or less are preferable, and those in which the sum of the number of carbon atoms is 12 or less are more preferable.

Among the compounds represented by the formulae (IV-A) to (IV-C), those represented by the formulae (IV-A) and (IV-B) are preferable, those represented by the formulae (IV-A) and (IV-D) are more preferable, and those represented by the formula (IV-A) are most preferable.

Specific examples of the compound represented by the formulae (IV-A), (IV-B), and (IV-C) according to the present invention will be given below, however, these examples are not intended to be limiting of the present invention.

(IV-A-1)
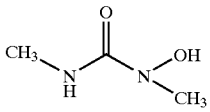
(IV-A-2)
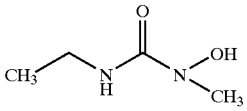
(IV-A-3)
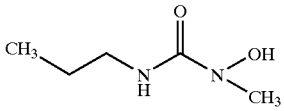
(IV-A-4)
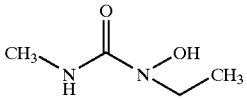
(IV-A-5)
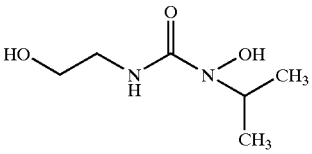
(IV-A-6)
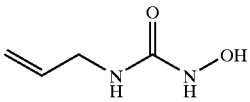
(IV-A-7)
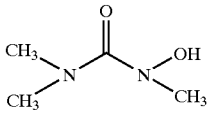
(IV-A-8)
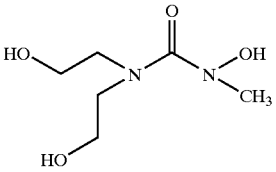
(IV-A-9)
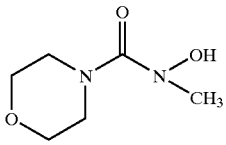
(IV-A-10)
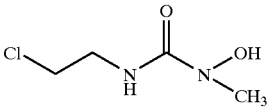
(IV-A-11)
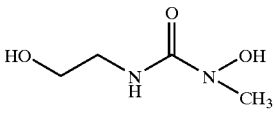
(IV-A-12)
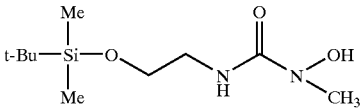
-continued
(IV-A-13)
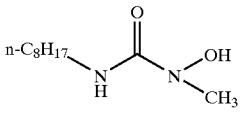
(IV-A-14)
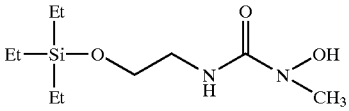
(IV-A-15)
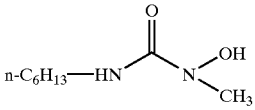
(IV-A-16)
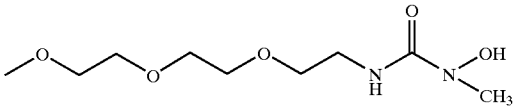
(IV-A-17)
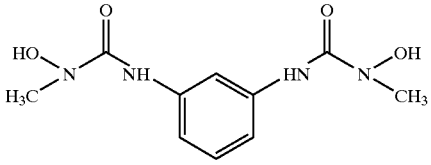
(IV-A-18)
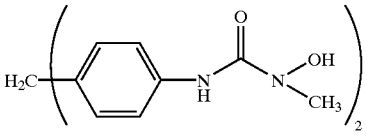
(IV-A-19)
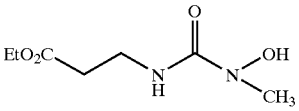
(IV-A-20)
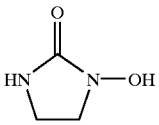
(IV-A-21)
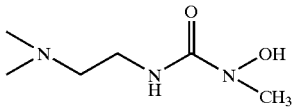
(IV-A-22)
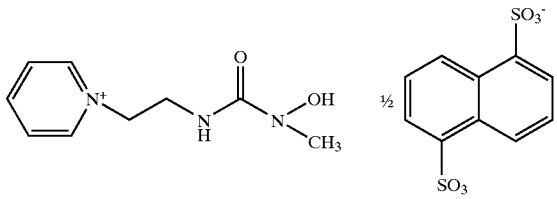
(IV-A-23)
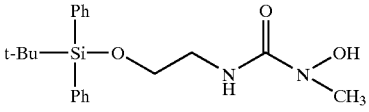

-continued
(IV-A-24)
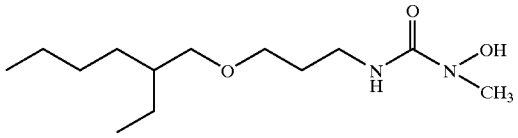
(IV-A-25)
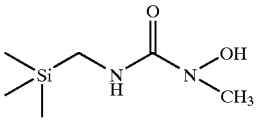
(IV-A-26)
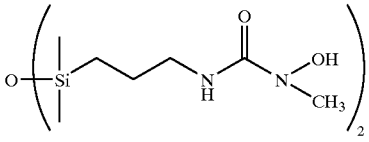
(IV-A-27)
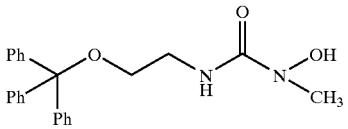
(IV-A-28)
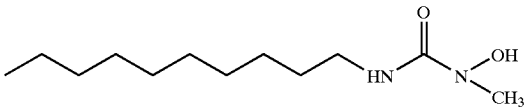
(IV-A-29)
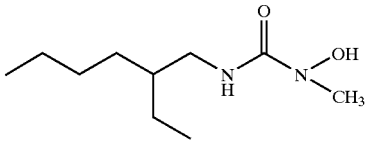
(IV-A-30)
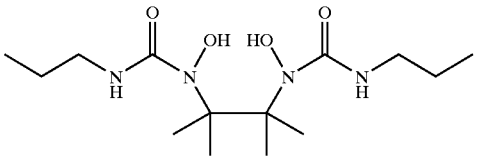
(IV-A-31)
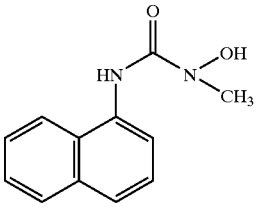
(IV-A-32)
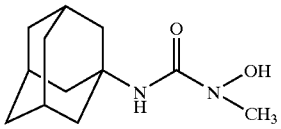
(IV-A-33)
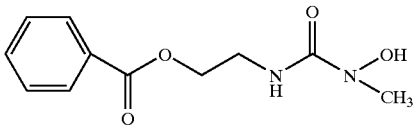
-continued
(IV-A-34)
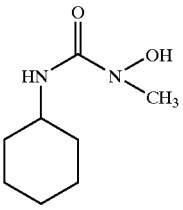
(IV-A-35)
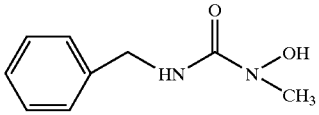
(IV-A-36)
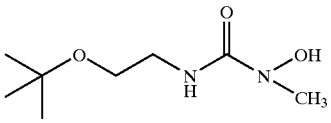
(IV-A-37)
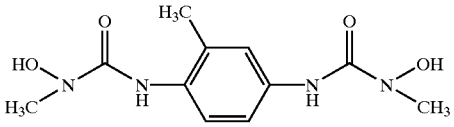
(IV-A-38)
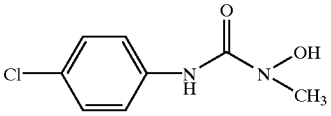
(IV-A-39)
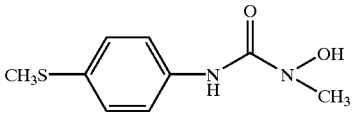
(IV-A-40)
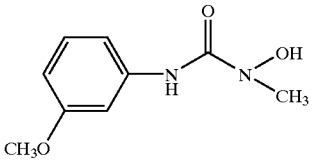
(IV-A-41)
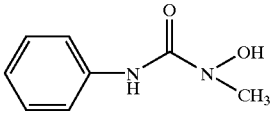
(IV-A-42)
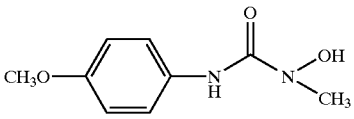
(IV-A-43)
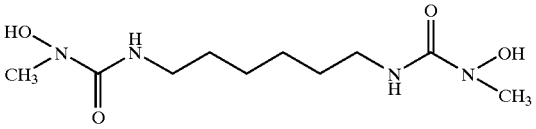
(IV-A-44)
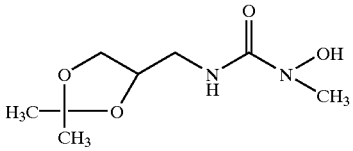

-continued
(IV-A-45)
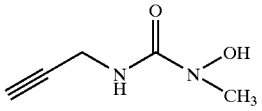
(IV-A-46)
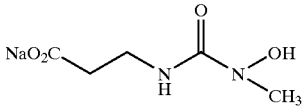
(IV-A-47)
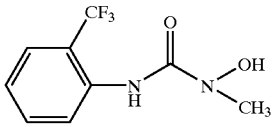
(IV-A-48)
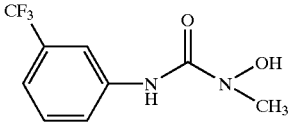
(IV-A-49)
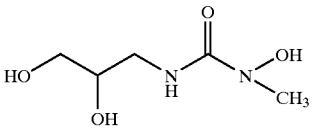
(IV-A-50)
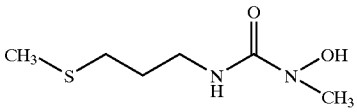
(IV-A-51)
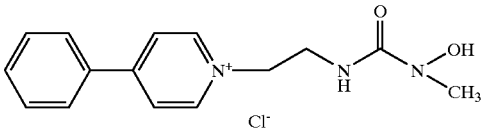
(IV-A-52)
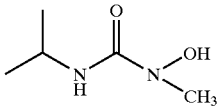
(IV-A-53)
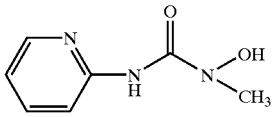
(IV-A-54)
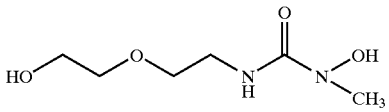
(IV-A-55)
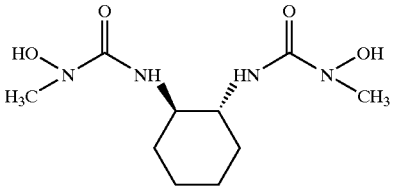
-continued
(IV-A-56)
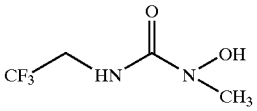
(IV-A-57)
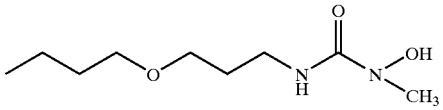
(IV-A-58)
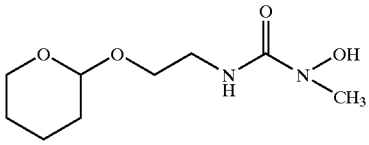
(IV-A-59)
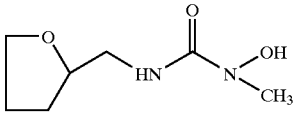
(IV-A-60)
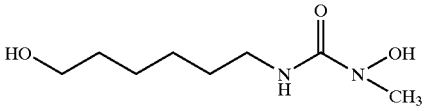
(IV-A-61)
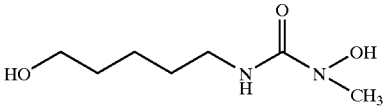
(IV-A-62)
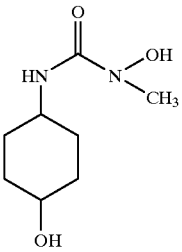
(IV-A-63)
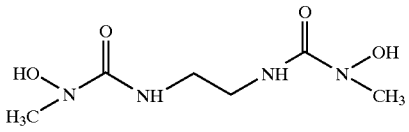
(IV-A-64)
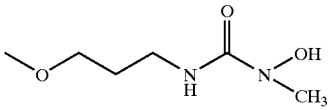
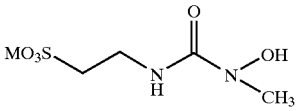
(IV-A-66)
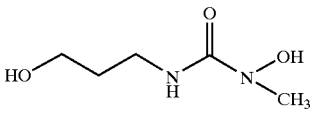

-continued
(IV-A-67)
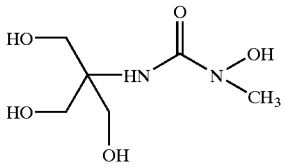
(IV-A-68)
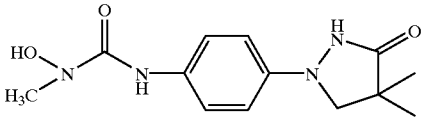
(IV-A-69)
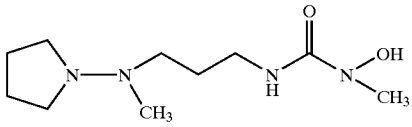
(IV-A-70)
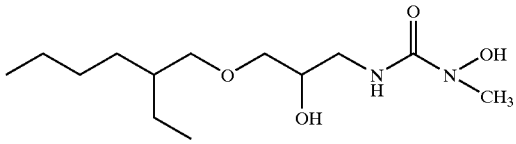
(IV-A-71)
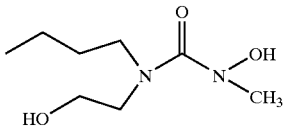
(IV-A-72)
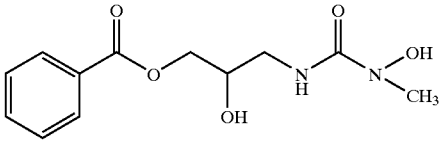
(IV-B-1)
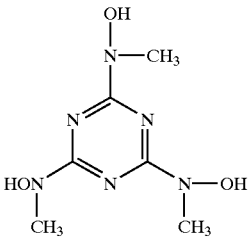
(IV-B-2)
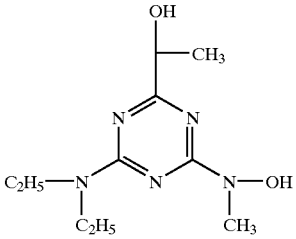
-continued
(IV-B-3)
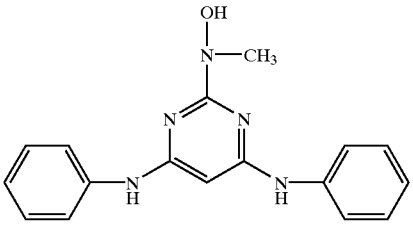
(IV-B-4)
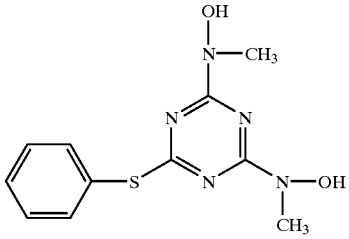
(IV-B-5)
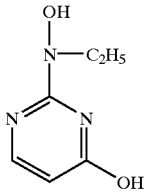
(IV-B-6)
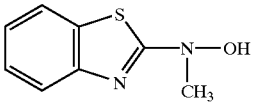
(IV-B-7)
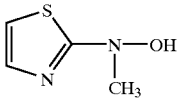
(IV-B-8)
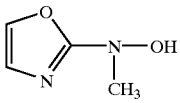
(IV-B-9)
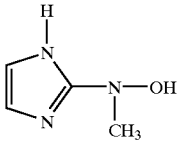
(IV-B-10)
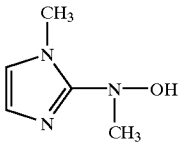
(IV-B-11)
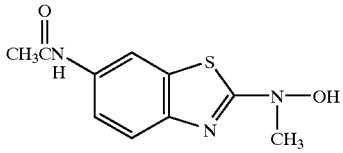

-continued
(IV-B-12)
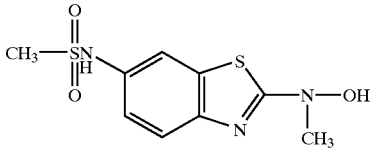
(IV-B-13)
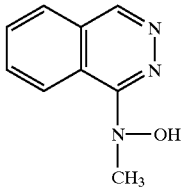
(IV-B-14)
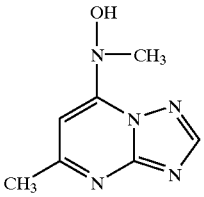
(IV-B-15)
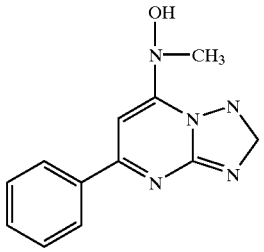
(IV-B-16)
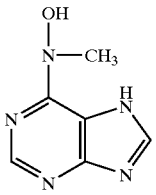
(IV-B-17)
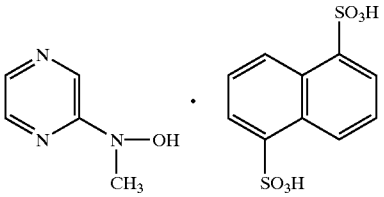
(IV-B-18)
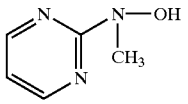
(IV-B-19)
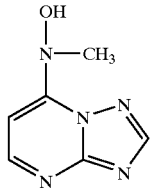
-continued
(IV-B-20)
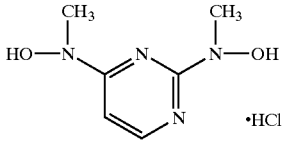
(IV-B-21)
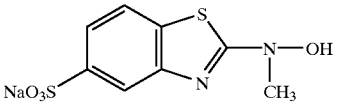
(IV-B-22)
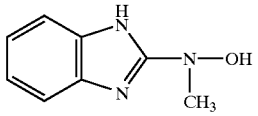
(IV-B-23)
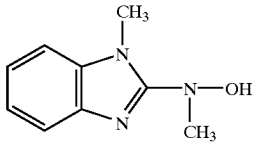
(IV-B-24)
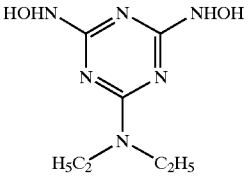
(IV-C-1)
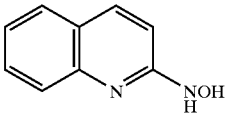
(IV-C-2)
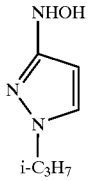
(IV-C-3)
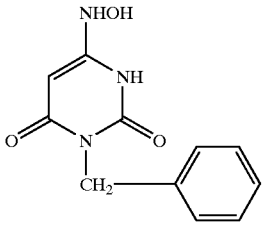
(IV-C-4)
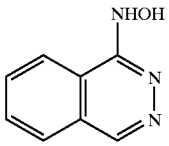
(IV-C-5)
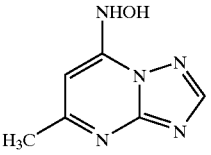

-continued (IV-C-6)

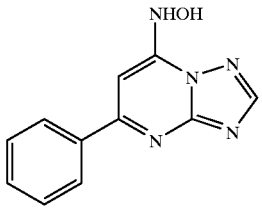

(IV-C-7)

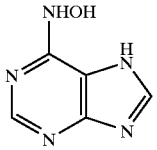

(IV-C-8)

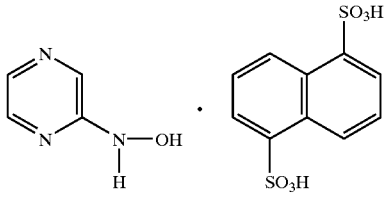

(IV-C-9)

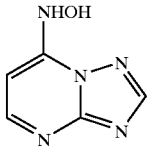

(IV-C-10)

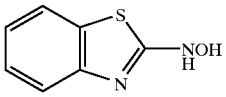

(IV-C-11)

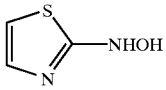

(IV-C-12)

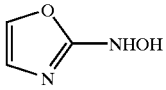

(IV-C-13)

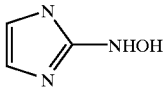

(IV-C-14)

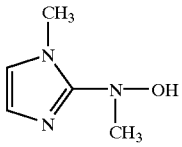

(IV-C-15)

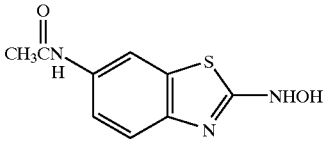

These compounds for use in the present invention can be easily synthesized by each of methods described in J. Org. Chem., 27, 4054 ('62), J. Amer. Chem. Soc., 73, 2981 ('51), and JP-B-49-10692, and the like, or a method based on these methods.

The compound represented by the formula (IV-A), (IV-B), or (IV-C) may be added to a silver halide emulsion layer or a non-light-sensitive layer.

In the present invention, the compound represented by the formulae (IV-A), (IV-B), or (IV-C) may be added by dissolving or emulsion-dispersing it in a water-soluble solvent such as water, methanol or ethanol, or a mixed solvent of these solvents. When dissolving in water, with respect to a compound that increases its solubility at a lower or higher pH, such a compound may be dissolved by raising or dropping the pH of water when it is added, or a surfactant is allowed to coexist in water.

In the present invention, the compounds represented by the formulae (IV-A) to (IV-C) is preferably added when the preparation of an emulsion. In the case of adding the compound when an emulsion is prepared, it may be added in any case of the process. Given as examples of these cases are a step of forming silver halide particles, a stage prior to the start of a desalting step, a desalting step, a stage prior to the start of chemical ripening, a chemical ripening step, and a step prior to the preparation of a finished emulsion. Also, the compound may be divided into plural lots and added in plural steps. The compound is preferably added before, during or after the stage of chemical sensitization. The compound may also be added before a coating solution is applied, or may be added to a layer adjacent to an emulsion layer or to other layers, when a coating solution is applied, to thereby diffuse the compound into the emulsion layer. Moreover, the compound may be used as a material obtained by dispersing and dissolving the compound in an emulsion, and then mixing it with the emulsion.

In the present invention, two or more types among the compounds represented by the formulae (IV-A), (IV-B), and (IV-C) may be used together. When two or more types are used, they may also be selected from the compounds represented by the formula (IV-B). When two or more types are used, they may be added to either the same layer or separate layers.

In the present invention, the addition amount of the compound represented by the formulae (IV-A), (IV-B), or (IV-C) is preferably $1\times10^{-6}$ mol to $5\times10^{-2}$ mol, and more preferably $1\times10^{-5}$ mol to $5\times10^{-3}$ mol per 1 mol of the light-sensitive silver halide, though a preferable amount largely depends on the aforementioned addition method and type of compound to be added.

In the present invention, the compounds selected from the group consisting of the compounds represented by the formula (III), and the compounds represented by the formulae (IV-A), (IV-B), and (IV-C), may be added to either the same layer or separate layers.

Next, the compound represented by the formula (V) will be explained.

In the formula (V), each of $R_{21}$, $R_{22}$ and $R_{23}$ independently represent a hydrogen atom, alkyl group, alkenyl group, alkinyl group, aryl group or heterocyclic group; $R_{24}$ represents a hydrogen atom, alkyl group, alkenyl group, alkinyl group, aryl group, heterocyclic group, or $NR_{25}R_{26}$; $L_{21}$ represents —CO— or —$SO_2$—, and n denotes 0 or 1. $R_{25}$ represents a hydrogen atom, hydroxyl group, amino group, alkyl group, alkenyl group, alkinyl group, aryl group, or heterocyclic group, and $R_{26}$ represents a hydrogen atom, alkyl group, alkenyl group, alkinyl group, aryl group, or heterocyclic group.

As to $R_{21}$, $R_{22}$ and $R_{23}$, the alkyl group, alkenyl group and alkinyl group are preferably those having 1 to 30 carbon atoms, and particularly, a straight-chain, branched or cyclic alkyl group having 1 to 10 carbon atoms, an alkenyl group having 2 to 10 carbon atoms, or an alkinyl group having 2 to 10 carbon atoms. As the alkyl group, alkenyl group, alkinyl group and aralkyl group can be mentioned are, for example, methyl, ethyl, propyl, cyclopropyl, allyl, propargyl, and benzyl groups. The aryl group for $R_{21}$, $R_{22}$ and $R_{23}$ is preferably those having 6 to 30 carbon atoms, and particularly, a monocyclic or condensed cyclic aryl group having 6 to 12 carbon atoms, for example, phenyl and naphthyl. The heterocyclic group for $R_{21}$, $R_{22}$ and $R_{23}$ is a three- to ten-membered saturated or unsaturated heterocycle containing at least one of a nitrogen atom, oxygen atom and sulfur atom. They may be monocyclic, or may respectively form a condensed ring in combination with other aromatic rings. The heterocycle is preferably a five- to six-membered aromatic heterocycle, for example, pyridyl, imidazolyl, quinolyl, benzimidazolyl, pyrimidyl, pyrazolyl, isoquinolyl, thiazolyl, thienyl, furyl, or benzothiazolyl.

The alkyl group, alkenyl group, alkinyl group, aryl group, and heterocyclic group for $R_{24}$ respectively have the same meanings as those groups exemplified for $R_{21}$, $R_{22}$ and $R_{23}$. The alkyl group, alkenyl group, alkinyl group, aryl group, and heterocyclic group for each of $R_{25}$ and $R_{26}$ in $NR_{25}R_{26}$ of $R_{24}$ respectively have the same meanings as those groups exemplified for $R_{21}$, $R_{22}$ or $R_{23}$.

Each group represented by $R_{21}$, $R_{22}$, $R_{23}$, $R_{24}$, $R_{25}$ and $R_{26}$ in the formula (V) may be substituted. As the substituent, the following groups can be mentioned.

Examples of the substituent include a halogen atom (fluorine atom, chlorine atom, bromine atom and iodine atom), cyano group, nitro group, ammonio group (e.g., trimethylammonio), phosphonio group, sulfo group, sulfino group, carboxy group, phosphono group, hydroxy group, mercapto group, hydrazino group, alkyl group (e.g., methyl, ethyl, n-propyl, isopropyl, t-butyl, n-octyl, cyclopentyl and cyclohexyl), alkenyl group (e.g., allyl, 2-butenyl, and 3-pentenyl), alkinyl group (e.g., propargyl and 3-pentinyl), aralkyl group (e.g., benzyl and phenethyl), aryl group (e.g., phenyl, naphthyl and 4-methylphenyl), heterocyclic group (e.g., pyridyl, furyl, imidazolyl, piperidyl, and morpholino), alkoxy group (e.g., methoxy, ethoxy and butyloxy), aryloxy group (e.g., phenoxy and 2-naphthyloxy), alkylthio group (e.g., methylthio and ethylthio), arylthio group (e.g., phenylthio), amino group (e.g., unsubstituted amino group, methylamino, dimethylamino, ethylamino, and anilino), acyl group (e.g., acetyl, benzoyl, formyl, and pivaloyl), alkoxycarbonyl group (e.g., methoxycarbonyl and ethoxycarbonyl), aryloxycarbonyl group (e.g., phenoxycarbonyl), carbamoyl group (e.g., unsubstituted carbamoyl group, or an N,N-dimethylcarbamoyl, N-ethylcarbamoyl and N-phenylcarbamoyl), acyloxy group (e.g., acetoxy and benzoyloxy), acylamino group (e.g., acetylamino and benzoylamino), alkoxycarbonylamino group (e.g., methoxycarbonylamino), aryloxycarbonylamino group (e.g., phenoxycarbonylamino), ureido group (e.g., unsubstituted ureido and an N-methylureido and N-phenylureido), alkylsulfonylamino group (e.g., methylsulfonylamino), arylsulfonylamino group (e.g., phenylsulfonylamino), alkylsulfonyloxy group (e.g., methylsulfonyloxy), arylsulfonyloxy group (e.g., phenylsulfonyloxy), alkylsulfonyl group (e.g., mesyl), arylsulfonyl group (e.g., tosyl), alkoxysulfonyl group (e.g., methoxysulfonyl), aryloxysulfonyl group (e.g., phenoxysulfonyl), sulfamoyl group (e.g., unsubstituted sulfamoyl group, N-methylsulfamoyl, N,N-dimethylsulfamoyl and N-phenyl sulfamoyl), alkylsulfinyl group (e.g., methylsulfinyl), arylsulfinyl group (e.g., phenylsulfinyl), alkoxysulfinyl group (e.g., methoxysulfinyl), aryloxysulfinyl group (e.g., phenoxysulfinyl) and phosphoric acid amido group (e.g., N,N-diethylphosphoric acid amido). These groups may be further substituted. When two or more substituents are present, these substituents may be the same or different.

In the formula (V), each of $R_{21}$ and $R_{22}$, $R_{21}$ and $R_{23}$, $R_{23}$ and $R_{24}$, or $R_{24}$ and $R_{22}$ may bond with each other to form a ring.

In the formula (V), when n is 0, preferably $R_{21}$, $R_{22}$ and $R_{23}$ are respectively an alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group, and $R_{24}$ is a hydrogen atom, alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group; and more preferably $R_{21}$, $R_{22}$, $R_{23}$ are respectively an alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group, and $R_{24}$ is a hydrogen atom. When n is 1, preferably $R_{21}$, $R_{22}$ and $R_{23}$ are respectively a hydrogen atom, alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group, $L_{21}$ is —CO—, $R_{24}$ is a hydrogen atom, alkyl group having 1 to 10 carbon atoms, alkenyl group having 2 to 10 carbon atoms, alkinyl group having 2 to 10 carbon atoms, aryl group having 6 to 10 carbon atoms, nitrogen-containing heterocyclic group, or $NR_{25}R_{26}$, $R_{25}$ is a hydrogen atom, hydroxyl group, amino group, alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group, and $R_{26}$ is a hydrogen atom, alkyl group having 1 to 10 carbon atoms, alkenyl group having 2 to 10 carbon atoms, alkinyl group having 2 to 10 carbon atoms, aryl group having 6 to 10 carbon atoms, or nitrogen-containing heterocyclic group; and more preferably $R_{21}$ is an aryl group having 6 to 10 carbon atoms, $R_{22}$ and $R_{23}$ are respectively a hydrogen atom, $L_{21}$ is —CO—, $R_{24}$ is $NR_{25}R_{26}$, and $R_{25}$ is a hydrogen atom, hydroxyl group, or alkyl group having 1 to 10 carbon atoms, alkenyl, or alkinyl group.

Specific examples of the compound represented by the formulae (V) will be given below, however, these examples are not intended to be limiting of the present invention.

(V-1)

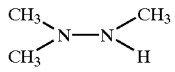

(V-2)

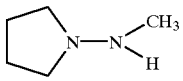

(V-3)

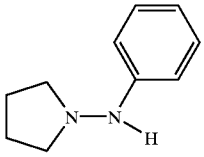

-continued
(V-4)
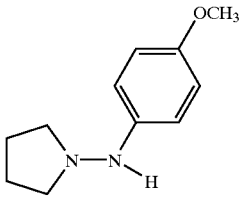
(V-5)
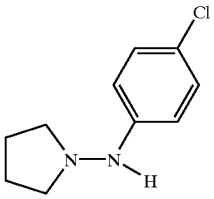
(V-6)
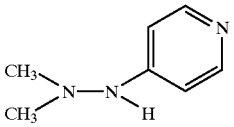
(V-7)
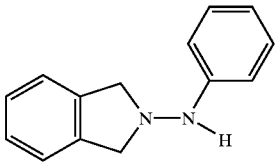
(V-8)
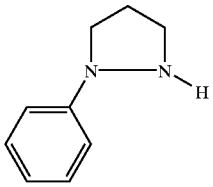
(V-9)
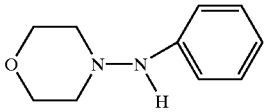
(V-10)
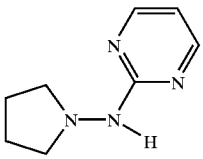
(V-11)
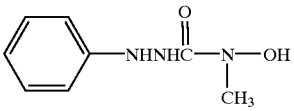
(V-12)
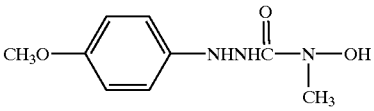
(V-13)
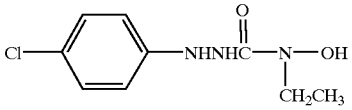
-continued
(V-14)
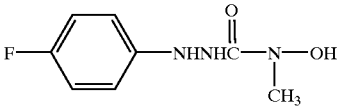
(V-15)
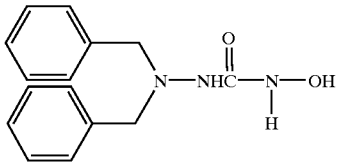
(V-16)
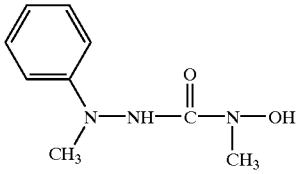
(V-17)
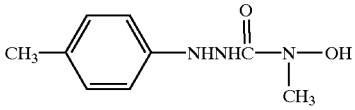
(V-18)
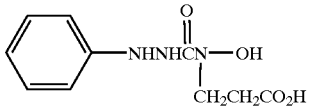
(V-19)
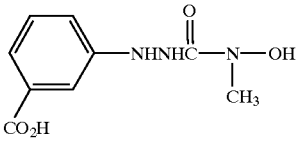
(V-20)
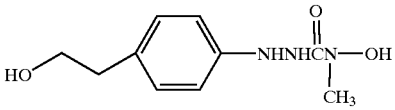
(V-21)
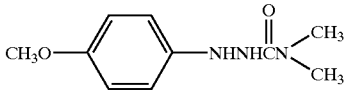
(V-22)
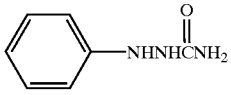
(V-23)
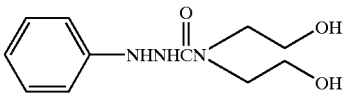
(V-24)
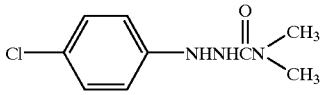
(V-25)
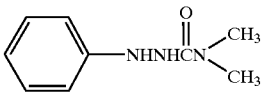
The compound represented by the formula (V) can be easily obtained as commercially available chemicals, or as compounds that can be synthesized from commercially available chemicals by a conventional method. The compound represented by the formula (V) may be synthesized easily by the methods described in J. Am. Chem. Soc., Vol. 72, page 2762 (1950); Organic Synthesis, Vol. 2, page 395; Shin Jikken Kagaku-Koza (New Experimental Chemistry Lecture), Vol. 14-2 or Vol. 14-3 (1977), Maruzen; and the like; or a method based on these methods.

The compound represented by formula (V) may be added to a silver halide emulsion layer or a non-light-sensitive layer.

The compound represented by the formula (V) is preferably added to a layer adjacent to an emulsion layer or other layers, before or when a coating solution is applied, to allow the added compound to diffuse into the emulsion layer. The compound may be added before, during or after chemical sensitization in the preparation of the emulsion.

The compound is used in an amount of generally $5\times10^{-6}$ mol to 0.05 mol, and more preferably $1\times10^{-5}$ mol to 0.005 mol per one mol of light-sensitive silver halide, though a preferable amount of the compound to be added largely depends upon the aforementioned addition method and the type of compound to be added. When the amount is greater than the above defined amount, this brings about adverse effects such as an increase in fogging and is therefore undesirable.

The compound represented by the formula (V) is preferably added by dissolving it in a water-soluble solvent. The pH may be either lowered or raised using an acid or a base. A surfactant is allowed to coexist. The compound may be added by dissolving it as an emulsion dispersion in a high-boiling organic solvent, or may be added as a microcrystal dispersion by using a known dispersing method.

The compounds represented by the formula (V) may be used in combinations of two or more. When the compounds represented by the formula (V) are used in combinations of two or more, these compounds may be added to either the same layer or different layers.

Next, the color diffusion-transfer light-sensitive material of the present invention will be explained.

A color diffusion-transfer film unit typically has a structure in which an image receiving-element and a light-sensitive element are laminated on one transparent support, and it is unnecessary to peel off the light-sensitive element from the image-receiving element after a transferred image is completed. To state in more detail, the image-receiving element comprises at least one mordant layer, and the light-sensitive element comprises, in a preferred embodiment, a combination of a blue-sensitive emulsion layer, a green-sensitive emulsion layer, and a red-sensitive emulsion layer, a combination of a green-sensitive emulsion layer, a red-sensitive emulsion layer, and an infrared-sensitive emulsion layer, or a combination of a blue-sensitive emulsion layer, a red-sensitive emulsion layer, and an infrared-sensitive emulsion layer, wherein a yellow dye image-forming compound, a magenta dye image-forming compound and a cyan dye image-forming compound are combined with the aforementioned emulsion layers respectively (here, the "infrared-sensitive emulsion layer" means a layer having a maximum spectral sensitivity at 700 nm or more and particularly 740 nm or more). In addition to the above, a white reflecting layer containing a solid pigment such as titanium oxide is disposed between the mordant layer and the light-sensitive layer, or the layer containing a dye image-forming compound, so as to view a transferred image through the transparent support.

A light-shielding layer may be further disposed between the white reflecting layer and the light-sensitive layer, to make it possible to finish developing treatment in a well-lighted place. Also, a peelable layer may be formed at a proper position so that all or a part of the light-sensitive element can be peeled from the image-receiving element, if desired. Such an embodiment is described in, for example, JP-A-56-67840 and Canadian Patent No. 674,082.

Another embodiment, which is peelable laminate layer type, include a color diffusion-transfer photographic film unit as disclosed in JP-A-63-226649. This film unit comprises a light-sensitive element having at least one silver halide emulsion layer combined with at least (a) a layer having a neutralizing function, (b) a dye image-receiving layer, (c) a peelable layer and (d) a dye image-forming compound in order, on a white support, an alkali treatment composition containing a light-shielding agent, and a transparent cover sheet, and wherein a layer having a light-shielding function is disposed on the side opposite to the side of the emulsion layer where the treating composition is developed.

Also, in a further peel-less form, the aforementioned light-sensitive element is coated on one transparent support, a white reflecting layer is coated on the light-sensitive element, and an image-receiving layer is further laminated on the reflecting layer. An embodiment in which an image-receiving element, a white reflecting layer, a peelable layer, and a light-sensitive element are laminated on the same support, and the light-sensitive element is peeled intentionally from the image-receiving element, is described in U.S. Pat. No. 3,730,718.

On the other hand, typical forms in which a light-sensitive element and a image receiving element are separately coated on two supports respectively are roughly classified into two categories. One is a peel-apart type and another is a peel-less type. To state these types in detail, in a preferred embodiment of a peel type film unit, at least one image-receiving layer is coated on one support, and a light-sensitive element is coated on another support provided with a light-shielding layer. This film unit has a devised structure in which the coating surface of a light-sensitive layer does not face the coating surface of a mordant layer before exposure is finished, and after exposure is finished (for example, during developing treatment), the coating surface of the light-sensitive layer turns over in an image-forming device so that it is brought into contact with the coating surface of the image-receiving layer. After, a transferred image is completed in the mordant layer, the light-sensitive element is rapidly peeled from the image-receiving element.

Further, in a preferred embodiment of a peel-less type film unit, at least one mordant layer is coated on a transparent support, and a light-sensitive element is coated on a support, which is transparent or is provided with a light-shielding layer, wherein the coating surface of the light-sensitive layer and the coating surface of the mordant layer are overlapped on facing each other.

A container (processing element), which contains an alkaline process solution and can be ruptured by pressure, may be further combined with the aforementioned form. Especially, in the peel-less type film unit in which an image-receiving element and a light-sensitive element are laminated on one support, such processing element is preferably disposed between the light-sensitive element and a cover sheet, which is to be overlapped on the light-sensitive element. Also, in the form in which a light-sensitive element and an image-receiving element are separately coated on two supports respectively, the processing element is preferably disposed between the light-sensitive element and the image-receiving element, by the time of processing at the latest. The processing element preferably contains one or both of a light-shielding agent (e.g. carbon black, a dye, which varies in color corresponding to pH, and the like) and a white pigment (e.g., titanium oxide), corresponding to the form of the film unit. Further, in a color diffusion-transfer method film unit, a neutralizing timing mechanism that comprises a combination of a neutralizing layer and a neutralizing timing layer, is preferably incorporated into a cover sheet, an image-receiving element, or a light-sensitive element.

Each structural element, which may be used for the light-sensitive material of the present invention, will be hereinafter explained in more detail.

I. Light-sensitive sheet

A) Support

As the support of the light-sensitive sheet for use in the present invention, any one of smooth transparent supports, which are usually used for photographic light-sensitive materials, may be used. For example, cellulose acetate, polystyrene, polyethylene terephthalate, polycarbonate, and the like is used. The support is preferably provided with an undercoat layer. The support preferably contains a minute amount of a dye or pigment such as titanium oxide in general, to prevent light-piping.

The thickness of the support is generally 50 to 350 $\mu$m, preferably 70 to 210 $\mu$m, and more preferably 80 to 150 $\mu$m.

A curl-balancing layer, or an oxygen-shielding layer as described in JP-A-56-78833 may be applied to the backside of the support according to the need.

B) Image-receiving layer

The dye image-receiving layer for use in the present invention is a layer containing a mordant in a hydrophilic colloid. This dye image-receiving layer may be a single layer or may have a multilayer structure, in which mordants having different mordant powers are coated such that they are overlapped on each other. There are descriptions concerning this in JP-A-61-252551. As the mordants, polymer mordants are preferable.

The polymer mordants are, for example, polymers containing a secondary or tertiary amino group, polymers having a nitrogen-containing heterocyclic portion, and polymers containing a quaternary cation, and those having a molecular weight of 5,000 or more, and particularly preferably 10,000 or more.

The amount of the mordant to be applied is generally 0.5 to 10 g/m$^2$, preferably 1.0 to 5.0 g/m$^2$, and particularly preferably 2 to 4 g/m$^2$.

As the hydrophilic colloid for use in the image-receiving layer, a gelatin, polyvinyl alcohol, polyacrylamide, polyvinylpyrrolidone, or the like is used, and a gelatin is preferably used.

An anti-fading agent as described in JP-A-62-30620, JP-A-62-30621, and JP-A-62-215272, may be incorporated into the image-receiving layer.

C) White reflecting layer

A white reflecting layer that forms a white background of a color image, generally contains a white pigment and a hydrophilic binder.

As the white pigment for the white reflecting layer, barium sulfate, zinc oxide, barium stearate, silver flakes, silicates, alumina, zirconium oxide, sodium zirconium sulfate, kaolin, mica, titanium dioxide, or the like is used. Further, non-filming polymer particles made of styrene or the like are used. Also, these pigments may be used singly, or by mixing them as far as an intended reflection factor is obtained.

A particularly useful white pigment is titanium dioxide.

The whiteness of the white reflecting layer varies depending on the type of pigment, the compounding ratio of the pigment and the binder, and the amount of the pigment to be applied. It is, however, desirable that the layer has light reflectance of 70% or more. Generally, the whiteness increases with an increase in the amount of the pigment to be applied. However, when an image-forming dye diffuses through this layer, the pigment resists the diffusion of the dye. It is therefore desirable to make the amount to be applied appropriate.

A white reflecting layer, which is coated with titanium dioxide in an amount of generally 5 to 40 g/m$^2$, and preferably 10 to 25 g/m$^2$, and has a light reflectance of 78 to 85% for light having a wavelength of 540 nm, is preferable. Titanium dioxide may be preferably selected from a variety of commercially available brands for use.

Among these titanium dioxides, particularly, rutile type titanium dioxide is preferably used.

Most of commercially available products are surface-treated using alumina, silica, zinc oxide or the like. Titanium dioxide, which is surface-treated to an extent of 5% or more in amount, is desirable to obtain a high reflectance. Commercially available titanium dioxide includes those described in Research Disclosure No. 15162, besides Tipure R931 (trade name) manufactured by Du Pont K.K..

As the binder for the white reflecting layer, an alkali-penetrative polymer matrix, for example, a gelatin, polyvinyl alcohol, and cellulose derivative such as hydroxyethyl cellulose, and carboxymethyl cellulose, may be used.

A particularly desirable binder for the white reflecting layer is a gelatin. The ratio of the white pigment to the gelatin is generally 1/1 to 20/1 (mass ratio), and preferably 5/1 to 10/1 (mass ratio).

An anti-fading agent as described in JP-B-62-30620 and JP-B-62-30621 is preferably incorporated into the white reflecting layer.

D) Light-shielding layer

A light-shielding layer containing a light-shielding agent and a hydrophilic binder is disposed between the white reflecting layer and the light-sensitive layer.

As the light-shielding agent, any material having a light-shielding function can be used, however, carbon black is preferably used. Decomposable dyes described in U.S. Pat. No. 4,615,966 may also be used.

As the binder used to coat the light-shielding agent, any binder may be used as far as it can disperse carbon black, and, a gelatin is preferable.

As raw materials of carbon black, those produced by an arbitrary method, such as a channel method, thermal method, and furnace method, as described in, for example, Donnel Voet "Carbon Black" Marcel Dekker, Inc (1976), may be used. Although no particular limitation is imposed on the size of a carbon black particle, those having a particle size of 90 to 1800 angstroms are preferable. The amount of a black pigment to be added as the light-shielding agent may be controlled corresponding to the sensitivity of the light-sensitive material to be shielded, however, the amount is preferably 5 to 10 in terms of optical density.

E) Light-sensitive layer

In the present invention, a light-sensitive layer comprising of a silver halide emulsion layer combined with a dye image-forming compound is disposed above the aforementioned light-shielding layer. Its structural elements will be hereinafter explained.

(1) Dye image-forming compound

Specific examples of the dye image-forming compound are described in the following references.

Examples of a yellow dye:

Those described in U.S. Pat. No. 3,597,200, U.S. Pat. No. 3,309,199, U.S. Pat. No. 4,013,633, U.S. Pat. No. 4,245,028, U.S. Pat. No. 4,156,609, U.S. Pat. No. 4,139,383, U.S. Pat. No. 4,195,992, U.S. Pat. No. 4,148,641, U.S. Pat. No. 4,148,643, U.S. Pat. No. 4,336,322, JP-A-51-114930, JP-A-56-71072, Research Disclosure No. 17630 (1978), and RD No. 16475 (1977).

Examples of a magenta dye:

Those described in U.S. Pat. No. 3,453,107, U.S. Pat. No. 3,544,545, U.S. Pat. No. 3,932,380, U.S. Pat. No. 3,931,144, U.S. Pat. No. 3,932,308, U.S. Pat. No. 3,954,476, U.S. Pat. No. 4,233,237, U.S. Pat. No. 4,255,509, U.S. Pat. No. 4,250,246, U.S. Pat. No. 4,142,891, U.S. Pat. No. 4,207,104, U.S. Pat. No. 4,287,292, JP-A-52-106727, JP-A-53-23628, JP-A-55-36804, JP-A-56-73057, JP-A-56-71060, JP-A-55-134, JP-A-7-120901, JP-A-8-286343, JP-A-8-286344, and JP-A-8-292537.

Examples of a cyan dye:

Those described in U.S. Pat. No. 3,482,972, U.S. Pat. No. 3,929,760, U.S. Pat. No. 4,013,635, U.S. Pat. No. 4,268,625, U.S. Pat. No. 4,171,220, U.S. Pat. No. 4,242,435, U.S. Pat. No. 4,142,891, U.S. Pat. No. 4,195,994, U.S. Pat. No. 4,147,544, U.S. Pat. No. 4,148,642; Great Britain Patent No. 1,551,138; JP-A-54-99431, JP-A-52-8827, JP-A-53-47823, JP-A-53-143323, JP-A-54-99431, JP-A-56-71061; European Patent (EP) No. 53,037, European Patent No. 53,040; Research Disclosure No. 17,630 (1978), and RD No. 16,475 (1977).

Dye image-forming compounds, which form a dye by coupling may be used. For example, these compounds are described in JP-A-8-286340, JP-A-9-152705, and Japanese Patent Applications No. 8-357190, No. 8-357191, No. 9-117529, and the like.

Positive type dye image-forming compounds may also be used. In this case, a negative emulsion may be used as the silver halide emulsion. Examples are described in JP-A-4-156542, JP-A-4-155332, JP-A-4-172344, JP-A-4-172450, JP-A-4-318844, JP-A-356046, JP-A-5-45824, JP-A-5-45825, JP-A-5-53279, JP-A-5-107710, JP-A-5-241302, JP-A-5-107708, JP-A-5-232659, and U.S. Pat. No. 5,192,649.

These compounds can be dispersed by a method described in JP-A-62-215272, pp. 144–146. Also, dispersions of these compounds may contain a compound described in JP-A-62-215272, pp. 137–144. As specific examples of these dye-forming compounds, the following compounds may be given. "Dye" in the following compounds respectively represent a dye group, a dye group that is temporarily short-waved, or a dye precursor group.

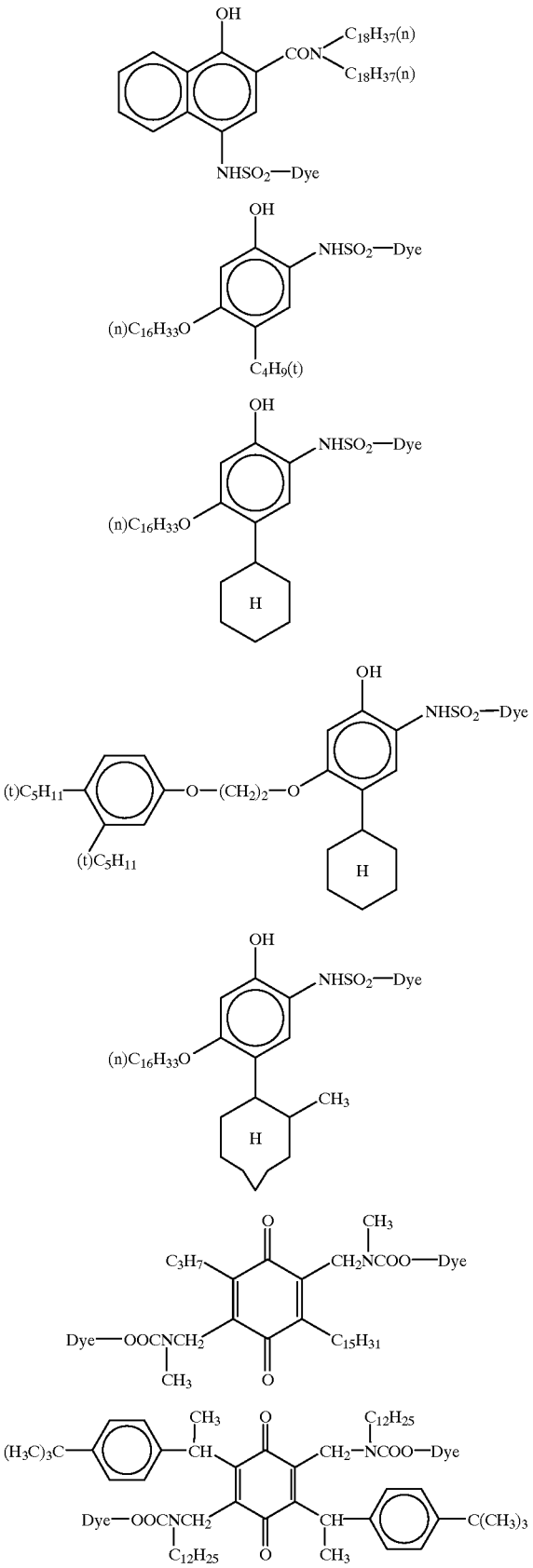

-continued

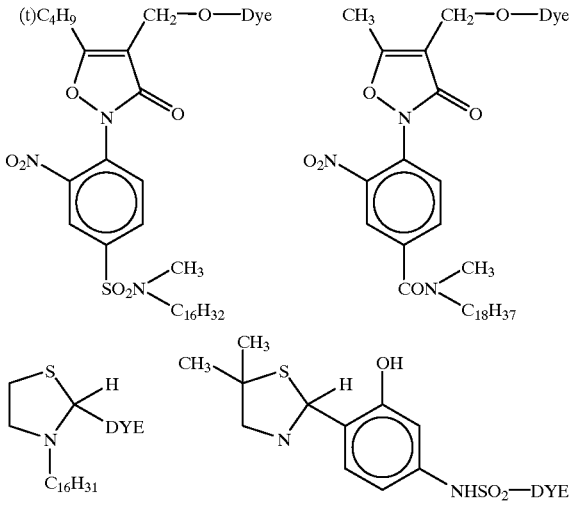

(2) Silver halide emulsion

The silver halide emulsion used in the present invention may be either a negative type emulsion, which forms a latent image mainly on the surface of a silver halide particle, or an internal latent image type direct positive emulsion, which forms a latent image inside of a silver halide particle.

Examples of the internal latent image type direct positive emulsion include a so-called "conversion type" emulsion, which is produced by making use of a difference in the solubility between silver halides, and a "core/shell type" emulsion produced by coating at least the light-sensitive site of an internal core particle of a silver halide with an external shell of a silver halide, wherein the internal core particle is doped with a metal ion, chemically sensitized or provided with the both treatments, and other emulsions. These emulsions are described in U.S. Pat. No. 2,592,250 and No. 3,206,313, U.K. Patent No. 1.027,146, U.S. Pat. No. 3,761,276, No. 3,935,014, No. 3,447,927, No. 2,297,875, No. 2,563,785, No. 3,551,662, No. 4,395,478, West Germany Patent No. 2,728,108, U.S. Pat. No. 4,431,730, and the like.

In the present invention, a spectral sensitizing dye may be used in combination with these negative type and internal latent image type direct positive emulsion. Specific examples of the spectral sensitizing dye are described in JP-A-59-180550, JP-A-60-140335, Research Disclosure (RD) No. 17029, U.S. Pat. No. 1,846,300, U.S. Pat. No. 2,078,233, U.S. Pat. No. 2,089,129, U.S. Pat. No. 2,165,338, U.S. Pat. No. 2,231,658, U.S. Pat. No. 2,917,516, U.S. Pat. No. 3,352,857, U.S. Pat. No. 3,411,916, U.S. Pat. No. 2,295,276, U.S. Pat. No. 2,481,698, U.S. Pat. No. 2,688,545, U.S. Pat. No. 2,921,067, U.S. Pat. No. 3,282,933, U.S. Pat. No. 3,397,060, U.S. Pat. No. 3,660,103, U.S. Pat. No. 3,335,010, U.S. Pat. No. 3,352,680, U.S. Pat. No. 3,384,486, U.S. Pat. No. 3,623,881, U.S. Pat. No. 3,718,470, U.S. Pat. No. 4,025,349, and the like.

(3) Structure of the light-sensitive layer

To reproduce a natural color by a subtractive color process, a light-sensitive layer that comprises at least two combinations of the emulsion, which is spectrally sensitized by the above spectral sensitizing dye, and the aforementioned dye image-forming compound, which donates a dye having selective spectral absorption in the same wavelength range as the emulsion, is used. The emulsion and the dye image-forming compound may be coated such that they are overlapped as separate layers, or may be coated as one layer by mixing them. When the dye image-forming material has absorption in the spectral sensitive range of the emulsion combined therewith, in the condition that the dye image-forming compound is applied, the separate layer system is preferable. Also, the emulsion layer may consist of a plurality of emulsion layers having different sensitivities, and further an optional layer may be formed between the emulsion layer and the dye image-forming compound layer. For example, a layer containing a nucleating development accelerator as described in JP-A-60-173541, or a bulkhead layer as described in JP-B-60-15267, is formed to raise the density of a color image, and also a reflecting layer may be formed to improve the sensitivity of the light-sensitive element.

The reflecting layer is preferably a layer containing a white pigment and a hydrophilic binder. The white pigment is preferably titanium oxide and the hydrophilic binder is preferably a gelatin. The amount of titanium oxide to be applied is generally 0.1 $g/m^2$, to 8 $g/m^2$, and preferably 0.2 $g/m^2$ to 4 $g/m^2$. Examples of the reflecting layer are described in JP-A-60-91354.

In a preferable multilayer structure, a combination unit of a blue-sensitive emulsion, a combination unit of a green-sensitive emulsion, and a combination unit of a red-sensitive emulsion are arranged in order, from the exposure side.

Arbitrary layers may be provided as required between each emulsion layer unit. Particularly, intermediate layers are preferably formed to prevent an undesirable influence of the effect due to the development of a certain emulsion layer, on other emulsion layer unit.

In the present invention, an irradiation preventive layer, a UV-absorbing layer, a protective layer, and the like, are coated according to the need.

F) Peeling layer

In the present invention, a peeling layer may be provided to be peeled apart at a desired place of the light-sensitive sheet in the unit, according to the need after treatment. Therefore, this peeling layer must be easily peeled off after treatment.

As the raw materials of the peeling layer, those described in, for instance, JP-A-47-8237, JP-A-59-220727, JP-A-59-229555, JP-A-49-4653, U.S. Pat. No. 3,220,835 and No. 4,359,518, JP-A-49-4334, JP-A-56-65133, JP-A-45-24075 and U.S. Pat. No. 3,227,550, No. 2,759,825, No. 4,401,746 and No. 4,366,227, and the like may be used. As one specific example of the raw material, water-soluble (or alkali-soluble) cellulose derivatives may be given. Examples of the cellulose derivative include hydroxyethyl cellulose, cellulose acetate phthalate, plasticized methyl cellulose, ethyl cellulose, cellulose nitrate, and carboxymethyl cellulose. Other examples include a variety of natural polymers, for example, alginic acid, pectin, gum arabic, and the like. Also, various modified gelatins, for example, an acetylated gelatin, an phthalated gelatin, and the like may be used. Further, as other examples, water-soluble synthetic polymers can be mentioned. Examples are polyvinyl alcohols, polyacrylates, polymethylmethacrylates, polybutylmethacrylates, or copolymers of these compounds, and the like.

The peeling layer may be a single layer or one made of a plurality of layers as described in JP-A-59-220727, JP-A-60-60642, or the like.

It is desirable that the color diffusion-transfer light-sensitive material in the present invention is provided with a material having a neutralizing function between the support and the light-sensitive layer, or between the support and the image-receiving layer, or on the cover sheet.

G) Support

As a support of the cover sheet used in the present invention, any smooth and transparent support, which is usually used for photographic light-sensitive materials, may be used. As the support, a cellulose acetate, polystyrene, polyethylene terephthalate, polycarbonate, and the like may be used. The support may be preferably provided with an undercoat layer.

The support preferably contains a minute amount of a dye to prevent light piping.

H) Layer having a neutralizing function

The layer having a neutralizing function for use in the present invention is a layer containing an acidic substance in an amount enough to neutralize an alkali delivered from processing compositions, and may be one having a multi-layer structure comprising a neutralizing rate-controlling layer (timing layer), an adhesion-reinforced layer, and the like, according to the need. A preferable acidic substance is a substance that contains an acidic group having a pKa of 9 or less (or a precursor group providing such acidic group by hydrolysis). More preferable acidic substance may include higher fatty acids, such as oleic acid as described in U.S. Pat. No. 2,983,606; and polymers of acrylic acids, methacrylic acids, or maleic acid, and its partial esters or acid anhydrides as disclosed in U.S. Pat. No. 3,362,819; copolymers of an acrylic acid and an acrylate as disclosed in French Patent No. 2,290,699; and latex type acidic polymers as disclosed in U.S. Pat. No. 4,139,383 or Research Disclosure No. 16102 (1977).

Besides the above compounds, acidic substances as disclosed in U.S. Pat. No. 4,088,493, JP-A-52-153739, JP-A-53-1023, JP-A-53-4540, JP-A-53-4541, JP-A-53-4542, and the like may be given as examples.

Specific examples of the acidic polymer include a copolymer of a vinyl monomer, such as, ethylene, vinyl acetate and vinyl methyl ether, with malic acid anhydride and its n-butylester, copolymer of butylacrylate and acrylic acid, cellulose, acetate.hydrogen phthalate, and the like.

The aforementioned polymer acid may be used by mixing with a hydrophilic polymer. Examples of such a polymer include a polyacrylamide, polymethylpyrrolidone, polyvinyl alcohol (including partially saponified products), carboxymethyl cellulose, hydroxymethyl cellulose, hydroxyethyl cellulose, polymethyl vinyl ether, and the like. Among these compounds, polyvinyl alcohol is preferable.

Also, a polymer other than hydrophilic polymers such as cellulose acetate may be mixed with the above polymer acid.

The amount of the polymer acid to be applied is controlled corresponding to the amount of an alkali developed in the light-sensitive element. The equivalent ratio of the polymer acid to the alkali per unit area is preferably 0.9 to 2.0. When the amount of the polymer acid is excessively small, the hue of a transferred dye is changed, and stains are produced on a white background portion; whereas when the amount is excessive, this brings about disadvantages such as a change in the hue and reduced light resistance. A more preferable equivalent ratio is 1.0 to 1.3. The quality of photographs is also lowered if the amount of the hydrophilic polymer is excessively large or small. The mass ratio of the hydrophilic polymer to the polymer acid is generally 0.1 to 10, and preferably 0.3 to 3.0.

Additives may be incorporated in the layer having a neutralizing function according to the present invention, for various purposes. For example, a hardener well-known to a person skilled in the art may be added for the purpose of promoting film hardening of this layer, and a polyvalent hydroxyl compound such as a polyethylene glycol, polypropylene glycol, or glycerol may be added for the purpose of improving the brittleness of the film. In addition, an antioxidant, fluorescent whitening agent, development inhibitor or its precursor, and the like may be added.

As the timing layer to be combined with the neutralizing layer, a polymer that reduces alkali-permeability, such as a gelatin, polyvinyl alcohol, partially acetalized polyvinyl alcohol, cellulose acetate, or partially hydrolyzed polyvinyl acetate; latex polymer, which is produced by the copolymerization with a small amount of a hydrophilic comonomer such as an acrylic acid monomer, and which raises an active energy for the permeation of an alkali; and polymer having a lactone ring are useful.

Among these polymers, cellulose acetates used for a timing layer as disclosed in JP-A-54-136328, and U.S. Pat. No. 4,267,262, No. 4,009,030, No. 4,029,849, and the like; latex polymers, which are produced by the copolymerization of a small amount of a hydrophilic comonomer such as an acrylic acid, as disclosed in JP-A-54-128335, JP-A-56-69629, JP-A-57-6843 and U.S. Pat. No. 4,056,394, No. 4,061,496, No. 4,199,362, No. 4,250,243, No. 4,256,827, No. 4,268,604, and the like; polymers having a lactone ring as disclosed in U.S. Pat. No. 4,229,516; and besides, polymers as disclosed in JP-A-56-25735, JP-A-56-97346, JP-A-57-6842, European Patent (EP) No. 31,957A1, EP No. 37,724A1 and EP No. 48,412A1, and the like are particularly useful.

In addition to the above, those described in the following references may also be used.

U.S. Pat. No. 3,421,893, U.S. Pat. No. 3,455,686, U.S. Pat. No. 3,575,701, U.S. Pat. No. 3,778,265, U.S. Pat. No. 3,785,815, U.S. Pat. No. 3,847,615, U.S. Pat. No. 4,088,493, U.S. Pat. No. 4,123,275, U.S. Pat. No. 4,148,653, U.S. Pat. No. 4,201,587, U.S. Pat. No. 4,288,523, U.S. Pat. No. 4,297,431, West Germany Patent Application (OLS) No. 1,622,936, Ibid. 2,162,277, Research Disclosure 15162, No. 151 (1976).

As the timing layer using these raw materials, a single layer or combinations of two or more layers may be used.

To the timing layer made of each of these raw materials, a development inhibitor and/or its precursor as disclosed in, for example, U.S. Pat. No. 4,009,029, West Germany Patent (OLS) No. 2,913,164, OLS No. 3,014,672, JP-A-54-155837, JP-A-55-138745 and the like, and further, a hydroquinone precursor as disclosed in U.S. Pat. No. 4,201,578, and other useful photographic additives or their precursors may be incorporated.

Moreover, as the layer having a neutralizing function, to provide an auxiliary neutralizing layer as described in JP-A-63-168648 and JP-A-63-168649 has an effect in view of reducing a change of transferred density due to aging after processing.

I) Others

Other than the layer having a neutralizing function, a back layer, protective layer, filter dye layer, and the like, may be provided as layers having auxiliary functions.

The back layer is provided to control curling, and to impart lubricity. The filter dye may be added to the back layer.

The protective layer is used primarily to prevent adhesion to the backface of the cover sheet, specifically to prevent the adhesion of the cover sheet to the protective layer of the light-sensitive material when the light-sensitive material and the cover sheet are overlapped on each other.

The cover sheet is allowed to contain a dye to control the sensitivity of the light-sensitive layer. The filter dye may be added directly to the inside of a support of the cover sheet, or to the layer having a neutralizing function, and further, to the aforementioned back layer, protective layer, or capture mordant layer. Alternatively, a single layer containing the filter dye may be formed.

II. Alkali processing composition

The processing composition used in the present invention is a composition, which is developed (permeated) uniformly on the light-sensitive element after the light-sensitive element is exposed, and is disposed on the backface of the support or on the side opposite to the processing solution of the light-sensitive layer forming a pair with the light-shielding layer to shield the light-sensitive layer completely from external light, and at the same time, the processing composition serves to develop the light-sensitive layer with the components contained therein. For this, the composition contains an alkali, a viscosity-enhancing agent, a light-shielding agent, a developing agent, further a development accelerator and development inhibitor for controlling development, an antioxidant for preventing the deterioration of a developing agent, and the like. A light-shielding agent is always contained in the composition for light-shielding.

The alkali is those sufficient to make the pH in a range from 12 to 14. Examples of the alkali include hydroxides of alkali metals (e.g., sodium hydroxide, potassium hydroxide, and lithium hydroxide), phosphates of alkali metals (e.g., potassium phosphate), guanidines and hydroxides of quaternary amines (e.g., tetramethylammonium hydroxide). Among these compounds, potassium hydroxide and sodium hydroxide are preferable.

The viscosity-enhancing agent is required to develop the processing solution uniformly, and to maintain the adhesion between the light-sensitive layer and the cover sheet. For example, as the viscosity-enhancing agent, an alkali metal salt of polyvinyl alcohol, hydroxyethyl cellulose or carboxymethyl cellulose, is used and preferably hydroxyethyl cellulose or sodium carboxymethyl cellulose is used.

As the light-shielding agent, any one of a dye and a pigment or a combination thereof may be used insofar as it does not diffuse into the dye image-receiving layer to produce stains. As typical examples of the light-shielding agent, carbon black can be mentioned.

As a preferable developing agent, any one of those which cross-oxidize dye image-forming substances and produce substantially no stains even if it is oxidized, may be used. These developing agents may be used either singly or in combinations of two or more, and they can be used in the form of precursors. These developing agents may be contained in a proper layer of the light-sensitive sheet, or in an alkaline processing solution. As specific examples, aminophenols and pyrazolidinones can be given. Among these compounds, pyrazolidinones are preferable because of decreased occurrence of stains.

Given as examples of these pyrazolidinones are 1-phenyl-3-pyrazolidinone, 1-p-tolyl-4,4-dihydroxymethyl-3-pyrazolidinone, 1-(3'-methyl-phenyl)-4-methyl-4-hydroxymethyl-3-pyrazolidinone, 1-phenyl-4-methyl-4-hydroxymethyl-3-pyrazolidinone, 1-p-tolyl-4-methyl-4-hydroxymethyl-3-pyrazolidinone, and the like.

Any one of the light-sensitive sheet, the cover sheet, and the alkali processing composition may contain a development accelerator described on pp. 72–91, a hardener described on pp. 146–155, a surfactant described on pp. 201–210, a fluorine-containing compound described on pp. 210–222, a viscosity-enhancing agent on pp. 225–227, an antistatic agent described on pp. 227–230, a polymer latex described on pp. 230–239, a matte agent described on page 240, and the like, in JP-A-62-215272. Also, it may contain a tertiary amine latex as described in JP-A-6-273907, JP-A-7-134386, JP-A-7-175193 or JP-A-7-287372.

Also, the alkali solution composition is preferably developed on the light-sensitive element, in a development thickness (the amount of the processing solution per $m^2$, after the processing solution is transferred) of 20 to 200 $\mu$m.

Further, processing temperature in the case of processing the light-sensitive material is preferably 0 to 50° C., and more preferably 0 to 40° C.

The details of the heat-developable color light-sensitive material (dye-fixing element) using the dye image-forming compound in the present invention, and an exposure and heating method, and the device are described in, for example, the publication of JP-A-7-219180, Paragraphs [0128] to [0159].

According to the present invention, a color diffusion-transfer light-sensitive material and a color diffusion-transfer film unit, which are reduced in the time required for an image to emerge, and in the time required to complete an image, have a high maximum image density, and are superior in storage stability are obtained.

The present invention will be explained in detail by way of examples, which are not intended to be limiting of the present invention.

EXAMPLES

Example 1

First, a method of the preparation of a silver halide emulsion will be explained.

The following 8 types of silver halide emulsion particles (Emulsion-A to Emulsion-F), and Emulsions T and U were prepared according to the preparation method of emulsion particles shown below. Preparation of emulsion-A (octahedral internal latent image type direct positive emulsion):

300 ml of an aqueous 0.4 M silver nitrate solution and an aqueous 0.4 M potassium bromide solution were added to 1000 ml of an aqueous gelatin solution that contaied 0.05 M potassium bromide, 1 g of 3,6-dithia-1,8-octane diol, 0.034 mg of lead acetate and 60 g of a deionized gelatin containing 100 ppm or less of Ca, by a control double jet method over 40 minutes, while the temperature was kept at 75° C., and the rate of addition of the aqueous potassium bromide solution was controlled such that the pBr was kept at 1.60.

When the addition was completed, octahedral silver bromide crystals (hereinafter called core particles) having even particle sizes with an average particle diameter (sphere equivalent diameter) of about 0.7 $\mu$m were produced.

Next, chemical sensitization of the core was carried out in the following condition.

1. Tank: having a hemispherical bottom, whose metal surface was Teflon-coated with a fluororesin material FEP developed by Du Pont K.K. in a thickness of 120 $\mu$m.

2. Stirring blade: a seamless integrated propeller type, whose metal surface was Teflon-coated.

3 ml of an aqueous solution obtained by dissolving 1 mg of sodium thiosulfate, 90 mg of potassium tetrachloroauric acid and 1.2 g of potassium bromide in 1000 ml of water, was added to a preparative solution of Emulsion-A, followed by heating at 75° C. for 80 minutes to perform chemical sensitization treatment. 0.15 M potassium bromide was added to the emulsion solution, which had been subjected to chemical sensitization in this manner. After the addition, to the solution were added 670 ml of an aqueous 0.9 M silver nitrate solution, and an aqueous 0.9 M potassium bromide solution by a control double jet method, over 70 minutes, while the temperature was kept at 75° C., and the rate of addition of the aqueous potassium bromide solution was controlled such that the pBr was kept at 1.30, in the same manner as in the preparation of the core particles.

The resulted emulsion was washed with water by a usual flocculation method, and the aforementioned gelatin, and 2-phenoxyethanol and methyl p-hydroxybenzoate were added to obtain octahedral silver bromide crystals (hereinafter called internal latent image type core/shell particles) having even particle sizes with an average particle diameter (sphere equivalent diameter) of about 1.2 μm.

Next, 3 ml of an aqueous solution obtained by dissolving 100 mg of sodium thiosulfate and 40 mg of sodium tetraborate to 1000 ml of water, was added, and further 14 mg of poly(N-vinylpyrrolidone) was added, to the internal latent image type core/shell particles, followed by ripening under heat at 60° C. Then, 0.005 M potassium bromide was added to the mixture to prepare an octahedral internal latent image type direct positive emulsion.

Preparation of Emulsion-B to Emulsion-F (octahedral internal latent image type direct positive emulsions):

In the preparation method of the aforementioned Emulsion-A, the addition time of the aqueous silver nitrate solution and the aqueous potassium bromide solution was altered, and further the amounts of the chemicals added were altered, to obtain octahedral internal latent image type direct positive silver halide emulsions having even particle sizes with an average particle diameter (sphere equivalent diameter) shown in Table 1.

TABLE 1

| Name of emulsion | Average particle diameter μm |
|---|---|
| B | 0.93 |
| C | 1.20 |
| D | 0.94 |
| E | 0.74 |
| F | 0.66 |

Preparation of Emulsion-T (hexagonal tabular internal latent image type direct positive emulsion):

To 1.2 litter of an aqueous gelatin solution that contained 0.05 M potassium bromide and 0.7 mass % of a gelatin having an average molecular weight of 100,000 or less, were added 33 ml of each of an aqueous 1.4 M silver nitrate solution containing the above gelatin, and an aqueous 2 M potassium bromide solution, at the same time, with vigorous stirring, by a double jet method in one minute. During this time, the aqueous gelatin solution was kept at 30° C. Further, 300 ml of a gelatin aqueous solution that contained 10 mass % of a deionized gelatin containing 100 ppm or less of Ca, was added to the solution, and then the temperature of the gelatin solution was raised to 75° C.

Next, 40 ml of an aqueous 0.9 M silver nitrate solution was added over 3 minutes, and then 25 mass % of an aqueous ammonia solution was added, to the gelatin solution, followed by performing ripening at 75° C. After the ripening was finished, ammonia was neutralized. Then, 5 mg of lead acetate (added as an aqueous solution) was added, and then an aqueous 1 M silver nitrate solution and an aqueous 1 M potassium bromide solution were added at an accelerated flow rate (the final flow rate was 6 times the start flow rate) by a double jet method, while the pBr was kept at 2.5 (the amount of the aqueous silver nitrate solution used was 500 ml).

The particles (hereinafter called core particles) formed in this manner, were washed with water by a usual flocculation method, and a gelatin, 2-phenoxyethanol and methyl p-hydroxybenzoate were added to the particles to obtain 750 g of a hexagonal tabular core particles.

The resulting hexagonal tabular core particles had the characteristics that the average projection area circle equivalent diameter was 0.9 μm, the average thickness was 0.20 μm, and 95% of the whole projection area was occupied by the hexagonal tabular particles.

Next, chemical sensitization of the core was carried out in the following condition.

1. Tank: having a hemispherical bottom, the surface of a metal being Teflon-coated with a fluororesin material FEP developed by Du Pont in a thickness of 120 μm.

2. Stirring blade: a seamless integrated propeller type, the surface of a metal being Teflon-coated.

1300 ml of water, 0.11 M potassium bromide and 40 g of a deionized gelatin were added to 200 g of the aforementioned hexagonal tabular core emulsion, and the temperature of the emulsion was raised to 75° C. Then, 2.4 ml of an aqueous solution obtained by dissolving 0.3 g of 3,6-dithia-1,8-octane diol, 10 mg of sodium benzene thiosulfate, 90 mg of potassium tetrachloroauric acid, and 1.2 g of potassium bromide in 1000 ml of water, and 15 mg of lead acetate (added as an aqueous solution) were added to the emulsion, followed by heating at 75° C for 180 minutes to perform chemical sensitization treatment. To the core particles, which had been subjected to chemical sensitization in this manner, were added a 2 M aqueous silver nitrate solution and a 2.5 M aqueous potassium bromide solution, at an accelerated flow rate (the final flow rate was 3 times the start flow rate), by a double jet method, while controlling the addition rate of the potassium bromide aqueous solution to maintain the pBr at 2.2 (the amount of the aqueous silver nitrate solution used was 810 ml), in the same manner as in the preparation of the core particles.

After 0.3 M potassium bromide was added, the emulsion was washed with water by a usual flocculation method, and a gelatin was added. A hexagonal tabular internal latent image type core/shell emulsion was thus prepared. The resulting hexagonal tabular particle had the average projection area circle equivalent diameter of 2.0 μm, the average thickness of 0.38 μm, the average volumetric size of 1.3 $(\mu m)^3$, and 88% of the whole projection area was occupied by the hexagonal tabular particles.

Next, 15 ml of an aqueous solution obtained by dissolving 100 mg of sodium thiosulfate and 40 mg of sodium tetraborate to 1000 ml of water, was added to the hexagonal tabular internal latent image type core/shell emulsion, and further 20 mg of poly(N-vinylpyrrolidone) was added, followed by heating at 70° C. for 100 minutes to perform chemical sensitization of the surface of the particles, thereby preparing a hexagonal tabular internal latent image type direct positive emulsion. Preparation of Emulsion-U (hexagonal tabular internal latent image type direct positive emulsion):

When the outer shell of Emulsion-T was formed, the shell was impregnated uniformly with 0.15 mol % of iodine, and further the amount of the external shell was increased, to thereby prepare a hexagonal tabular internal latent image type core/shell particles, which had the average projection area circle equivalent diameter of 2.5 μm, the average particle thickness of 0.45 μm, the average volumetric size of 1.7 $(\mu m)^3$, and 88% of the whole projection area being occupied by the hexagonal tabular particles.

Next, when the shell chemical sensitization of the hexagonal tabular internal latent image type core/shell emulsion was started, a AgI fine particle emulsion-X was added to the emulsion in an amount corresponding to 0.04 mol % of the amount of silver required to form the particles, and thereafter the same shell chemical sensitization as in the case of Emulsion-T was performed to prepare a hexagonal tabular internal latent image type direct positive emulsion.

Preparation of Emulsion-X (AgI fine particle emulsion)

80 ml of an aqueous silver nitrate solution containing 40 g of silver nitrate, and 80 ml of an aqueous solution containing 39 g of potassium iodide, were added with stirring, over 5 minutes, to a solution, which contained 0.5 g of potassium iodide and 26 g of a gelatin in water and was kept at 35° C. At this time, the flow rate of addition of each of the aqueous silver nitrate solution and the aqueous potassium iodide solution, was 8 ml/min at the start of the addition, and was linearly accelerated such that the addition of 80 ml was finished in 5 minutes.

The formation of a particle was thus completed, and then the soluble salts were removed at 35° C. by a precipitation method. Next, the temperature of the solution was raised to 40° C., 10.5 g of a gelatin and 2.56 g of phenoxyethanol were added to the solution, and the pH of the solution was adjusted to 6.8. The resulting emulsion was 730 g as finished amount, and was a monodispersed AgI fine particle having an average diameter of 0.015 μm.

Emulsions A to F, T and U were used in the following manner to produce comparative light-sensitive element (Sample 101) having the structure shown in Table 2 below. In this case, sensitizing dyes were added when the shell chemical sensitization was finished: the type of dye and the dispersion state, addition temperature, and amount of the dye were shown in Table 3.

TABLE 2

Configuration of comparative light-sensitive element 101

| Layer number | Name of layer | Additive | Coated amount (g/m²) |
|---|---|---|---|
| 22nd layer | Protective layer | Matting agent (1) | 0.15 |
| | | Gelatin | 0.25 |
| | | Surfactant (1) | $5.3 \times 10^{-3}$ |
| | | Surfactant (2) | $4.1 \times 10^{-3}$ |
| | | Surfactant (3) | $3.9 \times 10^{-3}$ |
| | | Additive (1) | $8.0 \times 10^{-3}$ |
| | | Additive (5) | 0.009 |
| 21st layer | Ultraviolet absorbing layer | Ultraviolet absorber (1) | 0.09 |
| | | Ultraviolet absorber (2) | 0.05 |
| | | Ultraviolet absorber (3) | 0.01 |
| | | Surfactant (3) | 0.013 |
| | | Surfactant (4) | 0.019 |
| | | Additive (1) | $8.0 \times 10^{-3}$ |
| | | Additive (5) | 0.023 |
| | | Hardener (1) | 0.050 |
| | | Hardener (2) | 0.017 |
| | | Gelatin | 0.52 |
| 20th layer | Blue light-sensitive layer (high sensitivity) | Internal latent image-type direct positive emulsion: U | in terms of silver 0.38 |
| | | Nucleating agent (1) | $2.9 \times 10^{-6}$ |
| | | Additive (2) | 0.019 |
| | | Additive (19) | 0.0076 |
| | | Additive (3) | $4.0 \times 10^{-3}$ |

TABLE 2-continued

Configuration of comparative light-sensitive element 101

| Layer number | Name of layer | Additive | Coated amount (g/m²) |
|---|---|---|---|
| | | Additive (4) | 0.013 |
| | | Additive (5) | $3.8 \times 10^{-3}$ |
| | | Additive (1) | $9.0 \times 10^{-3}$ |
| | | Surfactant (5) | $9.0 \times 10^{-3}$ |
| | | Gelatin | 0.42 |
| 19th layer | Blue light-sensitive layer (low sensitivity) | Internal latent image-type direct positive emulsion: A | in terms of silver 0.07 |
| | | Internal latent image-type direct positive emulsion: B | in terms of silver 0.10 |
| | | Nucleating agent (1) | $2.5 \times 10^{-6}$ |
| | | Additive (3) | 0.022 |
| | | Additive (5) | $9.0 \times 10^{-3}$ |
| | | Additive (1) | 0.013 |
| | | Surfactant (5) | $9.0 \times 10^{-3}$ |
| | | Gelatin | 0.35 |
| 18th layer | White reflective layer | Titanium dioxide | 0.30 |
| | | Additive (1) | $9.0 \times 10^{-3}$ |
| | | Surfactant (1) | $7.2 \times 10^{-5}$ |
| | | Additive (5) | 0.011 |
| | | Additive (8) | $2.8 \times 10^{-3}$ |
| | | Gelatin | 0.37 |
| 17th layer | Yellow color material layer | Yellow dye-releasing compound (1) | 0.62 |
| | | High-boiling organic solvent (1) | 0.27 |
| | | Additive (6) | 0.18 |
| | | Additive (7) | 0.09 |
| | | Surfactant (4) | 0.062 |
| | | Surfactant (5) | 0.030 |
| | | Additive (9) | 0.031 |
| | | Additive (1) | $6.0 \times 10^{-3}$ |
| | | Gelatin | 0.87 |
| 16th layer | Interlayer | Additive (10) | 0.013 |
| | | Surfactant (1) | $4.0 \times 10^{-4}$ |
| | | Additive (1) | $7.0 \times 10^{-3}$ |
| | | Gelatin | 0.42 |
| 15th layer | Color mixing prevention layer | Hydroquinone (A) | 1.13 |
| | | Polymethyl methacrylate | 1.22 |
| | | Surfactant (5) | 0.045 |
| | | Additive (1) | $3.8 \times 10^{-3}$ |
| | | Additive (12) | 0.61 |
| | | Gelatin | 1.22 |
| 14th layer | Green light-sensitive layer (high sensitivity) | Internal latent image-type direct positive emulsion: T | in terms of silver 0.69 |
| | | Nucleating agent (1) | $2.2 \times 10^{-6}$ |
| | | Additive (2) | 0.043 |
| | | Additive (19) | 0.017 |
| | | Additive (3) | 0.12 |
| | | Additive (5) | 0.014 |
| | | Additive (1) | $3.0 \times 10^{-3}$ |
| | | High-boiling organic solvent (2) | 0.07 |
| | | Surfactant (5) | 0.06 |
| | | Gelatin | 0.97 |
| 13th layer | Green light-sensitive layer (low sensitivity) | Internal latent image-type direct positive emulsion: C | in terms of silver 0.11 |
| | | Internal latent image-type direct positive emulsion: D | in terms of silver 0.08 |
| | | Nucleating agent (1) | $2.7 \times 10^{-6}$ |
| | | Additive (3) | 0.011 |
| | | Additive (4) | 0.033 |
| | | Additive (5) | $1.5 \times 10^{-3}$ |
| | | Additive (1) | 0.010 |
| | | Surfactant (5) | 0.024 |
| | | Gelatin | 0.26 |
| 12th layer | Interlayer | Additive (1) | 0.014 |
| | | Surfactant (1) | 0.038 |
| | | Surfactant (3) | $4.0 \times 10^{-3}$ |
| | | Additive (5) | 0.014 |
| | | Gelatin | 0.33 |
| 11th layer | Magenta color material layer | Magenta dye-releasing compound (1) | 0.56 |
| | | High-boiling organic solvent | 0.18 |
| | | Additive (13) | $9.3 \times 10^{-4}$ |
| | | Additive (5) | 0.02 |
| | | Surfactant (4) | 0.04 |
| | | Additive (14) | 0.02 |

TABLE 2-continued

Configuration of comparative light-sensitive element 101

| Layer number | Name of layer | Additive | Coated amount ($g/m^2$) |
|---|---|---|---|
| | | Additive | $7.0 \times 10^{-3}$ |
| | | Gelatin | 0.45 |
| 10th layer | Interlayer | Additive (10) | 0.014 |
| | | Surfactant (1) | $3.0 \times 10^{-4}$ |
| | | Additive (1) | $9.0 \times 10^{-3}$ |
| | | Gelatin | 0.36 |
| 9th layer | Color mixing prevention layer | Hydroquinone (A) | 0.90 |
| | | Polymethylmethacrylate | 0.97 |
| | | Surfactant (5) | 0.038 |
| | | Additive (1) | $2.0 \times 10^{-3}$ |
| | | Additive (12) | 0.49 |
| | | Gelatin | 0.97 |
| 8th layer | Red light-sensitive layer (high sensitivity) | Internal latent image-type direct positive emulsion: T | in terms of silver 0.33 |
| | | Nucleating agent (1) | $6.1 \times 10^{-6}$ |
| | | Additive (2) | 0.033 |
| | | Additive (19) | 0.013 |
| | | Additive (3) | 0.04 |
| | | Additive (5) | 0.01 |
| | | Additive (1) | $1.0 \times 10^{-3}$ |
| | | High-boiling organic solvent (2) | 0.04 |
| | | Surfactant (5) | 0.02 |
| | | Gelatin | 0.33 |
| 7th layer | Red light-sensitive layer (low sensitivity) | Internal latent image-type direct positive emulsion: E | in terms of silver 0.10 |
| | | Internal latent image-type direct positive emulsion: F | in terms of silver 0.11 |
| | | Nucleating agent (1) | $2.5 \times 10^{-5}$ |
| | | Additive (3) | 0.047 |
| | | Additive (5) | 0.016 |
| | | Additive (1) | $8.0 \times 10^{-3}$ |
| | | Surfactant (5) | 0.02 |
| | | Gelatin | 0.57 |
| 6th layer | White reflective layer | Titanium dioxide | 1.87 |
| | | Additive (1) | $7.0 \times 10^{-3}$ |
| | | Surfactant (1) | $4.0 \times 10^{-4}$ |
| | | Additive (5) | 0.02 |
| | | Additive (8) | 0.015 |
| | | Gelatin | 0.73 |
| 5th layer | Cyan color material layer | Cyan dye-releasing compound (1) | 0.25 |
| | | Cyan dye-releasing compound (2) | 0.14 |
| | | High-boiling organic solvent (1) | 0.05 |
| | | Additive (3) | 0.06 |
| | | Additive (5) | 0.01 |
| | | Surfactant (4) | 0.05 |
| | | Additive (9) | 0.05 |
| | | Additive (1) | $4.0 \times 10^{-3}$ |

TABLE 2-continued

Configuration of comparative light-sensitive element 101

| Layer number | Name of layer | Additive | Coated amount ($g/m^2$) |
|---|---|---|---|
| | | Hardener (3) | 0.014 |
| | | Gelatin | 0.40 |
| 4th layer | Light-shielding layer | Carbon black | 1.50 |
| | | Surfactant (1) | 0.08 |
| | | Additive (1) | 0.06 |
| | | Additive (5) | 0.06 |
| | | Additive (14) | 0.15 |
| | | Gelatin | 1.43 |
| 3rd layer | Interlayer | Surfactant (1) | $6.0 \times 10^{-4}$ |
| | | Additive (1) | $9.0 \times 10^{-3}$ |
| | | Additive (5) | 0.013 |
| | | Gelatin | 0.29 |
| 2nd layer | White reflective layer | Titanium dioxide | 19.8 |
| | | Additive (15) | 0.378 |
| | | Additive (16) | 0.094 |
| | | Surfactant (6) | 0.019 |
| | | Additive (8) | 0.16 |
| | | Hardener (1) | 0.02 |
| | | Hardener (2) | 0.007 |
| | | Gelatin | 2.45 |
| 1st layer | Image-receiving layer | Polymer mordant (1) | 2.22 |
| | | Additive (17) | 0.26 |
| | | Surfactant (7) | 0.04 |
| | | Additive (5) | 0.11 |
| | | Hardener (1) | 0.03 |
| | | Hardener (2) | 0.01 |
| | | Gelatin | 3.25 |
| Support (polyethylene terephthalate containing titanium dioxide for preventing light piping, and provided with an undercoat, 90 $\mu$m) | | | |
| Backing layer | Curling control layer | Ultraviolet absorber (4) | 0.40 |
| | | Ultraviolet absorber (5) | 0.10 |
| | | Diacetyl cellulose (Acetylation degree: 51%) | 4.20 |
| | | Additive (18) | 0.25 |
| | | Barium stearate | 0.11 |
| | | Hardener (4) | 0.50 |

TABLE 3

Sensitizing dye content per 1 kg-emulsion

| Layer No. | Emulsion name | Kind of sensitizing dye | Dispersion state of dye | Temperature at addition | Amount of dye (g)/1 kg-emulsion |
|---|---|---|---|---|---|
| 20 | U | (9) | Aqueous solution | 70° C. | $9.38 \times 10^{-2}$ |
| | | (8) | Aqueous solution | | $1.19 \times 10^{-1}$ |
| 19 | A | (9) | Aqueous solution | 60° C. | $6.50 \times 10^{-2}$ |
| | | (8) | Aqueous solution | | $1.47 \times 10^{-1}$ |
| 19 | B | (9) | Aqueous solution | 60° C. | $7.31 \times 10^{-2}$ |
| | | (8) | Aqueous solution | | $1.66 \times 10^{-1}$ |
| 14 | T | (7) | Gelatin dispersion | 60° C. | $1.18 \times 10^{-1}$ |
| | | (4) | Gelatin dispersion | | $2.94 \times 10^{-3}$ |
| | | (6) | Water/organic solvent | | $9.23 \times 10^{-2}$ |

TABLE 3-continued

| | | | | | |
|---|---|---|---|---|---|
| | | | dispersion by using a surfactant | | |
| 13 | C | (7) | Gelatin dispersion | 40° C. | $6.49 \times 10^{-2}$ |
| | | (4) | Gelatin dispersion | | $1.62 \times 10^{-3}$ |
| | | (6) | Water/organic solvent dispersion by using a surfactant | | $4.85 \times 10^{-2}$ |
| 13 | D | (7) | Gelatin dispersion | 40° C. | $7.34 \times 10^{-2}$ |
| | | (4) | Gelatin dispersion | | $1.83 \times 10^{-3}$ |
| | | (6) | Water/organic solvent dispersion by using a surfactant | | $5.69 \times 10^{-2}$ |
| 8 | T | (5) | Aqueous solution | 60° C. | $3.10 \times 10^{-2}$ |
| | | (4) | Gelatin dispersion | | $2.26 \times 10^{-2}$ |
| | | (3) | Gelatin dispersion | | $2.26 \times 10^{-2}$ |
| | | (2) | Gelatin dispersion | | $2.79 \times 10^{-3}$ |
| | | (1) | Gelatin dispersion | | $9.20 \times 10^{-2}$ |
| 7 | E | (5) | Aqueous solution | 60° C. | $1.63 \times 10^{-2}$ |
| | | (4) | Gelatin dispersion | | $1.34 \times 10^{-2}$ |
| | | (3) | Gelatin dispersion | | $1.34 \times 10^{-2}$ |
| | | (2) | Gelatin dispersion | | $1.91 \times 10^{-3}$ |
| | | (1) | Gelatin dispersion | | $6.32 \times 10^{-2}$ |
| 7 | F | (5) | Aqueous solution | 50° C. | $1.17 \times 10^{-2}$ |
| | | (4) | Gelatin dispersion | | $8.90 \times 10^{-3}$ |
| | | (3) | Gelatin dispersion | | $8.90 \times 10^{-3}$ |
| | | (2) | Gelatin dispersion | | $1.32 \times 10^{-3}$ |
| | | (1) | Gelatin dispersion | | $4.37 \times 10^{-2}$ |

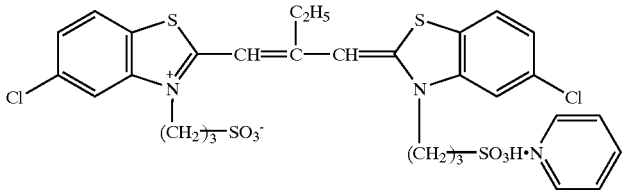

Molecular weight: 728.77
Molecular formula: $C_{25}H_{26}Cl_2N_2O_6S_4 \cdot C_5H_5N_1$
Sensitizing dye (1)

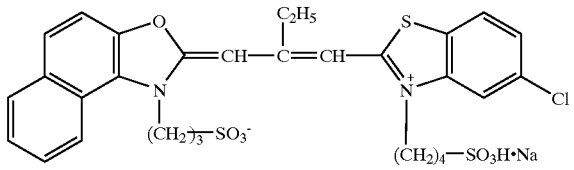

Molecular weight: 686.24
Molecular formula: $C_{30}H_{31}Cl_1N_2O_7S_3 \cdot NA_1$
Sensitizing dye (3)

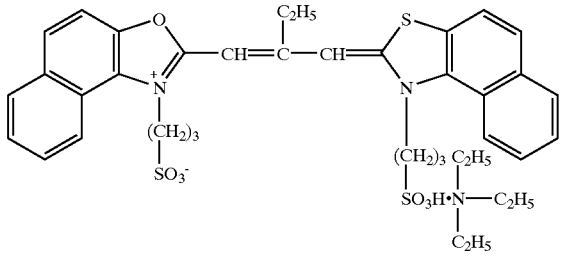

Molecular weight: 782.09
Molecular formula: $C_{33}H_{32}N_2O_6S_4 \cdot C_6H_{16}N_1$
Sensitizing dye (2)

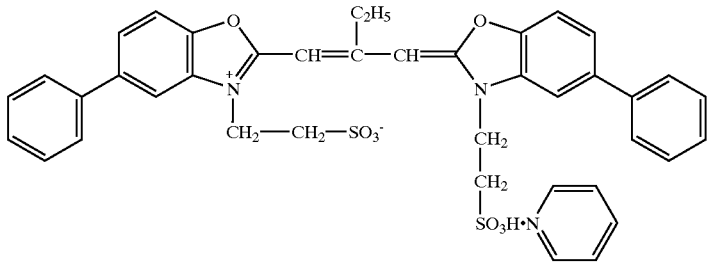

Molecular weight: 751.89
Molecular formula: $C_{35}H_{32}N_2O_8S_2 \cdot C_6H_5N_1$
Sensitizing dye (7)

TABLE 3-continued

| | |
|---|---|
| 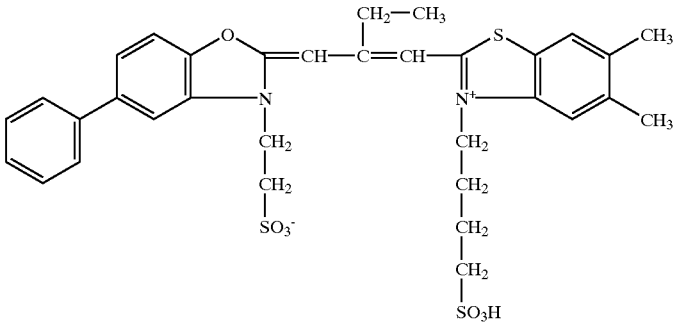 | Molecular weight: 707.96<br>Molecular formula: $C_{33}H_{36}N_2O_7S_3.K_1$<br>Sensitizing dye (4) |
| 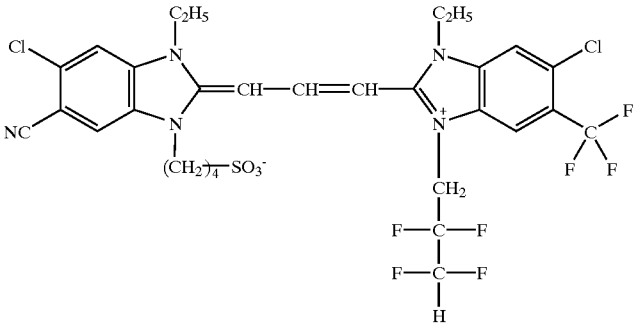 | Molecular weight: 742.57<br>Molecular formula: $C_{30}H_{25}Cl_2F_7N_6O_3S_1$<br>Sensitizing dye (6) |
| 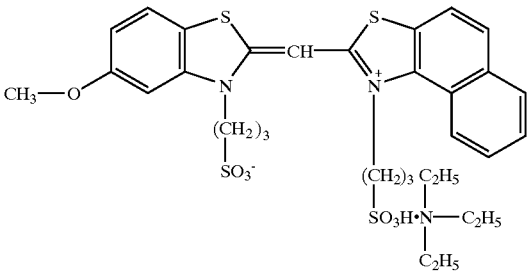 | Molecular weight: 707.96<br>Molecular formula: $C_{26}H_{26}N_2O_7S_4.$<br>$C_6H_5N_1$<br>Sensitizing dye (9) |
| 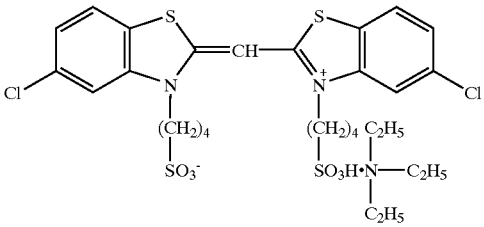 | Molecular weight: 724.83<br>Molecular formula: $C_{23}H_{24}Cl_2N_2O_6S_4.$<br>$C_6H_{15}N_1$<br>Sensitizing dye (5) |
| 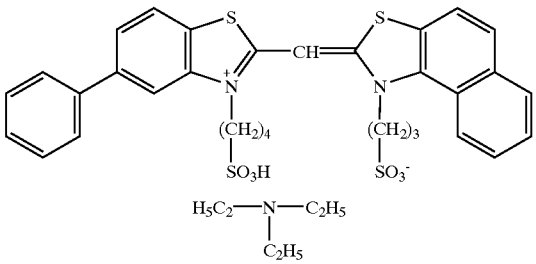 | Molecular weight: 752.00<br>Molecular formula: $C_{32}H_{30}N_2O_7S_2.$<br>$C_6H_{15}N_1$<br>Sensitizing dye (8) |

TABLE 3-continued
Yellow dye-releasing Compound (1)
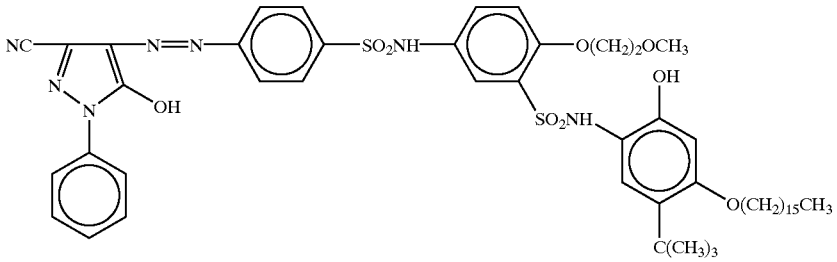
Magenta dye-releasing Compound (1)
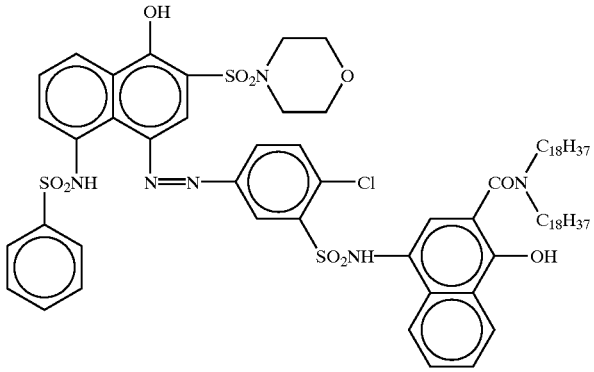
Cyan dye-releasing Compound (1)
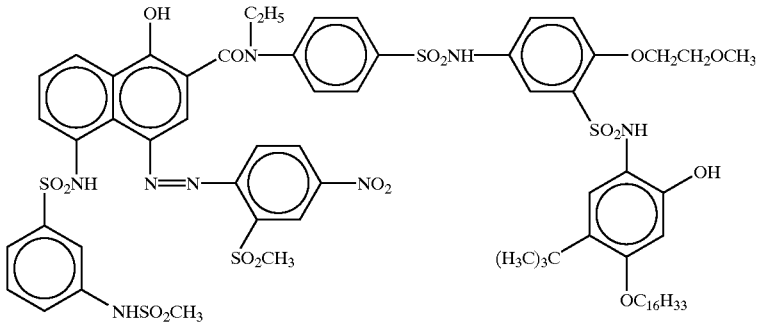
Cyan dye-releasing Compound (2)
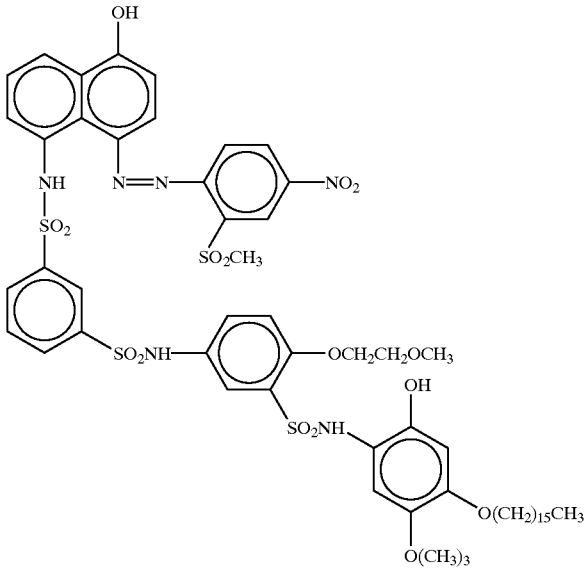

TABLE 3-continued
| | |
|---|---|
| Additive (1) | 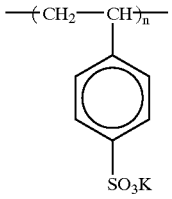 |
| Additive (2) | 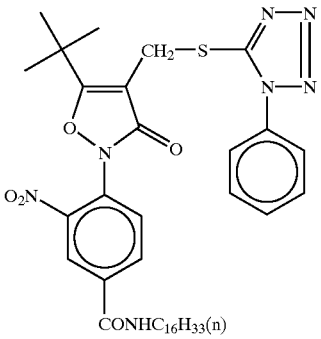 |
| Additive (3) | 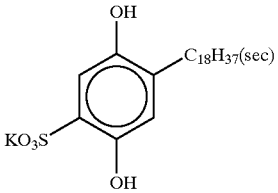 |
| Additive (4) | 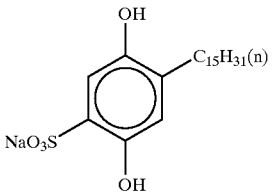 |
| Additive (5) | 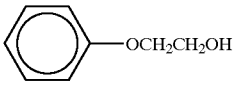 |
| Additive (6) | 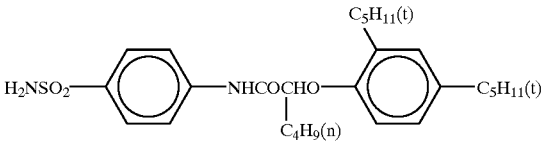 |
| Additive (7) | 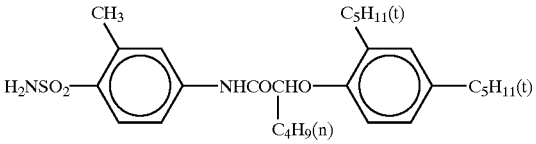 |
| Additive (8) | Carboxymethyl cellulose (CMC cellogen 6A (trade name), manufactured by Dai-ichi Kogyo Seiyaku Co., Ltd.) |
| Additive (9) | Polyvinyl alcohol (PVA-220E) Polymerization degree: about 2000, Saponification degree: 88% |

TABLE 3-continued
Additive (10)
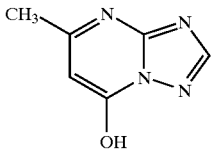
Additive (12)
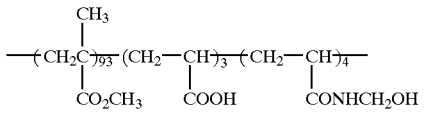
Additive (13)
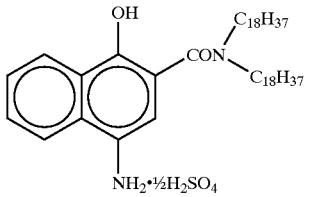
Additive (14)
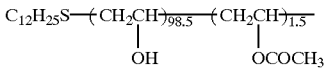
Additive (15)
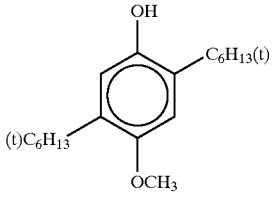
Additive (16)
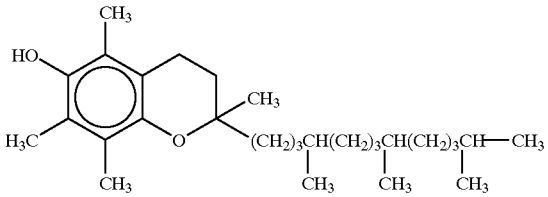
Additive (17)
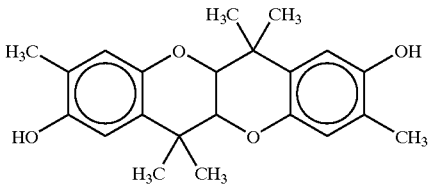
Additive (18)
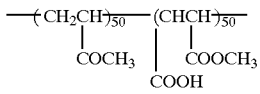

TABLE 3-continued
| | |
|---|---|
| Additive (19) | 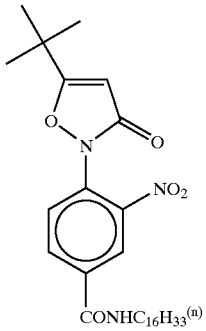 |
| Matte Agent (1) | Polymethylmethacrylate spherical latex (average particle diameter 3 $\mu$m) |
| Surfactant (1) | 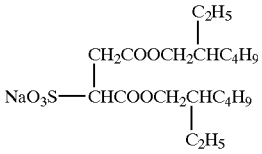 |
| Surfactant (2) | 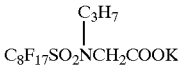 |
| Surfactant (3) | 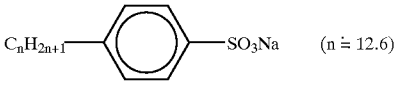 (n ≒ 12.6) |
| Surfactant (4) | 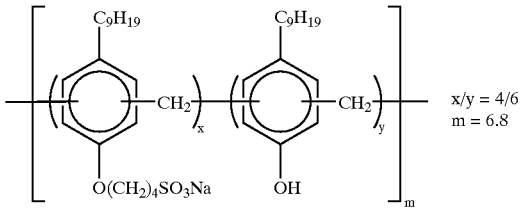 x/y = 4/6<br>m = 6.8 |
| Surfactant (5) | 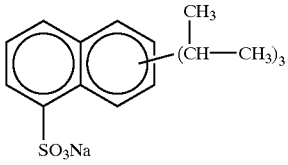 |
| Surfactant (6) | 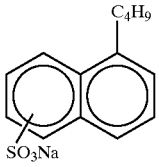 |
| Surfactant (7) | 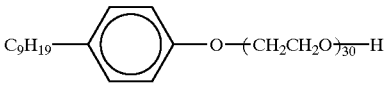 |
| Hydroquinone A: | 2,5-di-t-octylhydroquinone |
| Ultraviolet absorber (1) | 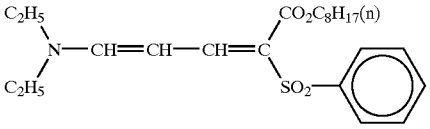 |

TABLE 3-continued
Ultraviolet absorber (2)
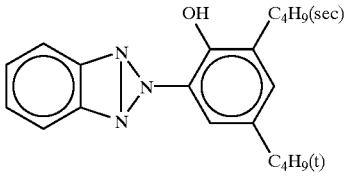
Ultraviolet absorber (3)
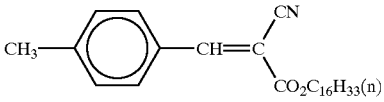
High-boiling organic solvent (1)
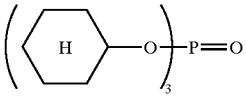
High-boiling organic solvent (2)
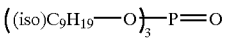
Ultraviolet absorber (4)
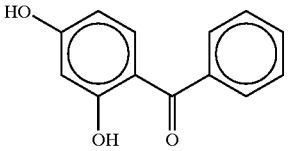
Ultraviolet absorber (5)
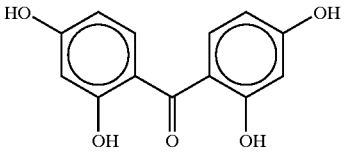
Hardener (1) $CH_2{=}CHSO_2CH_2CONH(CH_2)_2NHCOCH_2SO_2CH{=}CH_2$
Hardener (2) $CH_2{=}CHSO_2CH_2CONH(CH_2)_3NHCOCH_2SO_2CH{=}CH_2$
Hardener (3)
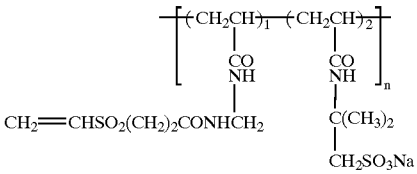
Hardener (4)
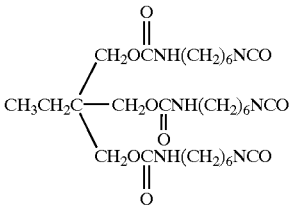
Nucleating agent (1)
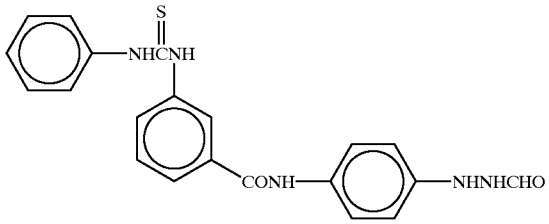

TABLE 3-continued

Polymer mordant (1)

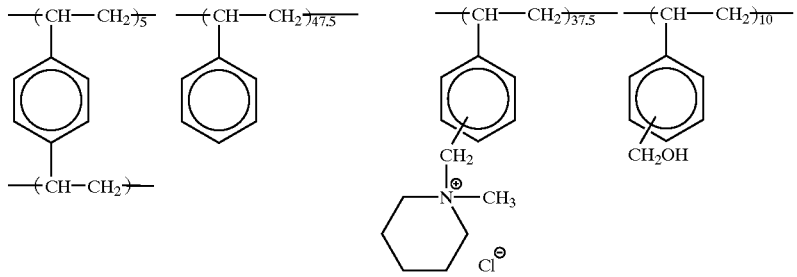

Production of a cover sheet

A layer configuration as shown in Table 4 was formed by application on a 75-μm-thick transparent support to produce a cover sheet.

TABLE 4

Configulation of cover sheet

| Layer number | Name of layer | Additive | Coated amount (g/m$^2$) |
|---|---|---|---|
| 3rd layer | Temperature compensating layer | Temperature compensating polymer (1) | 0.30 |
| | | Temperature compensating polymer (2) | 0.80 |
| | | Surfactant (8) | 0.005 |
| 2nd layer | Alkali barrier layer | Cellulose acetate (acetylation degree: 51%) | 4.30 |
| | | Additive (20) | 0.20 |
| | | Additive (21) | 0.20 |
| | | Hardener (2) | 0.40 |
| 1st layer | Neutralizing layer | Acidic polymer (1) | 10.40 |
| | | Cellulose acetate (acetylation degree: 45%) | 0.70 |
| | | Hardener (5) | 0.10 |
| Support (polyethylene terephthalate containing additive (22) for preventing light piping, and provided with an undercoat, 75 μm) | | | |
| Backing layer | Curling controll layer | Cellulose acetate (acetylation degree: 55%) | 9.10 |
| | | Silica | 0.04 |

In the following, the chemical structures or the like of the compounds used in the cover sheet are shown.

Surfactant (8)

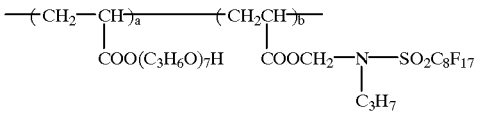

a/b is 6/4
(wt ratio)
Mw 30000~50000

Additive (20)

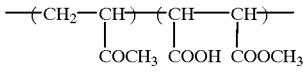

-continued

Additive (21)

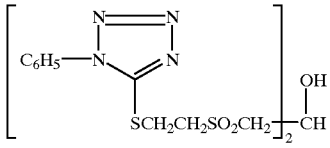

Hardener (5)

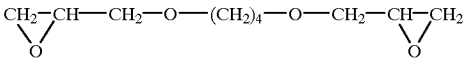

Additive (22)

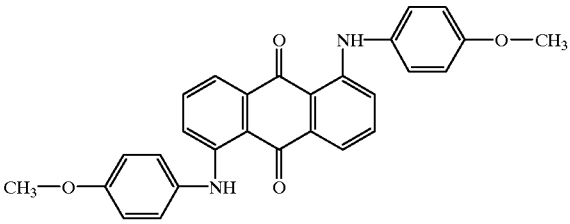

Temperature compensating polymer (1)

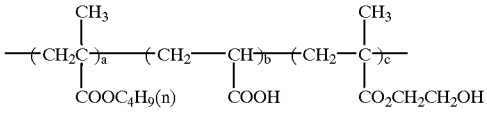

a/b/c = 66.1/5.5/28.4
(wt ratio)

Temperature compensating polymer (2)

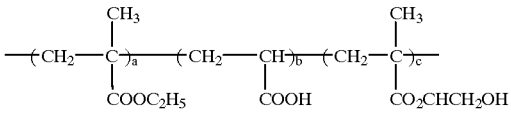

a/b/c = 66.1/5.5/28.4
(wt ratio)

Acidic polymer (1)

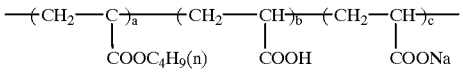

a/b/c = 20/76/4
(mole ratio)

The formulation of the alkali processing composition is shown below.

| | |
|---|---|
| Silver nitrate | 0.10 g |
| Carbon black (manufactured by Dainichiseika Color & Chemicals Mfg Co., Ltd.) | 160 g |
| Additive (23) | 8.60 g |
| Carboxymethylcellulose Na salt | 58.0 g |
| Benzyl alcohol | 2.50 g |
| Additive (24) | 2.10 g |
| Potassium sulfite (anhydrate) | 1.90 g |
| 5-Methylbenzotriazole | 2.50 g |
| 1-p-Tolyl-4-hydroxymethyl-4-methyl-3-pyrazolidone | 7.00 g |
| 1-Phenyl-4-hydroxymethyl-4-methyl-3-pyrazolidone | 10.0 g |
| Potassium hydrate | 56.0 g |
| Aluminum nitrate | 0.60 g |
| Zinc nitrate | 0.60 g |
| Additive (25) | 6.60 g |
| Additive (14) | 1.80 g |
| 1,2-Benzisothiazoline-3-on | 0.003 g |

Additive (23)

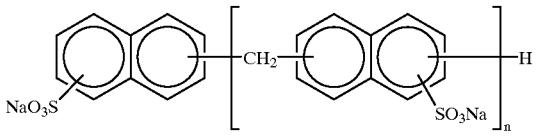

Additive (24)

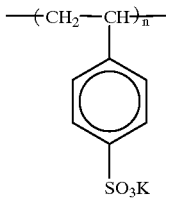

Additive (25)

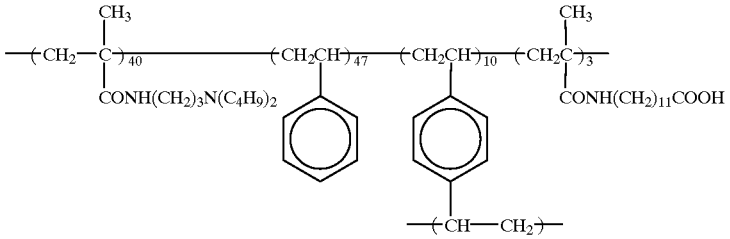

Light-sensitive materials 102 to 126 were prepared in the same manner, except that the compounds shown in Table 5 were added to each of the 7th, 8th, 13th, 14th, 19th and 20th layers of the light-sensitive material 101 in each amount shown in Table 5 or alternatively, the compounds shown in Table 5 were added to each of the 7th, 8th, 10th, 13th, 14th, 16th, 19th and 20th layers of the light-sensitive material 101 in each amount shown in Table 5.

TABLE 5

| | | Added amount ($10^{-6}$ mmol/m$^2$) | | | | | | | | |
|---|---|---|---|---|---|---|---|---|---|---|
| No. | Compound | 7th layer | 8th layer | 10th layer | 13th layer | 14th layer | 16th layer | 19th layer | 20th layer | Remarks |
| 101 | I-68 | 62.0 | 15.1 | — | 6.70 | 5.46 | — | 6.20 | 7.20 | Comparative example |
| 102 | I-68 | 124.0 | 30.2 | — | 13.4 | 10.9 | — | 12.4 | 14.4 | Comparative example |
| 103 | I-69 | 3.10 | 7.55 | — | 3.35 | 2.73 | — | 3.10 | 3.60 | Comparative example |
| 104 | I-69 | 62.0 | 15.1 | — | 6.70 | 5.46 | — | 6.20 | 7.20 | Comparative example |

TABLE 5-continued

| No. | Compound | Added amount ($10^{-6}$ mmol/m$^2$) 7th layer | 8th layer | 10th layer | 13th layer | 14th layer | 16th layer | 19th layer | 20th layer | Remarks |
|---|---|---|---|---|---|---|---|---|---|---|
| 105 | I-71 | 7.44 | 18.1 | — | 8.04 | 6.55 | — | 7.44 | 8.64 | Comparative example |
| 106 | I-71 | 14.9 | 36.2 | — | 16.1 | 13.1 | — | 14.9 | 17.3 | Comparative example |
| 107 | I-10a | 18.6 | 4.53 | — | 2.01 | 1.64 | — | 1.86 | 2.16 | Comparative example |
| 108 | I-10a | 62.0 | 15.1 | — | 6.70 | 5.46 | — | 6.20 | 7.20 | Comparative example |
| 109 | I-75 | 3.10 | 7.55 | — | 3.35 | 2.73 | — | 3.10 | 3.60 | Comparative example |
| 110 | I-75 | 62.0 | 15.1 | — | 6.70 | 5.46 | — | 6.20 | 7.20 | Comparative example |
| 111 | I-68 | 62.0 | 15.1 | — | 6.70 | 5.46 | — | 6.20 | 7.20 | This invention |
| | IV-B-6 | — | — | 500 | — | — | 500 | — | — | This invention |
| 112 | I-68 | 62.0 | 15.1 | — | 6.70 | 5.46 | — | 6.20 | 7.20 | This invention |
| | III-1 | — | 50.0 | — | — | 50.0 | — | — | 50.0 | This invention |
| 113 | I-68 | 62.0 | 15.1 | — | 6.70 | 5.46 | — | 6.20 | 7.20 | This invention |
| | III-1 | 40.0 | 60.0 | — | 30.0 | 60.0 | — | 40.0 | 70.0 | This invention |
| 114 | I-68 | 62.0 | 15.1 | — | 6.70 | 5.46 | — | 6.20 | 7.20 | This invention |
| | IV-B-24 | — | — | 500 | — | — | 500 | — | — | This invention |
| 115 | I-68 | 62.0 | 15.1 | — | 6.70 | 5.46 | — | 6.20 | 7.20 | This invention |
| | IV-A-3 | — | — | 500 | — | — | 500 | — | — | This invention |
| 116 | I-68 | 62.0 | 15.1 | — | 6.70 | 5.46 | — | 6.20 | 7.20 | This invention |
| | II-2 | — | — | 500 | — | — | 500 | — | — | This invention |
| 117 | I-68 | 62.0 | 15.1 | — | 6.70 | 5.46 | — | 6.20 | 7.20 | This invention |
| | IV-B-22 | — | — | 500 | — | — | 500 | — | — | This invention |
| 118 | I-68 | 62.0 | 15.1 | — | 6.70 | 5.46 | — | 6.20 | 7.20 | This invention |
| | V-17 | — | — | 500 | — | — | 500 | — | — | This invention |
| 119 | I-69 | 3.10 | 7.55 | — | 3.35 | 2.73 | — | 3.10 | 3.60 | This invention |
| | IV-B-6 | — | — | 500 | — | — | 500 | — | — | This invention |
| 120 | I-69 | 3.10 | 7.55 | — | 3.35 | 2.73 | — | 3.10 | 3.60 | This invention |
| | III-1 | 40.0 | 60.0 | — | 30.0 | 60.0 | — | 40.0 | 70.0 | This invention |
| 121 | I-71 | 6.0 | 15.1 | — | 6.70 | 5.46 | — | 6.20 | 7.20 | This invention |
| | IV-B-6 | — | — | 500 | — | — | 500 | — | — | This invention |
| 122 | I-71 | 62.0 | 15.1 | — | 6.70 | 5.46 | — | 6.20 | 7.20 | This invention |
| | III-1 | 40.0 | 60.0 | — | 30.0 | 60.0 | — | 40.0 | 70.0 | This invention |
| 123 | I-10a | 62.0 | 15.1 | — | 6.70 | 5.46 | — | 6.20 | 7.20 | This invention |
| | IV-B-6 | — | — | 500 | — | — | 500 | — | — | This invention |
| 124 | I-10a | 62.0 | 15.1 | — | 6.70 | 5.46 | — | 6.20 | 7.20 | This invention |
| | III-1 | 40.0 | 60.0 | — | 30.0 | 60.0 | — | 40.0 | 70.0 | This invention |
| 125 | I-75 | 62.0 | 15.1 | — | 6.70 | 5.46 | — | 6.20 | 7.20 | This invention |
| | IV-B-6 | — | — | 500 | — | — | 500 | — | — | This invention |
| 126 | I-75 | 62.0 | 15.1 | — | 6.70 | 5.46 | — | 6.20 | 7.20 | This invention |
| | III-1 | 40.0 | 60.0 | — | 30.0 | 60.0 | — | 40.0 | 70.0 | This invention |

Next, each of the above light-sensitive elements 101 to 126 was exposed to light from the emulsion layer side, through a gray continuous wedge, and then overlapped with the aforementioned cover sheet. The aforementioned alkali processing composition was developed between both materials by using a pressure roller, such that the thickness of the composition became 62 $\mu$m. The sample was processed at 25° C., after 2 hours, the transferred density was measured by a color densitometer to evaluate each of yellow, magenta and cyan colors for the maximum density, the minimum density, and the point of sensitivity that obtained a density of 1.0. Further, the time required for an image to emerge since the processing was finished, was measured.

Moreover, after the sample was stored at 35° C. under a humidity of 55% for one month in an incubator, the same operation as the above was performed to find changes in the sensitivvity point giving a density of 1.0 and the minimum image density (Dmin).

The results of measurement are listed in Table 6.

TABLE 6

| Sample No. | Image emergence time (seconds) | Maximum image density R | G | B | Change of sensitivity point that gives density of 1.0, after 35° C., 55%, 1M R | G | B | (Dmin after 35° C., 55%, 1M) - (Dmin before aging) R | G | B |
|---|---|---|---|---|---|---|---|---|---|---|
| 101 | 40 | 2.25 | 2.10 | 1.75 | 0.13 | 0.15 | 0.11 | 0.020 | 0.015 | 0.010 |
| 102 | 36 | 2.35 | 2.18 | 1.84 | 0.26 | 0.27 | 0.18 | 0.030 | 0.028 | 0.015 |
| 103 | 39 | 2.28 | 2.14 | 1.73 | 0.15 | 0.16 | 0.12 | 0.019 | 0.015 | 0.011 |
| 104 | 36 | 2.36 | 2.20 | 1.85 | 0.28 | 0.29 | 0.20 | 0.027 | 0.027 | 0.014 |
| 105 | 41 | 2.24 | 2.12 | 1.76 | 0.13 | 0.15 | 0.11 | 0.020 | 0.015 | 0.010 |
| 106 | 37 | 2.37 | 2.20 | 1.85 | 0.25 | 0.26 | 0.18 | 0.029 | 0.026 | 0.016 |
| 107 | 35 | 2.30 | 2.05 | 1.70 | 0.16 | 0.18 | 0.14 | 0.017 | 0.012 | 0.007 |
| 108 | 33 | 2.36 | 2.11 | 1.80 | 0.30 | 0.32 | 0.22 | 0.024 | 0.023 | 0.011 |
| 109 | 41 | 2.27 | 2.12 | 1.78 | 0.12 | 0.12 | 0.09 | 0.018 | 0.014 | 0.011 |

TABLE 6-continued

| Sample | Image emergence time | Maximum image density | | | Change of sensitivity point that gives density of 1.0, after 35° C., 55%, 1M | | | (Dmin after 35° C., 55%, 1M) - (Dmin before aging) | | |
|---|---|---|---|---|---|---|---|---|---|---|
| No. | (seconds) | R | G | B | R | G | B | R | G | B |
| 110 | 37 | 2.36 | 2.20 | 1.83 | 0.24 | 0.24 | 0.14 | 0.026 | 0.024 | 0.013 |
| 111 | 35 | 2.35 | 2.18 | 1.85 | 0.08 | 0.08 | 0.06 | 0.014 | 0.010 | 0.005 |
| 112 | 36 | 2.30 | 2.17 | 1.80 | 0.11 | 0.12 | 0.08 | 0.016 | 0.012 | 0.006 |
| 113 | 34 | 2.33 | 2.22 | 1.84 | 0.09 | 0.10 | 0.06 | 0.013 | 0.009 | 0.005 |
| 114 | 37 | 2.29 | 2.18 | 1.79 | 0.11 | 0.11 | 0.08 | 0.015 | 0.011 | 0.007 |
| 115 | 38 | 2.30 | 2.19 | 1.80 | 0.11 | 0.12 | 0.07 | 0.015 | 0.012 | 0.010 |
| 116 | 37 | 2.31 | 2.18 | 1.80 | 0.09 | 0.12 | 0.07 | 0.016 | 0.014 | 0.009 |
| 117 | 36 | 2.30 | 2.19 | 1.82 | 0.11 | 0.11 | 0.08 | 0.016 | 0.012 | 0.008 |
| 118 | 36 | 2.31 | 2.20 | 1.81 | 0.10 | 0.11 | 0.08 | 0.015 | 0.013 | 0.008 |
| 119 | 34 | 2.35 | 2.20 | 1.84 | 0.10 | 0.11 | 0.07 | 0.014 | 0.011 | 0.005 |
| 120 | 33 | 2.34 | 2.18 | 1.86 | 0.11 | 0.11 | 0.06 | 0.014 | 0.009 | 0.006 |
| 121 | 35 | 2.36 | 2.20 | 1.90 | 0.08 | 0.09 | 0.05 | 0.014 | 0.011 | 0.006 |
| 122 | 35 | 2.35 | 2.20 | 1.89 | 0.07 | 0.10 | 0.06 | 0.013 | 0.010 | 0.006 |
| 123 | 33 | 2.36 | 2.17 | 1.85 | 0.06 | 0.07 | 0.04 | 0.007 | 0.008 | 0.004 |
| 124 | 32 | 2.35 | 2.16 | 1.84 | 0.06 | 0.07 | 0.05 | 0.008 | 0.007 | 0.005 |
| 125 | 35 | 2.38 | 2.20 | 1.92 | 0.10 | 0.09 | 0.06 | 0.009 | 0.008 | 0.005 |
| 126 | 35 | 2.37 | 2.21 | 1.93 | 0.09 | 0.08 | 0.06 | 0.008 | 0.009 | 0.006 |

As is clear from the aforementioned Table 6, it is understood that the use of the compound for use in the present invention made it possible to obtain a photographic light-sensitive material, which was reduced in the time required for an image to emerge, had a high maximum image density, and was reduced in sensitivity change and in the rise of the minimum image density after storage.

Example 2

In the aforementioned Example 1, the same experiment as in Example 1 was conducted, except that the aforementioned alkali processing composition was developed such that the thickness became 49 $\mu$m. It was found that the use of the compound for use in the present invention made it possible to obtain a photographic light-sensitive material, which was reduced in the time required for an image to emerge, had a high maximum image density, and was reduced in sensitivity change and in the rise of the minimum image density after storage.

Example 3

The following layer structure was coated on a support of 100-$\mu$m-thick transparent polyethylene terephthalate film, to produce a light-sensitive element 301.

Back layer side:

(a) A light-shielding layer containing 6.0 g/m$^2$ of carbon black and 2.0 g/m$^2$ of a gelatin.

(b) A protective layer containing 0.5 g/m$^2$ of a gelatin.

Emulsion layer side:

(1) A layer containing 3.7 g/m$^2$ of titanium dioxide and 0.5 g/m$^2$ of a gelatin.

(2) A color material layer containing 0.46 g/m$^2$ of the following cyan dye-releasing redox compound, 0.07 g/m$^2$ of tricyclohexyl phosphate, 0.05 g/m$^2$ of the following dispersion aid (A), 0.06 g/m$^2$ of the following dispersion aid (B), and 0.5 g/m$^2$ of a gelatin.

Cyan dye-releasing redox compound

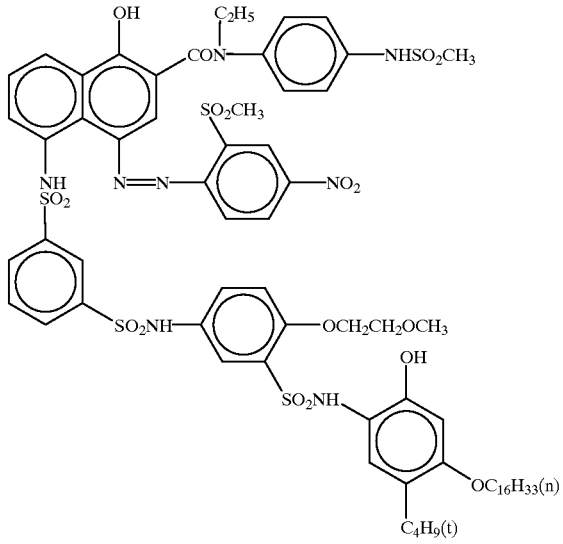

Dispersion aid (A)

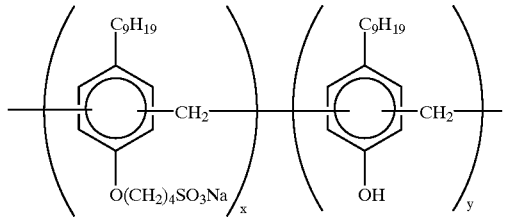

x:y = 4:6

-continued

Dispersion aid (B)

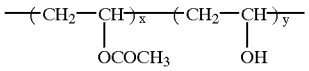

x:y = 12:88
(Average molecular weight 100,000)

(3) A layer containing 0.5 g/m$^2$ of a gelatin.

(4) A red-sensitive emulsion layer containing a red-sensitive internal latent image type direct positive silver bromide emulsion (average particle size: 0.65 $\mu$m, 0.11 g/m$^2$ as the amount of silver), 0.3 g/m$^2$ of a gelatin, 0.003 g/m$^2$ of the following nucleating agent, and 0.02 g/m$^2$ of 2-sulfo-5-n-pentadecylhydroquinone sodium salt.

Nucleating agent

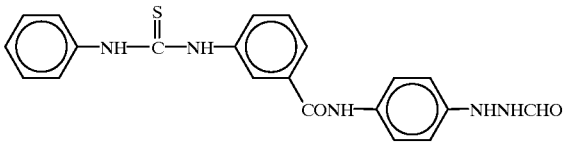

(5) A red-sensitive emulsion layer containing a red-sensitive internal latent image type direct positive silver bromide emulsion (average particle size: 0.98 $\mu$m, 0.23 g/m$^2$ as the amount of silver), 0.4 g/m$^2$ of a gelatin, 0.04 g/m$^2$ of 2-sulfo-5-n-pentadecylhydroquinone sodium salt, and 0.005 mg/m$^2$ of the same nucleating agent as that of the layer (4).

(6) A color-mixing prevention layer containing 0.61 g/m$^2$ of 2,5-di-t-pentadecylhydroquinone, 0.33 g/m$^2$ of the following polymer dispersant, and 0.3 g/m$^2$ of a gelatin.

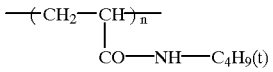

(Molecular weight 300,000)

(7) An intermediate layer containing 0.2 g/m$^2$ of a gelatin

.

(8) A color material layer containing 0.4 6 g/m$^2$ of the following magenta dye-releasing redox compound, 0.04 g/m$^2$ of the same dispersion aid (A) as that of the layer (2), and 0.07 g/m$^2$ of the same dispersion aid (B) as that of the layer (2), and 0.7 g/m$^2$ of a gelatin.

Magenta dye-releasing redox compound

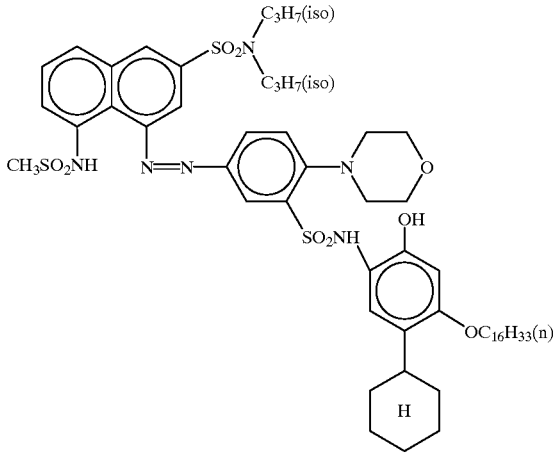

(9) A green-sensitive emulsion layer containing a green-sensitive internal latent image type direct positive silver bromide emulsion (average particle size: 0.65 $\mu$m, 0.11 g/m$^2$ as the amount of silver), 0.2 g/m$^2$ of a gelatin, 0.005 mg/m$^2$ of the same nucleating agent as that of the layer (4), and 0.02 g/m$^2$ of 2-sulfo-5-n-pentadecylhydroquinone sodium salt.

(10) A green-sensitive emulsion layer containing a green-sensitive internal latent image type direct positive silver bromide emulsion (average particle size: 0.98 $\mu$m, 0.26 g/m$^2$ as the amount of silver), 0.6 g/m$^2$ of a gelatin, 0.004 mg/m$^2$ of the same nucleating agent as that of the layer (4), and 0.04 g/m$^2$ of 2-sulfo-5-n-pentadecylhydroquinone sodium salt.

(11) A color-mixing prevention layer containing 0.91 g/m$^2$ of 2,5-di-t-pentadecylhydroquinone, 0.29 g/m$^2$ of the following polymer dispersant, and 0.4 g/m$^2$ of a gelatin.

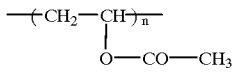

(Molecular weight 200,000)

(12) The same layer as the layer (7).

(13) A color material layer containing 0.53 g/m$^2$ of a yellow dye-releasing redox compound having the following structure, 0.16 g/m$^2$ of tricyclohexyl phosphate, 0.05 g/m$^2$ of the same dispersion aid (A) as that of the layer (2), and 0.03 g/m$^2$ of the same dispersion aid (B) as that of the layer (2), and 0.5 g/m$^2$ of a gelatin.

Yellow dye-releasing redox compound

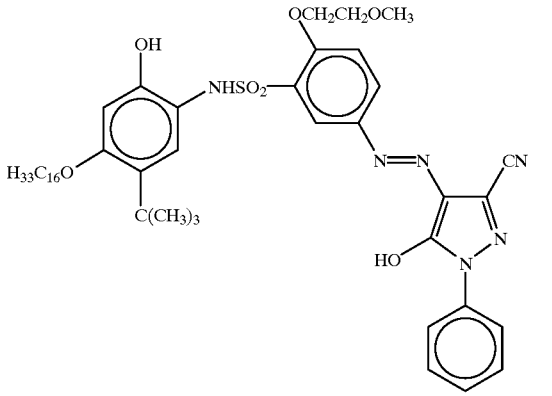

(14) A blue-sensitive emulsion layer containing a blue-sensitive internal latent image type direct positive silver bromide emulsion (average particle size: 0.65 μm, 0.15 g/m$^2$ as the amount of silver), 0.2 g/m$^2$ of a gelatin, 0.006 mg/m$^2$ of the same nucleating agent as that of the layer (4), and 0.01 g/m$^2$ of 2-sulfo-5-n-pentadecylhydroquinone sodium salt.

(15) A blue-sensitive emulsion layer containing a blue-sensitive internal latent image type direct positive silver bromide emulsion (average particle size: 0.98 μm, 0.23 g/m$^2$ as the amount of silver), 0.3 g/m$^2$ of a gelatin, 0.005 mg/m$^2$ of the same nucleating agent as that of the layer (4), and 0.01 g/m$^2$ of 2-sulfo-5-n-pentadecylhydroquinone sodium salt.

(16) A ultraviolet absorbing layer containing 0.12 g/m$^2$ of each of the following ultraviolet absorbers (A) and (B), and 0.5 g/m$^2$ of a gelatin.

Ultraviolet absorber (A)

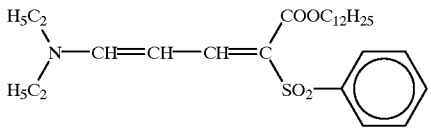

Ultraviolet absorber (B)

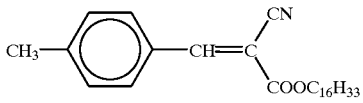

(17) A protective layer containing 0.2 g/m$^2$ of a matte agent (PMMA), 0.11 g/m$^2$ of the following hardener (A), 0.03 g/m$^2$ of the following hardener (B), and 0.4 g/m$^2$ of a gelatin.

Hardener (A)

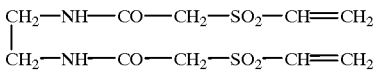

Hardener (B)

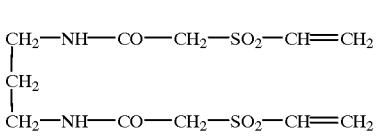

Next, a layer structure as shown below was coated on a 150-μm-thick paper support laminated with a 20-μm-thick polyethylene on each of both surfaces thereof, to produce an image-receiving element (101).

Back layer side:

(a) A light-shielding layer containing 2.8 g/m$^2$ of carbon black, and 4.8 g/m$^2$ of a gelatin.

(b) A white layer containing 4.1 g/m$^2$ of titanium dioxide, and 1.0 g/m$^2$ of a gelatin.

(c) A protective layer containing 0.5 g/m$^2$ of a gelatin.

Image-receiving layer side:

(1) A neutralizing layer containing 4.0 g/m$^2$ of an acrylic acid/butyl acrylate copolymer (mol ratio: 8:2, average molecular weight: 50,000), and 0.04 g/m$^2$ of polyvinyl alcohol (degree of polymerization: 500, saponification ratio: 88%), and 0.04 g/m$^2$ of the following compound (F).

Hardener (F)

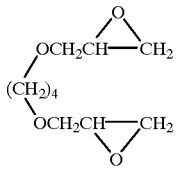

(2) A timing layer containing 3.5 g/m$^2$ of diacetyl cellulose (degree of acetylation: 51.3%), 0.39 g/m$^2$ of a styrene/maleic anhydride copolymer (mol ratio: 1:1, average molecular weight: 10000), 0.07 g/m$^2$of the following compound (B), and 0.098 g/m$^2$ of Coronate HL (trade name, manufactured by Nippon Polyurethane Industry CO., LTD.).

Compound B

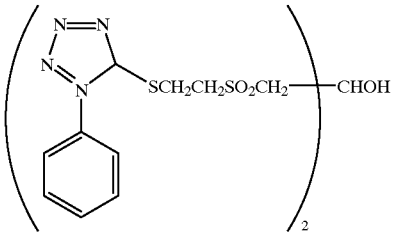

(3) A timing layer containing 1.32 g/m$^2$ of a polymer latex (one produced by way of emulsion-polymerization of styrene/butyl acrylate/N-methylolacrylamide, in a ratio by mass of 49.7/42.3/8), 1.32 g/m$^2$ of a polymer latex (one produced by way of emulsion-polymerization of methylmethacrylate/acrylic acid/N-methylolacrylamide, in a ratio of 93/3/4), 0.162 g/m$^2$ of the following compound (C), and 0.0148 g/m$^2$ of the following coating aid (D).

Compound C

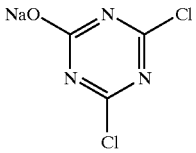

Coating aid (D)

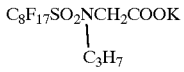

(5) A mordant layer containing 3.7 g/m$^2$ of the following mordant (E), 0.21 g/m$^2$ of formaldehyde, 0.10 g/m$^2$ of the aforementioned hardener (F), 0.01 g/m$^2$ of the aforementioned coating aid (D), and 2.8 g/m$^2$ of a gelatin.

Mordant (E)

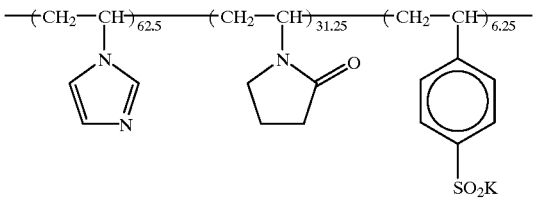

(6) A peeling layer containing 0.06 g/m$^2$ of an acrylic acid/butylmethacrylate copolymer (mol ratio: 85:15, average molecular weight: 100,000), and 0.003 g/m$^2$ of the following compound (H).

Compound (H)

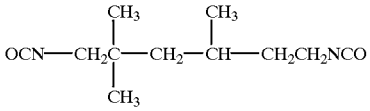

Moreover, each of 1 g of a processing solution having the following composition was filled in a pod made of an aluminum foil, on which vinyl chloride was laminated, under a nitrogen atmosphere, to produce an alkali processing composition.

| | |
|---|---|
| Hydroxyethyl cellulose | 42 g |
| Zinc nitrate.6$H_2O$ | 0.9 g |
| 5-Methylbenzotriazole | 5.4 g |
| Benzyl alcohol | 3.4 ml |
| Titanium dioxide | 1.2 g |
| Aluminum nitrate.9$H_2O$ | 15 g |
| Potassium sulfite | 1.0 g |
| 1-Phenyl-4-hydroxy-4-hydroxymehtyl-3-pyrazolidone | 13.0 g |
| Potassium hydroxide | 63 g |
| Water | 854 ml |

In the above light-sensitive element, a combination of the compounds according to the present invention was added to a red-sensitive emulsion layer, a green-sensitive emulsion layer, and a blue-sensitive emulsion layer. It was found that the use of the compound for use in the present invention made it possible to obtain a photographic light-sensitive material, which was reduced in the time required for an image to emerge, had a high maximum image density, and was reduced in sensitivity change and in the rise of the minimum image density.

Having described our invention as related to the present embodiments, it is our intention that the invention not be limited by any of the details of the description, unless otherwise specified, but rather be construed broadly within its spirit and scope as set out in the accompanying claims.

What we claim is:

1. A color diffusion-transfer light-sensitive material comprising, on a support, at least two light-sensitive silver halide emulsion layers, which are combined with a non-diffusive dye image forming compound that forms or releases a diffusive dye or its precursor in association with silver development, or with a dye image forming compound whose diffusibility changes in association with silver development, wherein the light-sensitive material comprises a compound represented by the following formula (I) and a compound represented by the following formulae (III)

Formula (I)

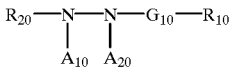

wherein, $R_{20}$ represents an aliphatic group, an aromatic group or a heterocyclic group; $R_{10}$ represents a hydrogen atom or a block group; $G_{10}$ represents —CO—, —COCO—, —C(=S)—, —$SO_2$—, —SO—, or —PO($R_{30}$)— (in which $R_{30}$ is selected from the same range of the groups as defined for $R_{10}$, and $R_{30}$ may be different from $R_{10}$) or an iminomethylene group; and $A_{10}$ and $A_{20}$ each represent a hydrogen atom, or one of $A_{10}$ and $A_{20}$ represents a hydrogen atom and the other represents a substituted or unsubstituted alkylsulfonyl group, a substituted or unsubstituted arylsulfonyl group, or a substituted or unsubstituted acyl group;

Formula (III)

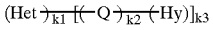

wherein, Het represents an adsorptive group to a silver halide, provided that the group represented by Het is substituted with at least one —(Q)k2—(Hy), where Q represents a divalent connecting group that comprises an atom or atomic group containing at least one of a carbon atom, a nitrogen atom, a sulfur atom, and an oxygen atom; and Hy represents a group having a hydrazine structure represented by $R_1R_2N$—$NR_3R_4$, where each of $R_1$, $R_2$, $R_3$ and $R_4$ independetly represent an alkyl group, an alkenyl group, an alkinyl group, an aryl group, or a heterocyclic group, and $R_1$ and $R_2$, $R_3$ and $R_4$, $R_1$ and $R_3$, or $R_2$ and $R_4$ may respectively bond to form a ring, provided that at least one of $R_1$, $R_2$, $R_3$ and $R_4$ is an alkylene group, an alkenylene group, an alkinylene group, an arylene group, or a divalent heterocyclic residue, to be substituted by —(Q)k2—(Het)k1; k1 and k3 independently denote 1, 2, 3 or 4, and k2 denotes 0 or 1; wherein the compound represented by formula (III) is added to a silver halide emulsion layer or a non-light-sensitive layer.

2. The color diffusion-transfer light-sensitive material as claimed in claim 1, wherein the compound represented by formula (III) is added in an amount of $1\times10^{-9}$ to $5\times10^{-2}$ mol per mol of the silver halide.

3. A color diffusion-transfer light-sensitive material comprising, on a support, at least two light-sensitive silver halide emulsion layers, which are combined with a non-diffusive dye image forming compound that forms or releases a diffusive dye or its precursor in association with silver development, or with a dye image forming compound whose diffusibility changes in association with silver development, wherein the light-sensitive material comprises a compound represented by the following formula (I) and a compound represented by the following formulae (IV-A)–(IV-C)

Formula (I)

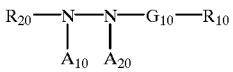

wherein, $R_{20}$ represents an aliphatic group, an aromatic group or a heterocyclic group; $R_{10}$ represents a hydrogen atom or a block group; $G_{10}$ represents —CO—, —COCO—, —C(=S)—, —$SO_2$—, —SO—, or —PO $(R_{30})$— (in which $R_{30}$ is selected from the same range of the groups as defined for $R_{10}$, and $R_{30}$ may be different from $R_{10}$) or an iminomethylene group; and $A_{10}$ and $A_{20}$ each represent a hydrogen atom, or one of $A_{10}$ and $A_{20}$ represents a hydrogen atom and the other represents a substituted or unsubstituted alkylsulfonyl group, a substituted or unsubstituted arylsulfonyl group, or a substituted or unsubstituted acyl group;

formula (IV-A)

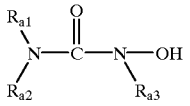

formula (IV-B)

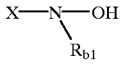

formula (IV-C)

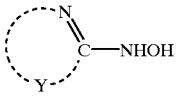

wherein, of the formula (IV-A), $R_{a1}$ represents a substituted or unsubstituted alkyl, alkenyl, or aryl group, $R_{a2}$ represents a hydrogen atom or a group defined for $R_{a1}$, $R_{a3}$ represents a hydrogen atom or a substituted or unsubstituted alkyl or alkenyl group having 1 to 10 carbon atoms, $R_{a1}$ and $R_{a3}$, or $R_{a2}$ and $R_{a3}$ may bond with each other to form a five- to seven-membered ring;

in the formula (IV-B), X represents a heterocyclic group, $R_{b1}$ represents an alkyl group, an alkenyl group or an aryl group, X and $R_{b1}$ may bond with each other to form a five- to seven-membered ring; and in the formula (IV-C), Y represents a non-metal atomic group required to form a five-membered ring in combination with a —N═C— group; Y further represents a non-metal atomic group required to form a six-membered ring in combination with a —N═C— group, and the end of Y, which connects with a carbon atom of the —N═C— group, represents one group (that connects with the carbon atom of the —N═C— group on the left side of each group) selected from the group consisting of $—N(R_{c1})—$, $—C(R_{c2})(R_{c3})—$, $—C(R_{c4})═$, —O— and S—, each of $R_{c1}$ to $R_{c4}$ respectively represent a hydrogen atom or a substituent;

wherein the compound represented by formulae (IV-A)–(IV-C) is added to a silver halide emulsion layer or a non-light-sensitive layer.

4. The color diffusion-transfer light-sensitive material as claimed in claim 3, wherein the compound represented by formula (IV-A), (IV-B), or (IV-C) is added in an amount of $1\times1^{-6}$ to $5\times10^{-2}$ mol per mol of the silver halide.

* * * * *